US009314060B2

(12) United States Patent
Giles

(10) Patent No.: US 9,314,060 B2
(45) Date of Patent: Apr. 19, 2016

(54) ENHANCED RECOIL ATTENUATING SAFETY HELMET

(71) Applicant: Tate Technology, LLC, Pacific Palisades, CA (US)

(72) Inventor: Brian C. Giles, Scottsdale, AZ (US)

( * ) Notice: Subject to any disclaimer, the term of this patent is extended or adjusted under 35 U.S.C. 154(b) by 256 days.

(21) Appl. No.: 13/915,572

(22) Filed: Jun. 11, 2013

(65) Prior Publication Data

US 2013/0340147 A1 Dec. 26, 2013

Related U.S. Application Data

(60) Provisional application No. 61/658,303, filed on Jun. 11, 2012.

(51) Int. Cl.

| | |
|---|---|
| ***A42B 3/00*** | (2006.01) |
| ***A42B 3/22*** | (2006.01) |
| ***A42B 3/12*** | (2006.01) |
| ***A42B 3/18*** | (2006.01) |
| ***A42B 3/20*** | (2006.01) |
| ***A42B 3/06*** | (2006.01) |

(52) U.S. Cl.

CPC . *A42B 3/00* (2013.01); *A42B 3/063* (2013.01); *A42B 3/124* (2013.01); *A42B 3/128* (2013.01); *A42B 3/18* (2013.01); *A42B 3/20* (2013.01); *A42B 3/22* (2013.01); *A42B 3/221* (2013.01)

(58) Field of Classification Search

CPC ..... A42B 3/00; A42B 3/124; A42B 3/128; A42B 3/18; A42B 3/22; A42B 3/221

USPC ..... 2/410–412, 5, 6.6, 6.8, 414, 417, 15, 2/427, 9, 424, 425; 428/80, 402

See application file for complete search history.

(56) References Cited

U.S. PATENT DOCUMENTS

| | | | | |
|---|---|---|---|---|
| 2,739,309 | A | 3/1956 | Frieder | |
| 4,233,687 | A | 11/1980 | Lancellotti | |
| 4,343,047 | A | 8/1982 | Lazowski | |
| 5,101,517 | A * | 4/1992 | Douglas | 2/424 |
| 6,219,850 | B1 | 4/2001 | Halstead | |
| 7,971,281 | B2 | 7/2011 | Imai | |
| 2012/0036620 | A1 | 2/2012 | Harris | |
| 2012/0251835 | A1 * | 10/2012 | Dry | 428/454 |
| 2013/0298316 | A1 * | 11/2013 | Jacob | 2/414 |

FOREIGN PATENT DOCUMENTS

JP 9-105014 A 4/1997

OTHER PUBLICATIONS

International Search Report and Written Opinion issued in related PCT/US2013/045271 on Jan. 17, 2014.

* cited by examiner

*Primary Examiner* — Khaled Annis

(74) *Attorney, Agent, or Firm* — Jeffer Mangels Butler & Mitchell, LLP

(57) ABSTRACT

A reinforced and impact attenuating helmet comprising a shell configured to receive a head of a wearer of the helmet, the shell comprising an outer surface and an inner surface; a series of linked coils; filler material; wherein the series of linked coils are entirely encased within the filler material to form a reinforcement layer, the reinforcement layer having a first surface and an opposing surface, the first surface of the reinforcement layer generally facing toward the inner surface of the shell, the reinforcement layer being located proximate the inner surface of the shell, forming a basic helmet assembly.

37 Claims, 49 Drawing Sheets

FIG.12
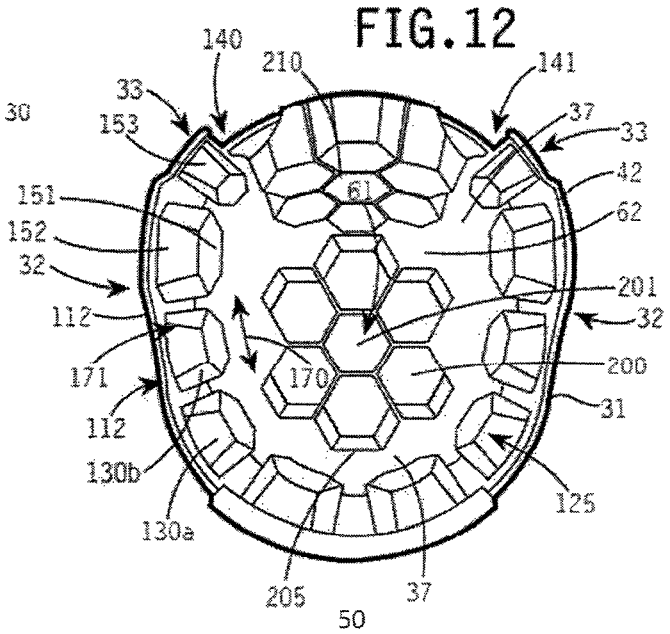
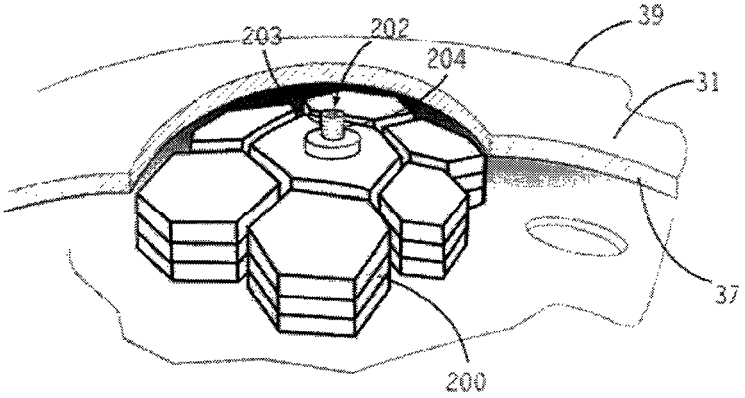
FIG.13

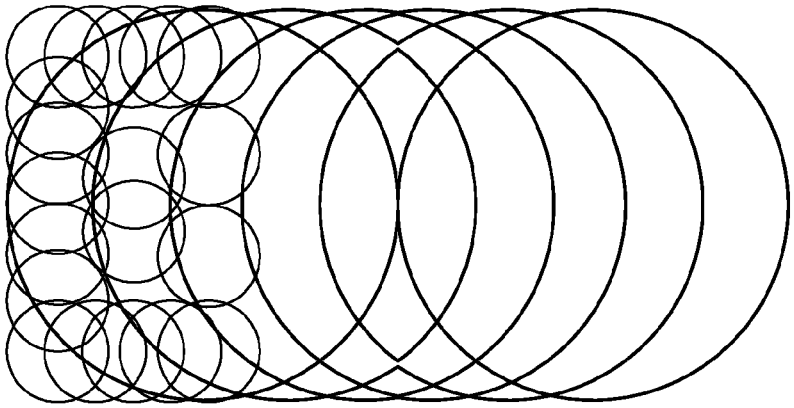
FIG. 42A
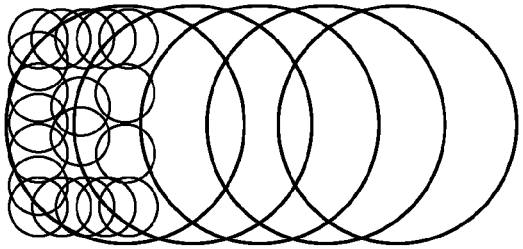
FIG. 42B
FIG. 42C
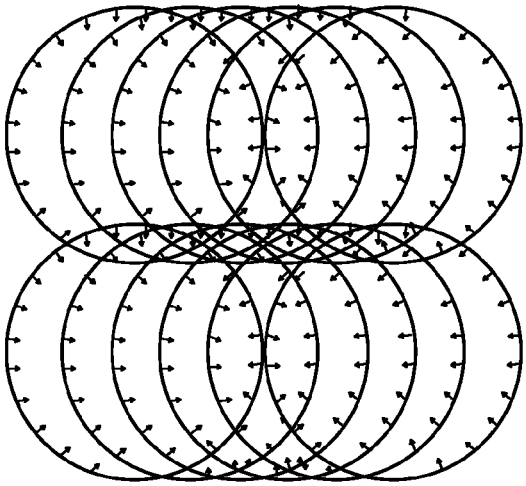

ENHANCED RECOIL ATTENUATING SAFETY HELMET

CROSS REFERENCE TO RELATED APPLICATIONS

This application claims the benefit of U.S. Provisional Patent Application No. 61/658,303, filed on Jun. 11, 2012, the entirety of which is incorporated herein by reference.

FIELD OF THE INVENTION

The invention generally relates to safety helmet(s), such as for activities and sports including, but not limited to football, motorcycling, and motocross, lacrosse, hockey and baseball and further includes, but is not limited to police, riot, and ballistic and military helmets.

BACKGROUND OF THE INVENTION

Various activities, such as contact sports, and in particular the sport of football, require the use of helmets to attempt to protect participants from impact injuries to their heads and necks etc. due to the repetitive and severe impacts forces that may be sustained during such activities. Various types of helmets have been in use in sports such as football, ever since individuals began wearing helmets in an attempt to protect their heads. Typically, these helmets have included: an outer shell, generally made of an appropriate plastic material, having the requisite strength and durability characteristics to enable them to be used during the sport of football; generally having some type of shock absorbing liner within the shell; a face guard; and a chin protector, or strap that fits about the chin of the wear of the helmet, in order to help secure the helmet to the wearer's head, as are well known within in the art. Accordingly, a need exists for an inventory control system that helps solve the problems discussed above.

Various improvements over the years have been made to the various components of helmets; however, in general, the general configuration and shape of a football helmet, has remained the same for many years. In this regard, a typical football helmet has included an ear flap as a part of the shell forming the helmet, and the ear flap generally overlies an ear of the wearer and a portion of a cheek of the wearer; however, the jaw of the wearer typically extends outwardly beyond the outer periphery of the helmet.

Generally, conventional football helmets presently have ear flaps and the lower portions thereof taper inwardly toward the neck and rearmost portions of the player's jawbone overlaid by the ear flaps. As a consequence of this structure, when a player removes his, or her helmet, it is necessary to pull the sides, or ear flaps, of the helmet slightly outwardly so that the helmet may clear the player's ears. Further in this regard, conventional helmets may also include pads adjacent the player's ears and these pads generally are located along the lower and front edge of the ear flap. These conventional pads must also be pulled away from the ears of the player when removing or putting on a conventional helmet. Additionally, this repeated putting on and taking off, a football helmet may cause irritation to the player's ears, so it would be desirable if the putting on, and for removal of, a helmet did not cause repeated sliding frictional contact with a player's ears, to prevent potential distraction and irritation to the player's ear.

Furthermore, as an example, conventional football helmets generally utilize heavy removable face guards having different designs and configurations for the different players' positions, which are generally made of either a metallic or thermoplastic materials. Since a player wears a helmet for a considerable period of time during practices and games, it would be desirable to minimize the weight of the helmet, while not sacrificing sufficient protection. The face guards of conventional helmets are typically mechanically attached to the front sides of the helmet, as well as upon the front of the helmet, such as by grommets, eyelets or screws. Thus, the face guard must extend rearward in order to be received and attached to the edge of the helmet. It would be desirable if the size and profile of the face guard could be reduced, thereby reducing the overall profile and weight of the face guard and improve the strength as used in the helmet(s) these and other limitations are overcome by the current invention.

While it is the desire and goal that a football helmet, and other types of protective helmets, prevent injuries from occurring, it should be noted that as to the helmet(s) of the present invention, as well as prior art safety helmets, due to the nature of the sports particularly when playing football or other sports in general, no protective equipment, or helmet can completely, totally prevent short term or long term injuries to those individuals playing such sports including football. It should be further noted that no protective equipment can completely prevent injuries to a player as examples, if the football player uses a football helmet in an improper or illegal manner, such as to butt, ram, or spear an opposing player, which is in violation of football regulations. Improper use of a helmet to butt, ram, or spear an opposing player can result in severe brain, head and/or neck injuries, paralysis, or death to the football player, and may further include the possible injury to the football player's opponent. No football helmet, or other protective helmet(s), including other transportable safety equipment, such as that of the current invention, can completely prevent head, brain, chin, or neck injuries a football player might receive while participating in such sports including football. The helmets and other transportable safety equipment as stated herein of the present invention is believed to offer improved protection including football players, but it is believed that no helmet can, or will ever, totally and completely prevent head injuries to football players.

The football helmet of the current invention, when compared to prior art proposed conventional safety helmets, including football helmets has the advantages of: being designed to attempt to protect a wearer of the helmets from the wide variety of injuries encountered from repetitive small injuries caused upon such impacts and further encompasses the more severe forces striking the helmet(s); preventing irritation to a player's ear; improve the hearing and safety of the player's ears; affording more protection to the head, neck, and jaw of the wearer; providing for and use of a stronger reinforced impact attenuating devices and lighter weight safety helmet(s); having improved face guard(s); having removable and attachment and securement devices simultaneously having an improved profile, and lower weight and better visibility as needed in the art.

Furthermore, as an example, a prior art manufacturing process requiring time consuming and costly processes and steps, such as having to cycle particularly between cooling and heating cycles when manufacturing with carbon fiber and/or Kevlar™ helmets. Employing the external "reinforcement" as an apparatus reduces or eliminates a step of this cycling in most cases.

In order to provide less expensive protective headgear, or protective helmets, sacrifices are often made from the standpoint of fitting and comfort of the protective helmet and also from the standpoint of protection. For example, in cases where individuals are required to use the same helmet, e.g., such as helmets used in playing football and batting helmets in baseball, hockey, lacrosse, construction a less than perfect fit is often tolerated in order to save cost by purchasing protective helmets that are not comfortable, nor adjustable. In these cases, protection of the individual's head may be lessened because of the less than optimum fit and comfort and function of the protective attenuation helmet on the individual's head.

Prior art attempts to provide a protective helmet capable of self or automatically adjusting to the head size of the individual wearing the protective helmet have included utilization of an elastic band disposed within the protective helmet such that can be expanded to the size of the individual's head. Because only an elastic band captures the head of the individual, it is contemplated that such protective helmets do not sufficiently secure the head of the individual within the protective helmet. Nor do they serve as an impact shock attenuating apparatus, as needed within the art.

The current invention provides simple self adjustment to different shape and sizes of heads; and provides automatic adjustment to different helmet shapes and sizes; and provides increased fit, and associated comfort and security of the protective helmet to the head of the wearer of the protective helmet. Therefore, there is a need within the art for protective helmets which: provides simple or self adjustment(s) to different shapes and sizes; provides automatic adjustment to different shapes and sizes; and provides increased fit and comfort, and provides a wider range of impact shock attenuation improving the security of the protective helmet to the head of the wearer of the protective helmet.

It should be noted that as to the protective helmet and the self adjustable helmet multi-layered memory foam force attenuating liner of the present invention, as well as to the prior art protective helmets and self adjustable helmet liners, due to the nature of such sports as football, baseball and motorcycling, hockey and other activities in which individuals wear protective headgear, no protective equipment can completely prevent injuries to those wearing the protective helmet and self adjustable multi-layered memory foam force attenuated helmet liner. It should be further noted that no protective equipment can completely prevent injuries to an individual if the individual uses the protective or safety helmet or self adjustable helmet liner in an improper manner. No protective helmet or self adjustable helmet liner, such as those of the current invention, can prevent all immediate and/or long term head, brain, chin, or neck injuries an individual might receive while participating in any activity in which the protective helmet or self adjustable helmet liner is worn, particularly if the individual improperly uses his protective helmet or self adjustable helmet multi-layered memory foam force attenuated liner.

Furthermore, in accordance with the current invention the foregoing advantages have been achieved through the present self adjustable multi-layered memory foam impact force attenuating helmet liner(s) for a wide variety of protective helmets having an interior surface, the adjustable helmet liner comprising: at least one liner wall having a peripheral surface adapted to substantially conform to, and fit within, the protective helmet for engagement with the head of a wearer of the protective helmet, the at least one liner wall having an outer surface and an inner surface, the outer surface adapted to be disposed adjacent the interior surface of the helmet and the inner surface adapted to be spaced from the interior surface of the helmet whereby the impact force attenuated multi-layered memory foam force attenuated liner may be inserted or removed from/into the protective helmet and self adjusts (expands and contracts) to conform to the head of the wearer of the protective helmet; and at least one expandable or adjustable band disposed along a portion of the outer surface of the liner wall, whereby the at least one expandable band provides for the adjustment of the multi-layered memory foam force attenuated liner to the head of the wearer of the protective helmet.

A further feature of the adjustable helmet memory foam impact attenuating liner is that the at least one liner wall may include at least one helmet attachment aperture adapted to connect the adjustable helmet liner to the protective helmet. Another feature of the adjustable helmet liner is that the at least one liner wall may include at least one band attachment aperture adapted to connect the at least one expandable band to the at least one liner wall. An additional feature of the adjustable helmet liner is that the inner surface of the at least one liner wall may include at least one multi-layered impact force attenuated impact absorption pad. A further feature of the adjustable helmet liner is that the at least one impact absorption pad may be formed of multiple impact force attenuated layers of different plastic foam material. Each layer having variable qualities and characteristics as needed thus attenuating i.e. controlling and directing a wider range of 3-dimensional impact shock waves in conjunction with the reinforced helmets of the current invention having a significant advantage over the prior art. Another feature of the self adjustable helmet liner is that the plastic foam material(s) may be a variety of a closed cell plastic foam material(s) configured as needed.

Having improved 3-dimensional synergistic impact force attenuation characteristics more specifically impact(s) surface accelerations and waveguide stress transferring characteristics having synergistic combinations of helmet shell impact stress transfer to memory foam pads having less weight and an improved chin strap receiving guide having an elongated arch. As an option or optionally the suspension apparatus may encompass multi-layered memory foam pads that may break their internal bubbles upon extreme impacts additionally having the advantage of expanding the P.S.I. range and narrowing the P.S.I. range of the memory foam pads as different types of impacts, speeds, and forces produce different types of injuries as the prior art does not consider or ignores these and other impact "frequencies" that need, to be significantly modulated and eliminated as needed to provide short and long term impact protection when wearing a helmet.

As the current invention is as separate and distinct from the prior art having previously unavailable reinforcement geometries that provides a wider range of impact attenuation and displacement as needed within the art. An object of the invention is to meet or exceed existing "prior art" football helmets safety performances and to reduce weight, mass, improve, broaden impact acceleration, speed, compensation, and attenuation ranges.

Additionally, having each memory foam pad and "layers" having variable qualities and characteristics as needed that is virtually unaffected by heat or cold. As an option, may encompass removable and replaceable suspension system(s) and padding system for ease of removal and cleaning and to provide a wider range of operating temperatures and humidity's such as seasonal variations as needed. Additionally, having a previously unavailable impact shock, "recoil," reduction, and attenuation displacement characteristics. To obtain and improving the overall safety performances of safety helmets in general more specifically football helmets. An additional feature of the memory foam adjustable helmet liner, such as closed cell plastic foam materials may be cross-linked polyethylene, etc. A further feature of the inventive adjustable helmet liner is that at least one liner wall may be formed of a plastic material and is compatible with a variety of foams and plastics and resins known within the art.

In accordance with the current invention the foregoing advantages have also been achieved through the inventive self adjustable multi-layer memory foam helmet liner(s) for protective helmets having an interior surface, the adjustable helmet liner(s) comprising: at least one multi-layered memory foam liner wall having a peripheral surface adapted to substantially conform to, and fit within, the protective helmet for engagement with the head of a wearer of the protective helmet, the at least one liner wall having an outer surface and an inner surface, the outer surface adapted to be disposed adjacent the interior surface of the helmet and the inner surface adapted to be spaced from the interior surface of the helmet whereby the force attenuating liner may be secured to or inserted into the helmet. The protective helmet and adjusts to the head of the wearer of the protective helmet; a first side wall having a first longitudinal axis and a plurality of edge surfaces; a first attachment wall disposed along the second edge surface; a second side wall having a second longitudinal axis and a plurality of edge surfaces; a second attachment wall disposed along the sixth edge surface; a rear wall having a third longitudinal axis and a plurality of edge surfaces; a third attachment wall disposed along the seventh edge surface, and an apex defined by the intersection of the first, second, and third attachment walls or as needed.

A further feature of the self adjustable helmet liner is that the adjustable helmet multi-layer memory foam impact force attenuating liner may include at least one expandable band or adjustable associated with the at least one liner wall. Another feature of the adjustable helmet liner is that each of the first, second, and rear walls may include at least one band attachment aperture adapted to connect the at least one expandable band or adjustable to the first, second, and rear walls. An additional feature of the adjustable helmet multi-layer memory liner is that each of the first, second, and rear walls may include at least one impact attenuating multi-layered memory foam absorption pad. A further feature of the adjustable helmet liner is that at least one liner wall may include at least one helmet attachment aperture adapted to connect the adjustable helmet liner to the protective helmet(s). Another feature of the adjustable helmet liner is that the plurality of edge surfaces of the first side wall may include first, second, third, and fourth, fifth edge surfaces, the first and third edge surfaces being disposed substantially perpendicular to the first longitudinal axis, and the second and fourth edge surfaces being disposed substantially parallel to the first longitudinal axis. An additional feature of the memory foam adjustable helmet liner is that the plurality of edge surfaces of the second side wall may include fifth, sixth, seventh and eighth edge surfaces, the fifth and seventh edge surfaces being disposed substantially perpendicular to the second longitudinal axis, and the sixth and eighth edge surfaces being disposed substantially parallel to the second longitudinal axis. A further feature of the adjustable helmet liner is that the plurality of edge surfaces of the rear wall can include ninth, tenth, eleventh and twelfth edge surfaces, the ninth and eleventh edge surfaces being disposed substantially perpendicular to the third longitudinal axis, and the tenth and twelfth edge surfaces being disposed substantially parallel to the third longitudinal axis.

In accordance with the current invention the foregoing advantages have also been achieved through the present protective reinforced safety helmet comprising: a helmet shell having an interior surface, portions of the interior surface having force attenuating pad structures disposed thereon in a spaced relationship; other portions of the interior surface being exposed in the spaces between the pad structures; an adjustable helmet multi-layered memory foam filled force attenuating liner for the helmet shell; the adjustable helmet liner including a liner wall having a peripheral surface adapted to substantially conform to, and fit within, the spaces between the memory foam filled force attenuating pad structures of the helmet for engagement with the head of a wearer of the protective helmet; the at least one multi-layered memory foam force attenuating liner wall preferably having a generally dome-shaped top outer surface and an inner surface; the outer surface adapted to be disposed adjacent the interior surface of the helmet and the inner surface adapted to be spaced from the interior surface of the helmet whereby the liner may be inserted into the protective helmet, and the dome surface adjusts to the head of the wearer of the protective helmet(s); and at least one expandable or adjustable band disposed along a portion of the outer surface, whereby the at least one expandable or adjustable band provides for the comfortable adjustment of the multi-layered memory foam force attenuating liner(s) to the head of the wearer of the protective helmet.

A further feature of the protective helmet(s) is that the at least one liner wall may include at least one helmet attachment aperture adapted to connect the self adjusting helmet liner to the protective helmet. Another feature of the protective helmet is that the at least one liner wall may include at least one band attachment aperture adapted to connect the at least one expandable band or adjustable band to the at least one liner wall. An additional feature of the protective helmet liner is that the inner surface of the at least one liner wall may include at least one multi-layered memory foam force attenuating impact absorption pad. A further feature of the protective helmet is that the at least one liner wall may be formed of two or preferably three or more plastic foam materials.

The adjustable helmet liner and the reinforced protective helmet(s) of the present invention, when compared with prior art adjustable helmet liners and protective helmets, have the advantages of: provides additional 3-dimensional impact force attenuation characteristics from a wide variety of helmet impacts and providing simpler adjustments to different head shapes and sizes; providing automatic adjustment to different shapes and sizes, and providing increased fit and comfort and security of the protective helmet to the head of the wearer of the protective helmet.

SUMMARY OF THE PREFERRED EMBODIMENTS

In accordance with a preferred embodiment of the present invention, a reinforced and impact attenuating helmet is provided comprising a shell configured to receive a head of a wearer of the helmet, the shell comprising an outer surface and an inner surface; a series of linked coils; and filler material. The series of linked coils are entirely encased within the filler material to form a reinforcement layer, the reinforcement layer having a first surface and an opposing surface, the first surface of the reinforcement layer generally facing toward the inner surface of the shell, the reinforcement layer being located proximate the inner surface of the shell, forming a basic helmet assembly. Preferably, the inner surface of the shell generally forms a curved plane, and wherein the series of linked coils are arranged in overlapping rows to form a curved plane that is generally parallel to the curved plane of the inner surface of the shell. Preferably, the amount by volume of the filler material is about the same on either side of the curved plane of the series of linked coils, such that the curved plane of the series of linked coils is located in approximately the middle of the reinforcement layer. Preferably, the helmet further comprises a face guard having an upper side and a lower side, wherein the face guard has at least one flexible connecting rod affixed proximate the upper side of the face guard, wherein the basic helmet assembly comprises at least one curved receiving channel that is generally parallel to the curved plane of the inner surface of the shell, wherein the curved receiving channel is adapted to allow the at least one flexible connecting rod to be removably inserted into the curved receiving channel so as to fasten the face guard to the basic helmet assembly. Preferably, the helmet further comprises at least one set of three ear ports, the at least one set of three ear ports comprising an upper ear port, a middle ear port, and a lower ear port configured generally in a vertical arrangement, the upper ear port having an opening that is larger than the middle ear port and larger than the lower ear port, and the middle ear port having an opening that is larger than the lower ear port. Preferably, the helmet comprises one or more adjustable pentagonal or octagonal memory foam pads affixed proximate the opposing surface of the reinforcement layer. Preferably, the helmet comprises one or more adjustable pentagonal or octagonal memory foam pads comprised of two or more layers. Preferably, the helmet comprises one or more adjustable rounded or ellipsed dome pads affixed proximate the opposing surface of the reinforcement layer. Preferably, the rigid filler material is comprised of resin or plastic. Preferably, the filler material is selected from the list of: polypropylene, polyethylene, linear low density polyethylene, polyamides, high density polyethylene, polyesters, polystyrene, and polyvinyl chloride. Preferably, the diameter of the linked coils range from about 0.25 inches to about 3 inches. Preferably, the diameter of the linked coils range from about 0.33 inches to about 2 inches. Preferably, the diameter of the linked coils range from about 0.4 inches to about 1.2 inches. Preferably, the number of linked coils that overlap ranges from 1 to 10. Preferably, the number of linked coils that overlap ranges from 4 to 5. Preferably, the linked coils are comprised of metal. Preferably, the linked coils are comprised of metal selected from the following list: carbon steel, alloy steel, stainless steels, and tool steel. Preferably, the linked coils are comprised of polypropylene, Kevlar®, or graphene. Preferably, the linked coils are comprised of micro tubes. Preferably, the outer surface of the shell comprises one or more openings through which the linked coils are visible. Preferably, the linked coils are treated with a color changing dye. Preferably, the filler material is a bonding material.

In accordance with another preferred embodiment of the present invention, a reinforced and impact attenuating helmet is provided comprising a shell configured to receive a head of a wearer of the helmet, the shell comprising an outer surface and an inner surface; mesh or weave; and filler material. The mesh or weave is entirely encased within the filler material to form a reinforcement layer, the reinforcement layer having a first surface and an opposing surface, the first surface of the reinforcement layer generally facing toward the inner surface of the shell, the reinforcement layer being located proximate the inner surface of the shell, forming a basic helmet assembly. Preferably, the inner surface of the shell generally forms a curved plane, and wherein the mesh is arranged to form a curved plane that is generally parallel to the curved plane of the inner surface of the shell. Preferably, the amount by volume of the filler material is about the same on either side of the curved plane of the mesh, such that the curved plane of the mesh is located in approximately the middle of the reinforcement layer. Preferably, the helmet further comprises a face guard having an upper side and a lower side, wherein the face guard has at least one flexible connecting rod affixed proximate the upper side of the face guard, wherein the basic helmet assembly comprises at least one curved receiving channel that is generally parallel to the curved plane of the inner surface of the shell defined therein, wherein the curved receiving channel is adapted to allow the at least one flexible connecting rod to be removably inserted into the curved receiving channel so as to fasten the face guard to the basic helmet assembly. Preferably, the helmet further comprises at least one set of three ear ports, the at least one set of three ear ports comprising an upper ear port, a middle ear port, and a lower ear port configured generally in a vertical arrangement, the upper ear port having an opening that is larger than the middle ear port and larger than the lower ear port, and the middle ear port having an opening that is larger than the lower ear port. Preferably, the helmet further comprises one or more adjustable pentagonal or octagonal memory foam pads affixed proximate the opposing surface of the reinforcement layer. Preferably, the one or more adjustable pentagonal or octagonal memory foam pads are comprised of two or more layers. Preferably, the helmet further comprises one or more adjustable rounded or ellipsed dome pads affixed proximate the opposing surface of the reinforcement layer. Preferably, the filler material is comprised of resin or plastic. Preferably, the mesh is woven and comprised of polypropylene, Kevlar®, or graphene. Preferably, the outer surface of the shell comprises one or more openings through which the linked coils are visible. Preferably, the linked coils are treated with a color changing dye. Preferably, the filler material is a bonding material.

In accordance with another preferred embodiment of the present invention, a reinforced and impact attenuating helmet is provided comprising a shell and reinforcement layer configured to receive a head of a wearer of the helmet, the shell comprising an outer surface and an inner surface, the inner surface of the shell generally forming a curved plane, to form a basic helmet assembly; and a face guard having an upper side and a lower side. The face guard has at least one flexible connecting rod affixed proximate the upper side of the face guard. The basic helmet assembly comprises at least one curved receiving channel that is generally parallel to the curved plane of the inner surface of the shell, wherein the curved receiving channel is adapted to allow the at least one flexible connecting rod to be removably inserted into the curved receiving channel so as to fasten the face guard to the basic helmet assembly. Preferably, the helmet further comprises at least one set of three ear ports, the at least one set of three ear ports comprising an upper ear port, a middle ear port, and a lower ear port configured generally in a vertical arrangement, the upper ear port having an opening that is larger than the middle ear port and larger than the lower ear port, and the middle ear port having an opening that is larger than the lower ear port. Preferably, the one or more adjustable pentagonal or octagonal memory foam pads are positioned on the reinforcement layer. Preferably, the one or more adjustable pentagonal or octagonal memory foam pads are comprised of two or more layers. Preferably, the helmet comprises one or more adjustable rounded or ellipsed dome pads affixed proximate the opposing surface of the reinforcement layer. Preferably, the reinforcement layer is further comprised of a series of linked coils encased within a filler material. Preferably, the series of linked coils are arranged in overlapping rows to form a curved plane that is generally parallel to the curved plane of the inner surface of the shell. Preferably, the linked coils are comprised of metal. Preferably, the linked coils are comprised of polypropylene, Kevlar®, or graphene. Preferably, the outer surface of the shell comprises one or more openings through which the linked coils are visible. Preferably, the linked coils are treated with a color changing dye. Preferably, the filler material is a bonding material.

In accordance with the invention, the foregoing advantages are believed to have been achieved by the inventive reinforced impact attenuating helmets of the current invention. The helmets of the current invention generally may include: an outer shell having an inner wall surface and an outer wall surface, the shell including a crown, a back, a front, a lower edge surface, and two sides, the shell being adapted to receive the head of wearer of the helmets, the wearer having a lower jaw having two side portions; each side of the shell includes an ear flap adapted to generally overlie an ear and a portion of a cheek of the wearer; each ear flap generally extending downwardly from its respective side; each ear flap including a jaw flap attached to the ear flap, each jaw flap extending from the ear flap forwardly toward the front of the shell and adapted to generally extend to overlie a side portion of the lower jaw of the wearer of the helmet; each side having a chin protector strap connector, adapted to connect a portion of a chin protector to the shell; front side having a face guard receiving channel or groove configured in the reinforced helmet connector, having at least 4 securements.

Having a chin guard securement strap(s) system and having an ellipsed receiving arch that is configured to have a wider and faster, and wider range of adjustments for different jaw and chins sizes as needed adapted to receive into and connect a edge portion of a face guard bar to the helmet shell, and having removable connectors, adapted to and connect with the face guard(s) to the helmet in to a portion of the inner edge or wall surface of the helmet shell. As an option or optionally, the current invention is that there may be a separate face guard connected to at least both sides of the helmet by the face guard connectors, each face guard connector including adapted to substantially directionally distribute an attenuate a wide range of impact force or forces, exerted upon the face guard, thus transferring and controlling and displacing throughout the entire reinforced attenuating helmet shell by transferring to the reinforced impact attenuating system, a further feature of this aspect of the present invention is that each shock absorber attenuating apparatus may be the synergistic combination of the shell and the face guard(s) and pads interface. Simultaneously increasing and improving the helmet wearers shading sunlight and thus improving the wearer's visibility. Note by changing the shape of the face guard bars cage to an oval configuration, note this shape also helps displace stress and shields the sunlight and simultaneously serves as a sun visor. The previously unavailable monolithic reinforced helmet system and apparatus that incorporates the helmet and the face guard and pads into a synergistic, multidimensional impact force attenuating apparatus improving helmet safety apparatus in general. In a specified embodiment encompasses that the face guard may be designed and manufactured to appear to be a two piece configuration and the helmet and the face guard to meet (correspond to) existing regulations and that is monolithic (one piece). As an option the face guard(s) may be composed of titanium or alloys of titanium are preferred. This inventive configuration having previously unavailable impact attenuating guiding/directing and transferring displacement and recoil stress transferring characteristics having acceleration effects (guided stress transfer). Preferably the helmet incorporates a face guard receiving groove or channel that is in a specified embodiment depending upon the application manufactured employing the inventive methods and apparatus as stated here in as separate and distinct from the prior art. Having previously unavailable reinforcement geometries. Thus provides a wider range of impact attenuation and displacement controlling characteristics. Including the highly complex forces (bulging) and waveforms and frequencies encountered during and having a wide range of sports impact attenuation to meet or preferably exceed existing "prior art" helmets safety performances.

In a specified embodiment encompasses that the present invention, the football helmet may include a chin protector having two sides and at least two flexible members associated with each side of the chin protector, the at least two flexible members adapted to engage with one of the chin protector connectors on the sides of the helmet(s) shell chin guard strap system engaging in the receiving and guiding ellipse arch is configured to have a wider range of chin, jaw fitting over the prior art and having faster and easier range of suitable adjustment.

In accordance with another aspect of the present invention, the football helmets may include a multi-layered memory foam shock absorbing transferring suspension apparatus and comfort fitting system and liner(s) associated with the inner wall surface of the reinforced attenuating helmet shell by the liner connector(s).

An additional feature of this aspect of the present invention is that the impact shock attenuating absorbing suspension system and apparatus or liner may include a plurality of different memory foam layers having adapted members to attenuated and absorb a wide variety of impact shock forces exerted upon the helmet(s) shell and or the face guard, and the plurality of memory foam pad liner(s) members may be disposed along the inner wall surface of the back and sides of the shell, including at least two multi-layered memory foam pad member disposed upon the inner wall surface of a portion of each of the jaw flaps of the shell or as needed.

In other specified embodiment encompasses that the inventive methods and apparatuses as stated herein. The current invention further includes other transportable safety equipment, such as but not limited to shoulder pads, chin pads, hip pads, shin pads, gloves, chest pads, knee pads, boots, shoes, elbow pads, etc., such as used when participating in the sport(s) of football, baseball, motocross, hockey, motorcycling, and other sport not stated herein.

In an exemplary embodiment, the current invention encompasses methods and apparatuses and methods of manufacturing high performance transportable ballistic safety equipment, such as but not limited to armored and/or multi-layered memory foam layers having impact attenuating protective pads, preferably having a multi-layered memory foam attenuating layer as described herein, further including shoulder pads, chin pads, hip pads, shin pads, gloves, chest pads, knee pads, elbow pads, boots, shoes, neck pads, throat pads, etc.

That further includes the installation of transportable armored (hard or flexible) plates, such as are installed in the above ballistic safety equipment. As an example, sliding into an armored vest, a bullet-proof chest plate that encompasses the methods, apparatuses, and methods of construction encompassed by the current invention.

A further feature of this aspect of the present invention is that each of the at least two resilient multi-layered memory foam pad members may be formed integral with the plurality of memory foam members, or at least two multi-layered memory foam pad member may be reasonably secured to the plurality of memory foam members. An additional feature of this aspect of the present invention is that on each side of the inner wall surface of the memory foam shell, an ear ports (channels) may be formed between at least one of the memory foam members of the shock attenuating transferring and absorbing liner(s), and the at least two memory foam pad member disposed upon the inner wall surface of a portion of the jaw flap, and each ear channel may be disposed adjacent an ear port openings formed in each flap or as needed.

In another specified aspect of the present invention is that the reinforcement(s) near the outer shell may have a vertical, longitudinal axis extending downwardly from the crown of the helmet(s), and each ear flap may generally lie in a plane which is substantially parallel to the longitudinal axis of the reinforcement(s) near the outer shell. Another feature of this aspect of the present invention is that the outer shell of the reinforced helmet may have a vertical, longitudinal axis extending downwardly from the crown, and each jaw flap may generally lie in a plane, which is substantially parallel to the longitudinal axis of the outer shell.

The reinforced helmet of the current invention, when compared with the prior art conventional safety helmets, more specifically football helmets, is theorized to have the advantages of: offering protection to football players against injuries caused by a wider range of encountered impact forces exerted upon the football helmet and/or face guard during the playing of the game of football; providing a helmet and face guard suitable for playing football, which is equal or lighter weight than the prior art and is more form fitting and comfortable for the helmet wearer; having improved hearing characteristics and is easier for the wearer of the helmet to put on and take off, and may minimize irritation to a player's ear; as an option providing more overall protection for the wearer of a monolithic helmet (a unitary one piece helmet and face guard); and provides a lighter in weight, monolithic face guard having impact force attenuating "rings" "coils." That is as separate and distinct from the prior art having inventive reinforcement geometries that provides a wider range of impact force attenuation and displacement.

As an example the prior art helmets having carbon fibers only in a portion of the helmet or only in certain segments.

Additionally, the prior art that is not aware or does not consider the use of attenuating recoil return "annular," "rings," or "coil" reinforcement(s), nor other attenuating mesh/net reinforcement attenuating inventive apparatuses as stated herein.

The inventive and previously unavailable impact shock attenuation apparatuses employing, "recoil" reduction, and displacement characteristics that reduces motion transfer thus improving the overall safety performances of safety helmets in general more specifically football helmets. Furthermore the prior art does not consider integrating multi-layered memory foam pads to functionally operate as an integrated impact attenuating component system or apparatus. Further includes an impact force attenuating multi-layered memory foam helmet lining apparatus comprises; a first surface made of flexible high polymer resin; a second surface made of flexible high polymer resin, in at least partially coextensive relation to the first surface to define a cavity there between, the coextensive relation defining opposing corresponding portions of the first and second surfaces; a plurality of impact force attenuating multi-layered memory foam helmet lining apparatus support members comprising externally directed dome in the first surfaces extending out of the impact force attenuating multi-layered memory foam helmet lining apparatus in each of the first surfaces having a generally ellipsed dome shape and an outwardly facing ellipsed dome; having multiple layers of visco-elastic foams substantially overlying the first surface and overlaying a second or third or fourth or fifth or sixth surfaces, and an enclosure surrounding the first surface, the second surface, the third or fourth or fifth or sixth surface and the foam multi-layers.

In accordance with another preferred embodiment of the present invention, a reinforced and impact attenuating football helmet apparatus is provided comprising: a reinforced plastic shell configured to receive a head of a wearer of the helmet, the shell having a front region, a rear region, and two side regions wherein each side region has an ear flap with an ear opening(s); each ear flap having a slot and an integral jaw flap that extends forward towards the front region; the reinforced shell further having a lower edge extending between the jaw flaps and along the rear region, the lower edge having an angled transition portion positioned below each ear openings, the transition portion formed by two segments of the lower edge that intersect, wherein the lower edge forward of the transition portion resides below the lower edge rearward of the transition portion; and a chin strap assembly that reasonably sufficiently secures the reinforced helmet to the wearer, the chin strap assembly having a central member and at least one flexible strap extending outwardly from each side of the central member, wherein the at least two flexible straps reasonably connects to the reinforced shell.

Preferably the crown area to the ear flap has a face guard connector attenuating apparatus where the face guard is securely positioned into and attached into the receiving apparatus grove or channel, wherein the removable face guard apparatus is securely attached, wherein the receiving groove or channel has a major axis and a minor axis, the major axis positioned vertical to the lower edge of the shell edge and substantially parallels to a longitudinal axis of the shell, wherein each crown area to the ear flap has both a face guard connector apparatus and an outwardly extending first snap connector apparatus that is positioned rearward of the face guard connector apparatus, wherein the first snap connector apparatus reasonably connects with an end of the flexible strap apparatus, and wherein the elongated arch receives a portion of the flexible strap apparatus when the flexible strap is secured to the first snap connector, wherein the transition portion engages the flexible strap when the flexible strap is secured to the first snap connector, wherein each ear flap has a second snap connector that is positioned above both the face guard connector and the ear port openings in the ear flap, and wherein a chord extending between the first and second snap connectors intersects the ear opening.

In accordance with another preferred embodiment of the present invention, a reinforced attenuating football helmet apparatus is provided comprising: a plastic shell configured to receive a head of a wearer of the helmet, the shell having a front region, a rear region, and two side regions wherein each side region has an ear flap with an ear port openings, each ear flap having an integral jaw flap that extends forward towards the front region; the shell further having a lower edge extending between the jaw flaps and along the rear region, the lower edge having an angled transition portion positioned below ear port openings, the transition portion formed by the intersection of a forward segment of the lower edge and a rearward segment of the lower edge, and a chin strap assembly apparatus that reasonably secures the helmet to the wearer, the chin strap assembly apparatus having a central member and at least one flexible strap apparatus extending outwardly from each side of the central member, wherein the at least one flexible strap apparatus reasonably connects to the shell apparatus and engages the transition portion, wherein the intersection of the forward segment and the rearward segment define an obtuse angle of the transition portion, wherein the forward segment of the lower edge resides below the rearward segment of the lower edge, wherein the lower edge is continuous and un-interrupted between the jaw flaps, along the rear region and through the transition portions, wherein each jaw flap has a bottom edge, a substantially linear front edge that extends upward from the bottom edge and a top edge that is inclined from the front edge, wherein the bottom edge and the front edge of the jaw flap are substantially perpendicular, wherein the front edge and the top edge of the jaw flap define an obtuse angle.

In accordance with another preferred embodiment of the present invention, a reinforced attenuating football helmet apparatus is provided comprising: a plastic shell configured to receive a head of a wearer of the helmet, the shell having a front region, a rear region, and two side regions wherein each side region has an ear flap, each ear flap having a face guard connectors, an ear opening, and a slot positioned rearward of the face guard connector apparatus and below an uppermost edge of the ear port openings apparatus, and a snap connector apparatus positioned rearward of the ear port openings apparatus and below the uppermost edge of the ear openings apparatus; and a chin strap assembly apparatus that releasably secures the helmet to the wearer, the chin strap assembly having a central member and at least one flexible strap extending outwardly from each side of the central member, wherein the flexible strap is received by the elongated arch apparatus, wherein each ear flap has a second snap connector positioned above the face guard connector apparatus, the second snap connector adapted to releasably engage a second flexible strap of the chin strap assembly apparatus, wherein the second snap connector is positioned above an uppermost bar of a face guard secured to the shell by the face guard connectors apparatus, wherein the elongated arch has a major axis and a minor axis and wherein the major axis is substantially parallel to a longitudinal axis of the shell, whereas the reinforced attenuating football helmet apparatus, wherein each ear flap has an integral jaw flap that extends forward towards the front region, wherein each jaw flap has a bottom edge, a substantially linear front edge that extends upward from the bottom edge and a top edge that is inclined from the front edge, wherein the bottom edge and the front edge of the jaw flap are substantially perpendicular, wherein the front edge and the top edge of the jaw flap define an obtuse angle.

In accordance with another preferred embodiment of the present invention, a reinforced attenuating helmet apparatus is provided comprising: a plastic shell configured to receive a head of a wearer of the helmet, the shell having a front region, a rear region, and two side regions wherein each side region has an ear flap with ear port openings apparatus, and an integral jaw flap that extends forward from the ear flap; the shell further having a lower edge extending between the jaw flaps and along the rear region, the lower edge having an angled transition portion positioned below each ear port openings apparatus, the transition portion formed by two segments of the lower edge that intersect, wherein the lower edge forward of the transition portion resides below the lower edge rearward of the transition portion; and a chin strap assembly that releasably secures the helmet apparatus to the wearer, the chin strap assembly apparatus having a central member and a flexible strap extending outwardly from each side of the central member, wherein the flexible strap releasably connects to the shell, wherein the transition elongated arch portion apparatus engages the flexible strap when the flexible strap is secured to the shell, wherein the ear port openings has a rear edge that is rearward of the transition portion, and wherein a face guard connector apparatus is forward of the rear edge of the ear port openings, wherein each jaw flap has a bottom edge, a substantially linear front edge that extends upward from the bottom edge and a top edge that is inclined from the front edge, whereas further comprising a jaw pad apparatus removable attached to an inner surface of the jaw flap, wherein the jaw pad has two or more force attenuating memory foam apparatus layers with a density of at least 5 pounds per cubic foot and at least a 25% compression deflection of 8 pounds per square inch, also further comprising a jaw pad removable attached to an inner surface of the jaw flap, wherein the jaw pad has two or more force attenuating memory foam layers with a surface comfort layer having a density of at least 0.10 to 0.40 pounds per cubic foot and at least a 25% compression deflection of 0.10 pounds per square inch, also further comprising a jaw pad removable attached to an inner surface of the jaw flap, wherein the jaw pad has two or more force attenuating memory foam layers with a density of at least 5 pounds per cubic foot and at least a 25% compression deflection of 8 pounds per square inch, wherein the jaw pad further has a multi-layer memory foam comfort layer, and wherein the means for engaging consists of a first angled lower edge segment intersecting a second angled lower edge segment; wherein the jaw pad apparatus has a front edge that is positioned both in front of a coronal plane and below a basic plane of the head of a wearer of the helmet apparatus.

In accordance with another preferred embodiment of the present invention, a reinforced attenuating football helmet apparatus is provided comprising: a plastic shell configured to receive a head of a wearer of the helmet, the shell having a front region, a rear region, and two side regions wherein each side region has an ear flap with generally slightly arched ear port openings apparatus, and an integral jaw flap that extends forward from the ear flap; a chin strap assembly that reasonably secures the reinforced helmet apparatus to the wearer, the chin strap assembly having a central member and a pair of lower flexible strap that extend outwardly from the central member; and, the shell further having a lower edge extending between the jaw flaps and along the rear region, the lower elongated arch having means for engaging the lower flexible strap apparatus to resist forward rolling of the helmet upon a downward impact to the reinforced helmet, wherein the means for engaging is positioned below the ear port openings apparatus.

Preferably, the helmet further comprises a viewing window apparatus device that is comprised of an initial or first recessed surface for revealing a logo, and wherein the viewing window apparatus device comprises an initial or first recessed surface for revealing a bar code, and wherein the viewing window apparatus device comprises an initial or first recessed surface for revealing a QR code, and wherein the viewing window apparatus device comprises an initial or first recessed surface for revealing coils, and wherein the viewing window apparatus device comprises an initial or first recessed surface for revealing mesh, and/or woven materials, and wherein the viewing window apparatus device comprises an initial or first recessed surface for revealing a hologram, and wherein the viewing window apparatus device comprises an initial or first recessed surface for reveals logo(s), bar code(s), QR code(s), coils, mesh, woven materials, laminate(s), hologram(s), or any combination therein.

In accordance with another preferred embodiment of the present invention, an adjustable helmet multi-layered liner apparatus for a protective helmet having an interior surface is provided, the adjustable memory foam liner force attenuating helmet comprising: at least one force attenuating liner wall apparatus having a peripheral surface adapted to substantially conform to, and fit within, the protective helmet for sufficient engagement and comfort with the head of a wearer of the protective helmet, the at least one liner wall apparatus having an outer surface and an inner surface, the outer surface adapted to be disposed adjacent the interior surface of the helmet apparatus and the inner surface adapted to be spaced from the interior surface of the helmet apparatus whereby the liner apparatus may be inserted into the protective helmet apparatus and adjusts to the head of the wearer of the protective helmet; having at least one expandable band disposed along a portion of the outer surface of the liner wall apparatus, whereby the at least one expandable band apparatus provides for the adjustment of the liner to the head of the wearer of the protective helmet; and at least one helmet attachment aperture apparatus disposed on the liner wall apparatus adapted to connect the adjustable helmet liner apparatus to the protective helmet, or reinforced and impact attenuating football helmet apparatus wherein the adjustable multi-layered memory foam helmet liner apparatus, wherein the at least one liner wall includes at least one band attachment aperture adapted to connect the at least one expandable band to the at least one liner wall apparatus, wherein the inner surface of the at least one liner wall includes at least one impact multi-layered memory foam force attenuating absorption pad apparatus, wherein the at least one impact absorption multi-layered pad apparatus is formed of a plastic memory foam force attenuating material apparatus, wherein the plastic multi-layered memory foam force attenuating material apparatus is a closed cell plastic foam material, wherein the closed cell plastic multi-layered memory foam force attenuating material apparatus is cross linked polyethylene, wherein the at least one liner apparatus wall is formed of a plastic memory foam force attenuating material.

In accordance with another preferred embodiment of the present invention, an adjustable helmet liner apparatus for a protective helmet having an interior surface is provided, the adjustable helmet multi-layered memory foam force attenuating liner apparatus comprising: at least one liner wall apparatus having a peripheral surface adapted to substantially conform to, and fit within, the protective helmet apparatus for engagement with the head of a wearer of the protective helmet, the at least one liner wall having an outer surface and an inner surface, the outer surface apparatus adapted to be disposed adjacent the interior surface of the helmet and the inner surface adapted to be spaced from the interior surface of the helmet apparatus whereby the multi-layered force attenuating memory foam liner apparatus may be inserted into the protective helmet apparatus and adjusts to the head of the wearer of the protective helmet apparatus; a first side wall having a first longitudinal axis and a plurality of edge surfaces; a first attachment wall disposed along a second edge surface of the first side wall; a second side wall having a second longitudinal axis and a plurality of edge surfaces; a second attachment wall disposed along a sixth edge surface of the second side wall; a rear wall having a third longitudinal axis and a plurality of edge surfaces; a third attachment wall disposed along a tenth edge surface of the rear wall; an apex defined by the intersection of the first, second, and third attachment walls; and at least one helmet attachment aperture disposed on the at least one liner wall apparatus adapted to connect the adjustable helmet liner apparatus to the protective helmet, further including at least one expandable adjustable band apparatus associated with the at least one liner wall apparatus, wherein each of the first, second, and rear walls includes at least one band attachment aperture adapted to connect the at least one expandable adjustable band apparatus to the first, second, and rear walls, wherein each of the first, second, and rear walls includes at least one impact absorption pad apparatus, wherein the plurality of edge surfaces of the first side wall includes first, second, third, and fourth edge surfaces, the first and third edge surfaces being disposed substantially perpendicular to the first longitudinal axis, and the second and fourth edge surfaces being disposed substantially parallel to the first longitudinal axis, wherein the plurality of edge surfaces of the second side wall includes fifth, sixth, seventh and eighth edge surfaces, the fifth and seventh edge surfaces being disposed substantially perpendicular to the second longitudinal axis, and the sixth and eighth edge surfaces being disposed substantially parallel to the second longitudinal axis, wherein the plurality of edge surfaces of the rear wall includes ninth, tenth, eleventh and twelfth edge surfaces, the ninth and eleventh edge surfaces being disposed substantially perpendicular to the third longitudinal axis, and the tenth and twelfth edge surfaces being disposed substantially parallel to the third longitudinal axis.

In accordance with another preferred embodiment of the present invention, a protective helmet is provided comprising: a helmet shell having an interior surface, portions of the interior surface having multi-layered memory foam force attenuating pad apparatus structures disposed thereon in a spaced relationship; other portions of the interior surface being exposed in the spaces between the multi-layered memory foam force attenuating pad structures apparatus; an adjustable helmet multi-layered memory foam force attenuating liner apparatus for the helmet shell, the adjustable helmet multi-layered memory foam force attenuating liner apparatus including a liner wall having a peripheral surface adapted to substantially conform to, and fit within, the spaces between the pad structures apparatus of the helmet for engagement with the head of a wearer of the protective helmet, the at least one multi-layered memory foam force attenuating liner wall apparatus having an outer surface and an inner surface, the outer surface adapted to be disposed adjacent the interior surface of the helmet and the inner surface adapted to be spaced from the interior surface of the helmet whereby the memory foam force attenuating multi-layered liner apparatus may be inserted into the protective helmet apparatus and adjusts to the head of the wearer of the protective helmet apparatus; the at least one expandable band disposed along a portion of the outer surface, whereby the at least one expandable band provides for the adjustment of the memory foam force attenuating multi-layered liner apparatus to the head of the wearer of the protective helmet; and the at least one helmet attachment fastener disposed on the memory foam force attenuating multi-layered liner wall apparatus adapted to connect the adjustable helmet liner to the protective helmet, wherein the at least one liner wall apparatus includes at least one helmet attachment aperture adapted to connect the adjustable helmet memory foam force attenuating multi-layered liner apparatus to the protective helmet, wherein the at least one memory foam force attenuating multi-layered liner wall apparatus includes at least one band attachment aperture adapted to connect the at least one expandable band to the at least one liner wall, and wherein the inner surface of the at least one multi-layered memory foam force attenuating liner wall apparatus includes at least two impact absorption pads, and, wherein the at least one memory foam force multi-layered liner wall attenuating apparatus is formed of a plastic material.

In accordance with another preferred embodiment of the present invention, an adjustable helmet liner apparatus for a protective helmet having an interior surface is provided, the adjustable helmet memory foam force attenuating multi-layered liner apparatus comprising: at least two memory foam force attenuating multi-layered liner wall apparatus having a peripheral surface adapted to substantially conform to, and fit within, the protective helmet for engagement with the head of a wearer of the protective helmet, the at least two memory foam force attenuating multi-layered liners wall apparatus having an outer surface and an inner surface, the outer surface adapted to be disposed adjacent the interior surface of the helmet and the inner surface adapted to be spaced from the interior surface of the helmet whereby the memory foam force attenuating multi-layered liner apparatus may be inserted into the protective helmet and adjusts to the head of the wearer of the protective helmet; the at least one expandable band disposed along a portion of the outer surface of the memory foam force attenuating multi-layered liner wall apparatus, whereby at least one expandable band provides for the adjustment of the liner to the head of the wearer of the protective helmet; and at least two impact absorption pad apparatus disposed on the inner surface of the at least two liner walls, and an adjustable helmet multi-layered memory foam force attenuating liner apparatus for a protective helmet having an interior surface, the adjustable helmet memory foam force attenuating multi-layered liner apparatus comprising: the at least two liner walls having a peripheral surface adapted to substantially conform to, and fit within, the protective helmet for engagement with the head of a wearer of the protective helmet, the at least two memory foam liner wall having an outer surface and an inner surface, the outer surface adapted to be disposed adjacent the interior surface of the helmet and the inner surface adapted to be spaced from the interior surface of the helmet whereby the memory foam liner may be inserted into the protective helmet and adjusts to the head of the wearer of the protective helmet; a first side wall having a first longitudinal axis and a plurality of edge surfaces; a first attachment wall disposed along a second edge surface of the first side wall; a second side wall having a second longitudinal axis and a plurality of edge surfaces; a second attachment wall disposed along a sixth edge surface of the second side wall; a rear wall having a third longitudinal axis and a plurality of edge surfaces; a third attachment wall disposed along a tenth edge surface of the rear wall; an apex defined by the intersection of the first, second, and third attachment walls; and at least two impact absorption multi-layered memory foam force attenuating pads apparatuses disposed on each of the first, second and rear walls.

In accordance with another preferred embodiment of the present invention, a protective helmet is provided comprising: a helmet shell having an interior surface, portions of the interior surface having multi-layered memory foam force attenuating pads structures apparatuses disposed thereon in a spaced relationship, other portions of the interior surface being exposed in the spaces between the pad structures; an adjustable helmet multi-layered memory foam force attenuating liner apparatus for the helmet shell, the adjustable helmet liner including a liner wall apparatus having a peripheral surface adapted to substantially conform to, and fit within, the spaces between the pad structures of the helmet apparatus for engagement with the head of a wearer of the protective helmet, the at least one memory foam impact force attenuating liner wall apparatus having an outer surface and an inner surface, the outer surface adapted to be disposed adjacent the interior surface of the helmet and the inner surface adapted to be spaced from the interior surface of the helmet whereby the multi-layered memory foam force attenuating liner apparatus may be inserted into the protective helmet and self adjusts to the head of the wearer of the protective helmet; the at least one expandable band disposed along a portion of the outer surface, whereby the at least one expandable band provides for the adjustment of the liner apparatus to the head of the wearer of the protective helmet; and at least one multi-layered memory foam impact absorption force attenuated pad apparatus disposed on the inner surface of the at least one liner wall.

In accordance with another preferred embodiment of the present invention, an adjustable helmet liner apparatus for a protective helmet having an impact force attenuating multi-layered memory foam helmet lining apparatus that improves the moisture wicking action is provided and comprises a first surface made of flexible high polymer resin; a second surface made of flexible high polymer resin, in at least partially coextensive relation to the first surface to define a cavity there between, the coextensive relation defining opposing corresponding portions of the first and second surfaces; a plurality of impact force attenuating multi-layered memory foam helmet lining apparatus support members comprising externally directed ellipsed dome in the first surfaces extending out of the impact force attenuating multi-layered memory foam helmet lining apparatus in each of the first surfaces having a generally ellipsed dome shape and an outwardly facing ellipsed dome; having multiple layers of different viscoelastic foams substantially overlying the first surface, and a enclosure surrounding the first surface, the second surface and the foam multi-layers.

In accordance with another preferred embodiment of the present invention, an adjustable helmet liner apparatus for a protective helmet having an impact force attenuating multi-layered memory foam helmet lining apparatus is provided comprising: (a) a first surface made of flexible high polymer resin; (b) a second surface made of flexible high polymer resin, in at least partially coextensive relation to said first surface to define a cavity there between, said coextensive relation defining opposing corresponding portions of said first and second surfaces; (c) a plurality of impact force attenuating multi-layered memory foam helmet lining apparatus having support members comprising externally directed ellipsed dome surfaces extending the first and second surfaces having a generally polygon/pentagon shape and an outwardly facing ellipsed dome surface; (d) multi-layers of visco-elastic foam substantially overlying the first surface; and, (e) an enclosure surrounding the first surface, the second surface and the multi-layered foam.

In accordance with another preferred embodiment of the present invention, an adjustable helmet liner apparatus for a protective helmet having an impact force attenuation multi-layered memory foam helmet lining apparatus is provided comprising: (a) a top surface made of flexible high polymer resin; (b) a bottom surface made of flexible high polymer resin, in at least partially coextensive relation to said top surface to define a space there between, said coextensive relation defining opposing corresponding portions of said top and bottom surfaces; (c) a impact force attenuation multi-layered memory foam helmet lining apparatus plurality of support members comprising an externally directed ellipsed dome in said top surfaces extending in each of the top surfaces being substantially polygonal/pentagonal and having an outwardly facing ellipsed dome in said top surface.

In accordance with another preferred embodiment of the present invention, an adjustable helmet liner apparatus for a protective helmet having an impact force attenuation multi-layered memory foam helmet lining apparatus is provided, wherein the force required to compress the impact force attenuation multi-layered memory foam helmet lining apparatus is a substantially linear function of the deflection comprising the compression; an impact force attenuation multi-layered memory foam helmet lining apparatus wherein the ellipsed dome comprise a substantially non-planar surface opposite the outwardly facing surface; an adjustable helmet liner apparatus for a protective helmet having an impact force attenuation multi-layered memory foam helmet lining apparatus wherein the ellipsed dome comprise five pairs of opposing walls with a generally rounded section to an adjacent wall, and an adjustable helmet liner apparatus for a protective helmet having an impact force attenuation multi-layered memory foam helmet lining apparatus additionally comprising a substantially planar surface opposite the outwardly facing dome with a polygon/pentagon section joining each wall to the substantially planar surface.

Preferably, the helmet further comprises a recoil dampening apparatus located inside the helmet(s), whereby the shock waves of the helmet(s) from one or more impacts is substantially eliminated, wherein the ratio of reinforcement apparatus to helmet mass is about 1.0 to about 4.0, wherein the helmet(s) is designed for playing football, wherein the helmet(s) is designed for motorcycle riding, wherein the reinforcement mesh angle .alpha. is between about 90 degrees and about 180 degrees, wherein the reinforcement mesh angle .alpha. is between about 100 degrees and about 160 degrees, wherein the angle .alpha. is between about 100 degrees and about 150 degrees, wherein the configuration of the reinforcement and the impact is set so that the impulse transmitted from the impact(s) to the reinforcement in a longitudinal component of the impact, wherein the attenuating reinforcement apparatus is housed in a face guard, further comprising a multi-layered lamination structure, wherein the reinforcement apparatus is housed in a lamination structure.

In accordance with another preferred embodiment of the present invention, an impact attenuating control device for use in a helmet(s) is provided, said device comprising: a reinforcement mesh positioned in response to the impact(s); wherein an angle .alpha. is formed between the initial impact path and the angle .alpha. is between about 45 degrees and about 155 degrees; wherein the impact attenuating apparatus is configured to transmit an impulses that alternates between the forward position and the rearward position, the impact having a component apparatus perpendicular to the impact axis of the impact of the helmet(s), wherein the angle .alpha. is between about 40 degrees and about 160 degrees, and wherein the path or guide is angular, and wherein the path is curved, and wherein the path is pentagon, and wherein the path is curvilinear, and wherein the path is coiled, wherein the angle .alpha. is between about 40 degrees and about 160 degrees, wherein the angle formed by the axis formed by the longitudinal axis of the impact reinforcement mesh of the helmet(s) and the axis formed by the reinforcement mesh guide is between about 45 degrees and about 155 degrees, and wherein the mesh angle is between about 90 degrees and about 180 degrees, wherein the helmet(s) is designed for motorcycle riding, wherein the helmet(s) is designed for playing football, wherein the helmet(s) is designed for playing hockey, and wherein the helmet(s) is designed for playing baseball, and wherein the helmet(s) is designed for playing lacrosse, and wherein the helmet(s) is designed for playing polo, and wherein the helmet(s) is designed for ballistic helmets, and wherein the helmet(s) is designed for construction safety, and wherein the helmet(s) is designed for driving racecars, and wherein the helmet(s) is designed for piloting aircraft, and wherein the helmet(s) is designated for motorcycle riding, wherein the helmets is designated for playing football, and wherein the helmets is designated for playing hockey, and wherein the helmets is designated for playing baseball, and wherein the helmets is designated for playing lacrosse, and wherein the helmet(s) is designated for playing polo, and wherein the helmets is designated for ballistic helmets, and wherein the helmets is designated for construction safety, and wherein the helmets is designated for driving racecars, and wherein the helmets is designated for piloting aircraft.

In accordance with another preferred embodiment of the present invention, an impact attenuating control apparatus device for use in a helmet(s) is provided, said device comprising: a impact attenuating control apparatus device or devices wherein an angle .alpha. is formed between the reinforcement mesh component initial angle .alpha. is between about 6 degrees and about 45 degrees; wherein the reinforcement mesh is configured to transmit a wide variety of impulses to the reinforcement apparatus that alternates between the forward position and the rearward position, the impulse(s) having a component perpendicular to the impacts axis of the reinforcement apparatus of the helmet(s), wherein the angle .alpha. is between about 100 degrees and about 180 degrees, and, wherein the reinforcement is housed in a helmet(s), and wherein the reinforcement is straight, and wherein the angle .alpha. is between about 100 degrees and about 150 degrees, and wherein the reinforcement is housed in a shell of a helmet(s), and wherein the mass of the reinforcement is greater than the mass of the helmet plastic, and wherein the ratio of reinforcement mass to helmet mass is approximately 1 to about 6, and wherein the ratio of reinforcement mass to helmet mass is approximately 2 to about 4, and wherein the ratio of reinforcement mass to helmet mass is approximately 2.5 to about 3.

Preferably, the reinforcement is housed in a shell of a helmet(s), encompassing a wide variety of force attenuating reinforcement apparatuses that are articulated so that the displacement of impacts results in a force component outside the impact axis of the impact of the helmet(s). The recoil impact force attenuating control device(s) can be incorporated into a wide variety of safety helmet(s) of a variety of sizes and configurations to produce impact reduction. The reinforcement "coils" attenuate the impact(s) highly non-linear system(s) derived from their tunable dynamic response, encompassing linear, and weakly nonlinear, and strongly nonlinear impact(s) regimes, for methods and apparatuses controlling the varying static and dynamic applied load(s), attenuates the propagation of highly nonlinear solitary waves of these impact waves, including the traveling pulse width, wave speed, including a number of separated pulses (singular or train of pulses), etc., are controlled by "coils" reinforcement(s) modifying one or many of the impact parameters, such as the, static and dynamic force amplitude, the type and duration of the initial excitation (impact) applied to the coil reinforcement system(s), and/or the periodicity of the coils having the ability to control the wave properties in such coils as needed, including the collective vibrations of the methods and apparatuses reinforcement(s) particles for controlling the dynamic response of the reinforcement methods and apparatuses attenuating system(s); further including such as the re-formation of reflected solitary waves propagating back from the interface, which are sensitive to the "coils'" geometric configurations and material properties of the adjoining media; further including an impact reinforcement attenuating apparatus coil apparatus device where in the reinforcement "coils," "rings," "hoops" sizes range from about 0.250 to 3.00 includes outer diameter ("O.D."), ranging between 0.330 to 2.00 inches O.D, and a impact reinforcement attenuating apparatus having material composed of coiled plastic material, wherein said layer of filler or bonding material comprises synthetic plastic material, and a impact reinforcement attenuating apparatus having material composed of coiled plastic, wherein each hemisphere or strip is molecularly oriented in the same direction of the of the length of the helmet or strip, and a impact reinforcement attenuating apparatus having attenuating material composed of coiled plastic material, wherein each strip is of a synthetic plastic material selected from the group consisting of polypropylene, polyethylene, linear low density polyethylene, polyamides, high density polyethylene, polyesters, polystyrene, polyvinyl chloride, their copolymers and mixtures thereof, and an impact reinforcement attenuating apparatus having material composed of coiled plastic material, wherein the width of each strip in the range of from about 0.005 to about 2.00 inches, and an impact reinforcement attenuating apparatus having material composed of coiled plastic material, wherein the gauge/thickness of each strip is in the range of from about 0.01 to about 0.50 inches.

In accordance with another preferred embodiment of the present invention, an impact reinforcement attenuating apparatus is provided having material composed of coiled plastic material or other natural or hybrid materials, wherein a layer of material comprises synthetic plastic material selected from the group consisting of linear low density polyethylene, ionomers, polyvinyl chloride, ethyl vinyl acetate, ethyl propyl copolymers, polyethylene copolymers, low density polyethylene, their copolymers, vinyl copolymers and mixtures thereof linear low density polyethylene, ionomers, polyvinyl chloride, ethyl vinyl acetate, ethyl propyl copolymers, polyethylene copolymers, low density polyethylene, their copolymers, vinyl copolymers polyolefin, polypropylene, polystyrene, polyethylene, polyurethane, polyvinyl alcohol (water soluble), burlap, silk, carbon, Kevlar™, steel comprised of carbon steels, alloy steels, stainless steels, tool steels, or other natural or hybrid materials and mixtures thereof, and an impact reinforcement attenuating apparatus having material composed of coiled plastic material, or other natural or hybrid materials, wherein the thickness of each laminate filler or bonding layer is in the range of from about 0.01 to 0.50 inches, and an impact reinforcement attenuating apparatus having material composed of coiled plastic material or other natural or hybrid materials, wherein said layer of filler or bonding material comprises synthetic plastic material, and an impact reinforcement attenuating apparatus having material composed of coiled plastic material or other natural or hybrid materials, wherein each strip is of a synthetic plastic material consisting of selected from the group consisting of polypropylene, polyethylene, linear low density polyethylene, polyamides, high density polyethylene, polyesters, polystyrene, polyvinyl chloride, their copolymers and mixtures thereof, and an impact reinforcement attenuating apparatus having material composed of coiled plastic material or other natural or hybrid materials, wherein the width of each strip in the range of between about 0.02 to about 1.00 inch, and an impact reinforcement attenuating apparatus having material composed of coiled plastic material, wherein the thickness of each strip is in the range of from about 0.01 to about 0.250 inches.

In accordance with another preferred embodiment of the present invention, an impact reinforcement attenuating apparatus is provided having material composed of coiled plastic material, wherein said layer of filler or bonding material comprises synthetic plastic material selected from the group consisting of linear low density polyethylene, ionomers, polyvinyl chloride, ethyl vinyl acetate, ethyl propyl copolymers, polyethylene copolymers, low density polyethylene, their copolymers, vinyl copolymers and mixtures thereof linear low density polyethylene, ionomers, polyvinyl chloride, ethyl vinyl acetate, ethyl propyl copolymers, polyethylene copolymers, low density polyethylene, their copolymers, vinyl copolymers polyolefin, polypropylene, polystyrene, polyethylene, polyurethane, polyvinyl alcohol (water soluble), burlap, silk, carbon, Kevlar®, or other natural or hybrid materials and mixtures thereof, and an impact reinforcement attenuating apparatus having material composed of coiled stainless steel metals, metal alloys and other hybrid materials, and an impact reinforcement attenuating apparatus having material composed of coiled stainless steel, and an impact reinforcement attenuating apparatus having material composed of coiled carbon fibers, and an impact reinforcement attenuating apparatus having material composed of coiled interlocking graphene hoops, hooks, and rings, and an impact reinforcement attenuating apparatus having material composed of coiled plastic material, wherein the thickness of each filler or bonding layer is in the range of from about 0.00005 to 0.250 inches.

In accordance with another preferred embodiment of the present invention, an impact reinforcement attenuating apparatus is provided having material composed of a coiled sleeve of woven plastic material, and a generally dome shaped reinforcement structure such as helmet(s) liners further comprising a length a coiled dome comprising a length of dome structure, said dome length being open at least one end, and the impact reinforcement attenuating apparatus coil device, wherein the reinforcement "rings," "hoops" sizes range from about 0.250 to 3.00 includes O.D. ranging between 0.330 to 2.00 inches O.D, and an impact reinforcement attenuating apparatus having material composed of woven plastic material, wherein said layer of filler or bonding material comprises synthetic plastic material, and an impact reinforcement attenuating apparatus having material composed of woven plastic material, wherein each hemisphere or strip is molecularly oriented in the same direction of the of the length of the helmet reinforcement or strip, and an impact reinforcement attenuating apparatus having a apparatus having material composed of woven plastic material, wherein each strip is of a synthetic plastic material is selected from the group consisting of polypropylene, polyethylene, linear low density polyethylene, polyamides, high density polyethylene, polyesters, polystyrene, polyvinyl chloride, their copolymers and mixtures thereof, and an impact reinforcement attenuating apparatus having material composed of woven plastic material, wherein the width of each strip in the range of from about 0.005 to about 2 inches, and an impact reinforcement attenuating apparatus having material composed of woven plastic material, wherein the thickness of each strip is in the range of from about 0.01 to about 0.50 inches.

In accordance with another preferred embodiment of the present invention, an impact reinforcement attenuating apparatus is provided having material composed of woven plastic material, wherein said layer of filler or bonding material comprises synthetic plastic material selected from the group consisting of linear low density polyethylene, ionomers, polyvinyl chloride, ethyl vinyl acetate, ethyl propyl copolymers, polyethylene copolymers, low density polyethylene, their copolymers, vinyl copolymers and mixtures thereof linear low density polyethylene, ionomers, polyvinyl chloride, ethyl vinyl acetate, ethyl propyl copolymers, polyethylene copolymers, low density polyethylene, their copolymers, vinyl copolymers polyolefin, polypropylene, polystyrene, polyethylene, polyurethane, polyvinyl alcohol (water soluble), burlap, silk, carbon, Kevlar™ or other natural or hybrid materials and mixtures thereof, and an impact reinforcement attenuating apparatus having material composed of woven plastic material, wherein the thickness of each filler or bonding layer is in the range of from about 0.01 to 0.50 inches, and an impact reinforcement attenuating apparatus having material composed of woven plastic material, and an impact reinforcement attenuating apparatus having material composed of woven plastic material, wherein said layer of filler or bonding material comprises synthetic plastic material, and an impact reinforcement attenuating apparatus having material composed of woven plastic material, wherein each strip is of a synthetic plastic material consisting of selected from the group consisting of polypropylene, polyethylene, linear low density polyethylene, polyamides, high density polyethylene, polyesters, polystyrene, polyvinyl chloride, their copolymers and mixtures thereof, and an impact reinforcement attenuating apparatus having material composed of woven plastic material, wherein the width of each strip in the range of between about 0.02 to about 1.00 inch, and an impact reinforcement attenuating apparatus having material composed of woven plastic material, wherein the thickness of each strip is in the range of from about 0.01 to about 0.250 inches.

In accordance with another preferred embodiment of the present invention, an impact reinforcement attenuating apparatus is provided having material composed of woven plastic materials, wherein said layer of filler or bonding material comprises synthetic plastic material selected from the group consisting of linear low density polyethylene, ionomers, polyvinyl chloride, ethyl vinyl acetate, ethyl propyl copolymers, polyethylene copolymers, low density polyethylene, their copolymers, vinyl copolymers and mixtures thereof linear low density polyethylene, ionomers, polyvinyl chloride, ethyl vinyl acetate, ethyl propyl copolymers, polyethylene copolymers, low density polyethylene, their copolymers, vinyl copolymers polyolefin, polypropylene, polystyrene, polyethylene, polyurethane, polyvinyl alcohol (water soluble), burlap, silk, carbon, Kevlar® or other natural or hybrid materials and mixtures thereof, and an impact reinforcement attenuating apparatus having material composed of woven plastic material, wherein the thickness of each filler or bonding layer is in the range of from about 0.00005 to 0.250 inches, and an impact reinforcement attenuating apparatus having material composed of a woven sleeve of woven plastic material, and a generally dome shaped reinforcement structure such as helmet(s) comprising a length a woven reinforcement dome shaped structure comprising a length of dome structure, said dome length being open at least one end.

Preferably, the impact recoil control helmet is designed for playing football; and wherein the helmet is designed for motorcycle riding; and wherein the helmet is designed for playing baseball; and wherein the helmet is designed for playing lacrosse; and wherein the helmet is designed for playing polo; and wherein the helmet is designed for playing hockey; and wherein the helmet is designed for ballistic helmets; and wherein the helmet is designed for driving racecars; and wherein the helmet is designed for piloting aircraft, and also the impact recoil control apparatus device wherein the helmet is designed for construction safety.

Preferably, the helmet comprises a coiled attenuating apparatus, wherein the helmet comprises a mesh attenuating apparatus, wherein the helmet comprises a woven attenuating apparatus, wherein the configuration of the recoil attenuation apparatus contains coils is encased in plastic or plastics, wherein the configuration of the recoil attenuation apparatus contains coils is encased in plastic or plastics for playing football, and wherein the configuration of the recoil attenuation apparatus contains coils is encased in plastic or plastics for motorcycle riding, and wherein the configuration of the recoil attenuation apparatus contains coils is encased in plastic or plastics for playing baseball, and wherein the configuration of the recoil attenuation apparatus contains coils is encased in plastic or plastics for playing hockey, and wherein the configuration of the recoil attenuation apparatus contains coils is encased in plastic or plastics for playing lacrosse, and wherein the configuration of the recoil attenuation apparatus contains coils is encased in plastic or plastics for playing polo, and wherein the configuration of the recoil attenuation apparatus contains coils is encased in plastic or plastics for construction safety, and wherein the configuration of the recoil attenuation apparatus contains coils is encased in plastic or plastics for ballistic helmets, and wherein the configuration of the recoil attenuation apparatus contains coils is encased in plastic or plastics for driving racecars, and wherein the configuration of the recoil attenuation apparatus contains coils is encased in plastic or plastics for piloting aircraft, and the impact recoil attenuating control apparatus device wherein the configuration of the recoil attenuation apparatus contains mesh is encased in plastic or plastics, wherein the configuration of the recoil attenuation apparatus contains mesh is encased in plastic or plastics for playing football, and wherein the configuration of the recoil attenuation apparatus contains mesh is encased in plastic or plastics for motorcycle riding, and wherein the configuration of the recoil attenuation apparatus contains mesh is encased in plastic or plastics for playing baseball, and wherein the configuration of the recoil attenuation apparatus contains mesh is encased in plastic or plastics for playing hockey, and wherein the configuration of the recoil attenuation apparatus contains mesh is encased in plastic or plastics for playing lacrosse, and wherein the configuration of the recoil attenuation apparatus contains mesh is encased in plastic or plastics for playing polo, and wherein the configuration of the recoil attenuation apparatus contains mesh is encased in plastic or plastics for construction safety, and wherein the configuration of the recoil attenuation apparatus contains mesh is encased in plastic or plastics for ballistic helmets, and wherein the configuration of the recoil attenuation apparatus contains mesh is encased in plastic or plastics for driving racecars, and wherein the configuration of the recoil attenuation apparatus contains mesh is encased in plastic or plastics for piloting aircraft, and wherein the configuration of the recoil attenuation apparatus contains woven materials is encased in plastic or plastics, wherein the configuration of the recoil attenuation apparatus contains woven materials is encased in plastic or plastics for playing football, and wherein the configuration of the recoil attenuation apparatus contains woven materials is encased in plastic or plastics for motorcycle riding, and wherein the configuration of the recoil attenuation apparatus contains woven materials is encased in plastic or plastics for playing baseball, and wherein the configuration of the recoil attenuation apparatus contains woven materials is encased in plastic or plastics for playing hockey, and wherein the configuration of the recoil attenuation apparatus contains woven materials is encased in plastic or plastics for playing lacrosse, and wherein the configuration of the recoil attenuation apparatus contains woven materials is encased in plastic or plastics for playing polo, and wherein the configuration of the recoil attenuation apparatus contains woven materials is encased in plastic or plastics for construction safety, and wherein the configuration of the recoil attenuation apparatus contains woven materials is encased in plastic or plastics for ballistic helmets, and wherein the configuration of the recoil attenuation apparatus contains woven materials is encased in plastic or plastics for driving racecars, and wherein the configuration of the recoil attenuation apparatus contains woven materials is encased in plastic or plastics for piloting aircraft.

In accordance with another preferred embodiment of the present invention, a reinforced a impacted attenuating football helmet method is provided comprising: a reinforced plastic shell configured to receive a head of a wearer of the helmet, the shell having a front region, a rear region, and two side regions wherein each side region has an ear flap with an ear opening(s), each ear flap having a slot and an integral jaw flap that extends forward towards the front region; the reinforced shell further having a lower edge extending between the jaw flaps and along the rear region, the lower edge having an angled transition portion positioned below each ear openings, the transition portion formed by two segments of the lower edge that intersect, wherein the lower edge forward of the transition portion resides below the lower edge rearward of the transition portion; and a chin strap assembly that reasonably sufficiently secures the reinforced helmet to the wearer, the chin strap assembly having a central member and at least one flexible strap extending outwardly from each side of the central member, wherein the at least two flexible straps reasonably connects to the reinforced shell, wherein each crown area to the ear flap has a face guard connector attenuating method where the face guard is securely positioned into and attached into the receiving groove method or receiving channel, the removable face guard method is securely attached wherein the receiving groove or channel has a major axis and a minor axis, the major axis positioned vertical to the lower edge of the shell edge and substantially parallels to a longitudinal axis of the shell, wherein each ear flap has both a face guard connector method and an outwardly extending first snap connector method that is positioned rearward of the face guard connector method, wherein the first snap connector method reasonably connects with an end of the flexible strap method, wherein the elongated arch positions and engages a portion of the flexible strap securement method when the flexible strap is secured to the first snap connector, wherein the transition portion engages the flexible strap when the flexible strap is secured to the first snap connector, wherein each ear flap has a second snap connector that is positioned above both the face guard connector and the ear port openings in the ear flap, wherein a chord extending between the first and second snap connectors intersects the ear opening.

In accordance with another preferred embodiment of the present invention, a reinforced attenuating football safety helmet method is provided comprising: a plastic shell configured to receive a head of a wearer of the helmet, the shell having a front region, a rear region, and two side regions wherein each side region has an ear flap with three ear port openings, each ear flap having an integral jaw flap that extends forward towards the front region; the shell further having a lower edge extending between the jaw flaps and along the rear region, the lower edge having an angled transition portion positioned below three ear port openings, the transition portion formed by the intersection of a forward segment of the lower edge and a rearward segment of the lower edge, and a chin strap assembly method that reasonably secures the helmet to the wearer, the chin strap assembly method having a central member and at least one flexible strap method extending outwardly from each side of the central member, wherein the at least one flexible strap reasonably connects to the shell and engages the transition portion, wherein the intersection of the forward segment and the rearward segment define an obtuse angle of the transition portion, wherein the forward segment of the lower edge resides below the rearward segment of the lower edge, wherein the lower edge is continuous and un-interrupted between the jaw flaps, along the rear region and through the transition portions, wherein each jaw flap has a bottom edge, a substantially linear front edge that extends upward from the bottom edge and a top edge that is inclined from the front edge, wherein the bottom edge and the front edge of the jaw flap are substantially perpendicular, wherein the front edge and the top edge of the jaw flap define an obtuse angle.

In accordance with another preferred embodiment of the present invention, a reinforced attenuating safety football helmet method is provided comprising: a plastic shell configured to receive a head of a wearer of the helmet, the shell having a front region, a rear region, and two side regions wherein each side region has an ear flap, crown area to each ear flap having a face guard connectors, three ear openings, and a slot positioned rearward of the face guard connector method and below an uppermost edge of the three ear port openings, and a snap connector method positioned rearward of the three ear port openings and below the uppermost edge of the ear openings method; and a chin strap assembly method that releasably secures the helmet to the wearer, the chin strap assembly having a central member and at least one flexible strap extending outwardly from each side of the central member, wherein the flexible strap is received by the elongated arch positioning method, wherein each ear flap has a second snap connector positioned above the method of face guard connection, the second snap connector adapted to releasably engage a second flexible strap of the chin strap assembly method, wherein the second snap connector is positioned above an uppermost bar of a face guard secured to the shell by the face guard connectors method, wherein the elongated arch has a major axis and a minor axis and wherein the major axis is substantially parallel to a longitudinal axis of the shell, wherein each ear flap has an integral jaw flap that extends forward towards the front region, wherein each jaw flap has a bottom edge, a substantially linear front edge that extends upward from the bottom edge and a top edge that is inclined from the front edge, wherein the bottom edge and the front edge of the jaw flap are substantially perpendicular, wherein the front edge and the top edge of the jaw flap define an obtuse angle.

In accordance with another preferred embodiment of the present invention, a reinforced attenuating helmet method is provided comprising: a plastic shell configured to receive a head of a wearer of the helmet, the shell having a front region, a rear region, and two side regions wherein each side region has an ear flap with ear port openings method, and an integral jaw flap that extends forward from the ear flap; the shell further having a lower edge extending between the jaw flaps and along the rear region, the lower edge having an angled transition portion positioned below each ear port openings method, the transition portion formed by two segments of the lower edge that intersect, wherein the lower edge forward of the transition portion resides below the lower edge rearward of the transition portion; and a chin strap assembly that releasably secures the helmet method to the wearer, the chin strap assembly method having a central member and a flexible strap extending outwardly from each side of the central member, wherein the flexible strap releasably connects to the shell, wherein the transition elongated arch portion method engages the flexible strap when the flexible strap is secured to the shell, wherein the three ear port openings has a rear edge that is rearward of the transition portion, and wherein a face guard connector method is forward of the rear edge of the three ear port openings, wherein each jaw flap has a bottom edge, a substantially linear front edge that extends upward from the bottom edge and a top edge that is inclined from the front edge, further comprising a jaw pad removable attached to an inner surface of the jaw flap, wherein the jaw pad method has two or more force attenuating memory foam layers with a density of at least 5.00 pounds per cubic foot and at least a 25% compression deflection of 8.00 pounds per square inch, further comprising a jaw pad removable attached to an inner surface of the jaw flap, wherein the jaw pad has two or more force attenuating memory foam layers with a surface comfort layer having a density of at least 0.10 to 0.40 pounds per cubic foot and at least a 25% compression deflection of 0.10 pounds per square inch, further comprising a jaw pad removable attached to an inner surface of the jaw flap, wherein the jaw pad has two or more force attenuating memory foam layers with a density of at least 5.00 pounds per cubic foot and at least a 25% compression deflection of 8.00 pounds per square inch, wherein the jaw pad further has a multi-layer memory foam comfort layer, wherein the jaw pad method has a front edge that is positioned both in front of a coronal plane and below a basic plane of the head of a wearer of the helmet method.

A reinforced attenuating safety football helmet method comprising: a plastic shell configured to receive a head of a wearer of the helmet, the shell having a front region, a rear region, and two side regions wherein each side region has an ear flap with generally slightly arched three ear port openings, and an integral jaw flap that extends forward from the ear flap; a chin strap assembly that reasonably secures the reinforced safety helmet method to the wearer, the chin strap assembly having a central member and a pair of lower flexible strap that extend outwardly from the central member; and, the shell further having a lower edge extending between the jaw flaps and along the rear region, the lower elongated arch having means for positioning and engaging the lower flexible strap method to resist forward rolling of the helmet upon a downward impact to the reinforced safety helmet, wherein the means for engaging is positioned below the three ear port openings method, wherein the means for engaging consists of a first angled lower edge segment intersecting a second angled lower edge segment.

Preferably, the recoil helmet device comprises a clear window or port viewing apparatus on a portion of the helmet that visually reveals into the helmet(s) reinforcements apparatuses under a translucent or transparent shell window to visually verify the reinforcement configurations, bar codes, laminates, holograms, logos, embedded chips, trademarks, manufacturing and other codes, etc., wherein the viewing device comprises a viewing window that is preferably round or oval or other geometric configurations such as pentagon having a diameter of 0.250 of an inch to 3.00 inches, more preferably between about 0.750 inch to 2.00 inches, wherein the viewing window apparatus device comprises an initial or first recessed clear surface for visually revealing a logo, wherein the viewing window device apparatus comprises an initial or first recessed clear surface for visually revealing a bar code, wherein the viewing window apparatus comprises an initial or first clear recessed surface for visually revealing a QR code, wherein the viewing window apparatus comprises an initial or first clear recessed surface for visually revealing coils, wherein the viewing window apparatus comprises an initial or first clear recessed surface for visually revealing mesh, wherein the viewing window apparatus comprises an initial or first clear recessed surface for visually revealing woven materials, wherein the viewing window apparatus comprises an initial or first clear recessed surface for visually revealing a hologram, wherein the viewing window apparatus device comprises an initial or first clear recessed surface for visually revealing logo(s), bar code(s), QR code(s), coils, mesh, woven materials, laminate(s), hologram(s), or any combination therein, wherein the viewing window apparatus device, wherein the helmet(s) is designed for motorcycle riding, wherein the viewing window apparatus device, wherein the helmet(s) is designed for playing football, wherein the viewing window apparatus device, wherein the helmet(s) is designed for playing hockey, wherein the viewing window apparatus device, wherein the helmet(s) is designed for playing baseball, wherein the viewing window apparatus device, wherein the helmet(s) is designed for playing lacrosse, wherein the viewing window apparatus device, wherein the helmet(s) is designed for playing polo, wherein the viewing window apparatus device, wherein the helmet(s) is designed for ballistic helmets, wherein the viewing window apparatus device, wherein the helmet(s) is designed for construction safety, wherein the viewing window apparatus device, wherein the helmet(s) is designed for driving racecars, wherein the viewing window apparatus device, wherein the helmet(s) is designed for piloting aircraft, wherein the recoil helmet device, wherein the helmets comprises a window or port viewing method, on a portion of the helmet that visually reveals into the helmet(s) reinforcements apparatuses under a translucent or transparent shell window to visually verify the reinforcement configurations, bar codes, laminates, holograms, logos, embedded chips, trademarks, manufacturing, factory and other codes, etc., wherein the viewing window method device comprises an initial or first recessed clear surface for visually revealing a logo, wherein the viewing window device method comprises an initial or first recessed clear surface for visually revealing a bar code, wherein the viewing window method device comprises an initial or first clear recessed surface for visually revealing a QR code, wherein the viewing window method device comprises an initial or first clear recessed surface for visually revealing coils, wherein the viewing window method device comprises an initial or first clear recessed surface for visually revealing mesh, wherein the viewing window method device comprises an initial or first clear recessed surface for visually revealing woven materials, wherein the viewing window method device comprises an initial or first clear recessed surface for visually revealing a hologram, wherein the viewing window method device comprises an initial or first clear recessed surface for visually revealing logo(s), bar code(s), QR code(s), coils, mesh, woven materials, laminate(s), hologram(s), or any combination therein, wherein the viewing window method device, wherein the helmet(s) is designed for motorcycle riding, wherein the viewing window method device, wherein the helmet(s) is designed for playing football, wherein the viewing window method device, wherein the helmet(s) is designed for playing hockey, wherein the viewing window method device, wherein the helmet(s) is designed for playing baseball, wherein the viewing window method device, wherein the helmet(s) is designed for playing lacrosse, wherein the viewing window method device, wherein the helmet(s) is designed for playing polo, wherein the viewing window method device, wherein the helmet(s) is designed for ballistic helmets, wherein the viewing window method device, wherein the helmet(s) is designed for construction safety, wherein the viewing window method device, wherein the helmet(s) is designed for driving racecars, wherein the viewing window method device, wherein the helmet(s) is designed for piloting aircraft.

In accordance with another preferred embodiment of the present invention, an adjustable helmet multi-layered liner method for a protective helmet having an interior surface is provided, the adjustable memory foam liner force attenuating safety helmet comprising: at least one force attenuating liner wall method having a peripheral surface adapted to substantially conform to, and fit within, the protective safety helmet method for sufficient engagement and comfort with the head of a wearer of the protective safety helmet, the at least one liner wall having an outer surface and an inner surface, the outer surface adapted to be disposed adjacent the interior surface of the safety helmet method and the inner surface adapted to be spaced from the interior surface of the helmet whereby the liner method may be inserted into the protective helmet and adjusts to the head of the wearer of the protective safety helmet; having at least one expandable band method disposed along a portion of the outer surface of the liner wall, whereby the at least one expandable band method provides for the adjustment of the liner to the head of the wearer of the protective safety helmet; and at least one helmet attachment aperture disposed on the liner wall adapted to connect the adjustable helmet liner method to the protective safety helmet, wherein the at least one liner wall includes at least one band attachment aperture adapted to connect the at least one expandable band to the at least one liner wall method, wherein the inner surface of the at least one liner wall includes at least one impact multi-layered memory foam force attenuating absorption pad, wherein the at least one impact absorption multi-layered pad method is formed of a plastic memory foam force attenuating material, wherein the plastic multi-layered memory foam force attenuating material is a closed cell plastic foam material, wherein the closed cell plastic multi-layered memory foam force attenuating material attenuating method is cross-linked polyethylene, wherein the at least one liner wall attenuating method is formed of a plastic memory foam force attenuating material.

In accordance with another preferred embodiment of the present invention, an adjustable helmet liner attenuating method for a protective helmet having an interior surface is provided, the adjustable helmet multi-layered memory foam force attenuating liner comprising: at least one liner wall attenuating method having a peripheral surface adapted to substantially conform to, and fit within, the protective safety helmet attenuating method for engagement with the head of a wearer of the protective helmet, the at least one liner wall having an outer surface and an inner surface, the outer surface attenuating pad adapted to be disposed adjacent the interior surface of the helmet and the inner surface adapted to be spaced from the interior surface of the safety helmet attenuating liner whereby the multi-layered force attenuating memory foam liner method attenuating method may be inserted into the protective helmet and adjusts to the head of the wearer of the protective helmet; a first side wall having a first longitudinal axis and a plurality of edge surfaces; a first attachment wall disposed along a second edge surface of the first side wall; a second side wall having a second longitudinal axis and a plurality of edge surfaces; a second attachment wall disposed along a sixth edge surface of the second side wall; a rear wall having a third longitudinal axis and a plurality of edge surfaces; a third attachment wall disposed along a tenth edge surface of the rear wall; an apex defined by the intersection of the first, second, and third attachment walls; and at least one safety helmet attachment aperture disposed on the at least one liner wall method adapted to connect the adjustable helmet liner to the protective helmet, further including at least one expandable adjustable band associated with the at least one liner wall, wherein each of the first, second, and rear walls includes at least one band attachment aperture adapted to connect the at least one expandable adjustable band to the first, second, and rear walls, wherein each of the first, second, and rear walls includes at least one impact absorption pad, wherein the plurality of edge surfaces of the first side wall includes first, second, third, and fourth edge surfaces, the first and third edge surfaces being disposed substantially perpendicular to the first longitudinal axis, and the second and fourth edge surfaces being disposed substantially parallel to the first longitudinal axis, wherein the plurality of edge surfaces of the second side wall includes fifth, sixth, seventh and eighth edge surfaces, the fifth and seventh edge surfaces being disposed substantially perpendicular to the second longitudinal axis, and the sixth and eighth edge surfaces being disposed substantially parallel to the second longitudinal axis, wherein the plurality of edge surfaces of the rear wall includes ninth, tenth, eleventh and twelfth edge surfaces, the ninth and eleventh edge surfaces being disposed substantially perpendicular to the third longitudinal axis, and the tenth and twelfth edge surfaces being disposed substantially parallel to the third longitudinal axis.

In accordance with another preferred embodiment of the present invention, a protective safety helmet is provided comprising: a safety helmet shell having an interior surface, portions of the interior surface having multi-layered memory foam force attenuating pad structures disposed thereon in a spaced relationship, other portions of the interior surface being exposed in the spaces between the multi-layered memory foam force attenuating pad structures; an adjustable safety helmet multi-layered memory foam force attenuating liner method for the helmet shell, the adjustable helmet multi-layered memory foam force attenuating liner including a liner wall having a peripheral surface adapted to substantially conform to, and fit within, the spaces between the pad structures of the helmet for engagement with the head of a wearer of the protective helmet, the at least one multi-layered memory foam force attenuating liner wall having an outer surface and an inner surface, the outer surface adapted to be disposed adjacent the interior surface of the helmet and the inner surface adapted to be spaced from the interior surface of the helmet whereby the memory foam force attenuating multi-layered liner method may be inserted into the protective safety helmet and adjusts to the head of the wearer of the protective safety helmet; at least one expandable band disposed along a portion of the outer surface, whereby the at least one expandable band provides for the adjustment of the memory foam force attenuating multi-layered liner method to the head of the wearer of the protective helmet; and at least one helmet attachment fastener disposed on the memory foam force attenuating multi-layered liner wall method adapted to connect the adjustable helmet liner to the protective safety helmet, wherein the at least one liner wall method includes at least one helmet attachment aperture adapted to connect the adjustable safety helmet memory foam force attenuating multi-layered liner method to the protective safety helmet, wherein the at least one memory foam force attenuating multi-layered liner wall method includes at least one band attachment aperture adapted to connect the at least one expandable band to the at least one liner wall, wherein the inner surface of the at least one multi-layered memory foam force attenuating liner wall method includes at least two impact absorption pads, wherein the at least one memory foam force attenuating multi-layered liner wall method is formed of a plastic material.

In accordance with another preferred embodiment of the present invention, an adjustable safety helmet liner method for a protective helmet having an interior surface is provided, the adjustable helmet memory foam force attenuating multi-layered liner method comprising: at least one memory foam force attenuating multi-layered liner wall method having a peripheral surface adapted to substantially conform to, and fit within, the protective helmet for engagement with the head of a wearer of the protective helmet, the at least one memory foam force attenuating multi-layered liner wall method having an outer surface and an inner surface, the outer surface adapted to be disposed adjacent the interior surface of the safety helmet and the inner surface adapted to be spaced from the interior surface of the helmet whereby the memory foam force attenuating multi-layered liner method may be inserted into the protective safety helmet and adjusts to the head of the wearer of the protective safety helmet; at least one expandable band disposed along a portion of the outer surface of the memory foam force attenuating multi-layered liner wall, whereby at least one expandable band provides for the adjustment of the liner to the head of the wearer of the protective helmet; and at least two impact absorption pad disposed on the inner surface of the at least one liner wall, and an adjustable safety helmet multi-layered memory foam force attenuating liner for a protective safety helmet method having an interior surface, the adjustable helmet memory foam force attenuating multi-layered liner method comprising: at least one liner wall having a peripheral surface adapted to substantially conform to, and fit within, the protective helmet for engagement with the head of a wearer of the protective safety helmet, the at least one memory foam liner wall having an outer surface and an inner surface, the outer surface adapted to be disposed adjacent the interior surface of the helmet and the inner surface adapted to be spaced from the interior surface of the helmet whereby the memory foam liner may be inserted into the protective safety helmet and adjusts to the head of the wearer of the protective helmet; a first side wall having a first longitudinal axis and a plurality of edge surfaces; a first attachment wall disposed along a second edge surface of the first side wall; a second side wall having a second longitudinal axis and a plurality of edge surfaces; a second attachment wall disposed along a sixth edge surface of the second side wall; a rear wall having a third longitudinal axis and a plurality of edge surfaces; a third attachment wall disposed along a tenth edge surface of the rear wall; an apex defined by the intersection of the first, second, and third attachment walls; and at least two impact absorption multi-layered memory foam force attenuating pads methods disposed on each of the first, second and rear walls.

In accordance with another preferred embodiment of the present invention, a protective safety helmet is provided comprising: a safety helmet shell having an interior surface, portions of the interior surface having multi-layered memory foam force attenuating pads structures disposed thereon in a spaced relationship, other portions of the interior surface being exposed in the spaces between the pad structures; an adjustable helmet multi-layered memory foam force attenuating liner method for the safety helmet shell, the adjustable helmet liner including a liner wall method having a peripheral surface adapted to substantially conform to, and fit within, the spaces between the pad structures of the helmet method for engagement with the head of a wearer of the protective helmet, the at least one memory foam impact force attenuating liner wall having an outer surface and an inner surface, the outer surface adapted to be disposed adjacent the interior surface of the helmet and the inner surface adapted to be spaced from the interior surface of the helmet whereby the multi-layered memory foam force attenuating liner may be inserted into the protective helmet and self adjusts to the head of the wearer of the protective safety helmet; at least one expandable band disposed along a portion of the outer surface, whereby the at least one expandable band method provides for the adjustment of the liner to the head of the wearer of the protective helmet; and at least one multi-layered memory foam impact absorption force attenuating pad disposed on the inner surface of the at least one liner wall, and an impact force attenuating multi-layered memory foam safety helmet lining method that improves the moisture wicking action comprises a first surface made of flexible high polymer resin; a second surface made of flexible high polymer resin, in at least partially coextensive relation to the first surface to define a cavity there between, the coextensive relation defining opposing corresponding portions of the first and second surfaces; a plurality of impact force attenuating multi-layered memory foam safety helmet lining support members comprising externally directed ellipsed domed surface in the first surfaces extending out of the impact force attenuating multi-layered memory foam helmet lining method in each of the first surfaces having a generally ellipsed dome shape and an outwardly facing ellipsed dome; having multiple layers of different viscoelastic foams substantially overlying the first surface, and a enclosure surrounding the first surface, the second surface and the foam multi-layers.

In accordance with another preferred embodiment of the present invention, an impact force attenuating multi-layered memory foam helmet lining and method is provided comprising: (a) a first surface made of flexible high polymer resin; (b) a second surface made of flexible high polymer resin, in at least partially coextensive relation to said first surface to define a cavity there between, said coextensive relation defining opposing corresponding portions of said first and second surfaces; (c) a plurality of impact force attenuating multi-layered memory foam safety helmet lining method having support members comprising externally directed ellipsed domed surface extending the first surfaces having a generally polygon/pentagon shape and an outwardly facing ellipsed domed surface; (d) multi-layers of visco-elastic foam substantially overlying the first surface; and, (e) an enclosure surrounding the first surface, the second surface and the multi-layered foam, and an impact force attenuation multi-layered memory foam helmet lining method comprising: (a) a top surface made of flexible high polymer resin; (b) a bottom surface made of flexible high polymer resin, in at least partially coextensive relation to said top surface to define a space there between, said coextensive relation defining opposing corresponding portions of said top and bottom surfaces; (c) a impact force attenuation multi-layered memory foam safety helmet lining method plurality of support members comprising an externally directed ellipsed dome in said top surfaces extending in each of the top surfaces being substantially polygonal/pentagonal and having an outwardly facing ellipsed dome in said top surface, wherein the force required to compress the impact force attenuation multi-layered memory foam safety helmet lining apparatus is a substantially linear function of the deflection comprising the compression, wherein the ellipsed dome comprise a substantially non-planar surface opposite the outwardly facing surface, wherein the ellipsed dome comprise five pairs of opposing walls with a generally rounded section to an adjacent wall, plus a impact force attenuation multi-layered memory foam safety helmet lining method additionally comprising a substantially planar surface opposite the outwardly facing dome with a polygon/pentagon section joining each wall to the substantially planar surface, further comprising a recoil dampening method located inside the helmet(s), whereby the shock waves of the helmet(s) from one or more impacts is substantially eliminated, wherein the ratio of reinforcement method to helmet mass is about 1.0 to about 4.0, wherein the safety helmet(s) is designed for playing football, wherein the safety helmet(s) is designed for motorcycle riding, wherein the reinforcement mesh angle .alpha. is between about 90 degrees and about 180 degrees, wherein the reinforcement mesh angle .alpha. is between about 100 degrees and about 160 degrees, wherein the angle .alpha. is between about 100 degrees and about 150 degrees, wherein the configuration of the reinforcement and the impact is set so that the impulse transmitted from the impact(s) to the reinforcement in a longitudinal component of the impact, wherein the attenuating reinforcement method is housed in a face guard, further comprising a multi-layered filler or bonding lamination structure, wherein the reinforcement method is housed in a filler or bonding lamination structure.

In accordance with another preferred embodiment of the present invention, an impact attenuating control method and mesh device for use in a safety helmet(s) is provided, said device comprising: a reinforcement mesh positioned in response to the impact(s); wherein an angle .alpha. is formed between the initial impact path and the angle .alpha. is between about 45 degrees and about 155 degrees; wherein the reinforcement impact attenuating apparatus is configured to transmit an impulses to the alternates between the forward position and the rearward position, the impact having an attenuating component and method perpendicular to the impact axis of the impact of the helmet(s), wherein the angle .alpha. is between about 40 degrees and about 160 degrees, wherein the path or guide is angular, wherein the path is curved, wherein the path is pentagon, wherein the path is curvilinear, wherein the path is coiled, wherein the angle .alpha. is between about 40 degrees and about 160 degrees, wherein the angle formed by the axis formed by the longitudinal axis of the impact reinforcement mesh of the helmet(s) and the axis formed by the reinforcement mesh guide is between about 45 degrees and about 155 degrees, wherein the mesh angle is between about 90 degrees and about 180 degrees, wherein the helmet(s) is designed for motorcycle riding, wherein the helmet(s) is designed for playing football, and wherein the helmet(s) is designed for playing hockey, and wherein the helmet(s) is designed for playing baseball, and wherein the helmet(s) is designed for playing lacrosse, and wherein the helmet(s) is designed for playing polo, and wherein the helmet(s) is designed for ballistic helmets, and wherein the helmet(s) is designed for construction safety, and wherein the helmet(s) is designed for driving racecars, and wherein the helmet(s) is designed for piloting aircraft, and wherein the helmet(s) is designated for motorcycle riding, and wherein the helmets is designated for playing football, and wherein the helmets is designated for playing hockey, and wherein the helmets is designated for playing baseball, and wherein the helmets is designated for playing lacrosse, and, wherein the helmet(s) is designated for playing polo, and wherein the helmets is designated for ballistic helmets, and wherein the helmets is designated for construction safety, and wherein the helmets is designated for driving racecars, and wherein the helmets is designated for piloting aircraft.

In accordance with another preferred embodiment of the present invention, an impact attenuating control method and mesh device for use in a helmet(s) is provided, said device comprising: a impact attenuating control device or devices wherein an angle .alpha. is formed between the reinforcement mesh device initial angle .alpha. is between about 6 degrees and about 45 degrees; wherein the reinforcement mesh device is configured to transmit a wide variety of impact impulses to the reinforcement apparatus that alternates between the forward position and the rearward position, the impulse(s) having a component perpendicular to the impacts axis of the reinforcement apparatus of the helmet(s), wherein the angle .alpha. is between about 100 degrees and about 180 degrees, wherein the reinforcement is housed in a helmet(s), wherein the reinforcement is straight, wherein the angle .alpha. is between about 100 degrees and about 150 degrees, wherein the reinforcement is housed in a shell of a helmet(s), wherein the mass of the reinforcement is greater than the mass of the helmet plastic, wherein the ratio of reinforcement mass to helmet mass is approximately 2 to about 4, wherein the mass of the reinforcement is greater than the mass of the helmets plastic, wherein the ratio of reinforcement mass to helmet mass is approximately 2 to about 4, wherein the ratio of reinforcement mass to helmet mass is approximately 2.5 to about 3.

Preferably, the impact attenuating control mesh and method device is housed in a shell of (a) helmet(s), encompasses a wide variety of force attenuating reinforcement methods and apparatuses that are articulated so that the displacement of impacts results in a force component outside the impact axis of the impact of the helmet(s). The coil impact force attenuating control device(s) can be incorporated into a wide variety of safety helmet(s) of a variety of sizes and configurations to produce impact reduction. The reinforcement "coils" attenuate the impact(s) highly non-linear system(s) derived from their tunable dynamic response, encompassing linear, and weakly nonlinear, and strongly nonlinear impact(s) regimes, having methods and apparatuses for controlling the varying static and dynamic applied load(s), attenuates the propagation of highly nonlinear solitary waves of these impact waves, including the traveling pulse width, wave speeds, further including a number of separated pulses (singular or train of pulses), etc., are controlled by the reinforcement(s) "coils," thus modifying one or many of the impact parameters, such as the, static and dynamic force amplitude, the type and duration of the initial excitation (impact or impacts) applied to the reinforcement "coils" apparatus and system(s), and/or the periodicity of the coils having the ability to control the wave properties in such coils. Further including the collective vibrations of the methods and apparatuses reinforcement(s) particles for controlling the dynamic response of the reinforcement methods and apparatuses attenuating system(s). Further including such as the re-formation of reflected solitary waves propagating back from the interface, which are sensitive to the "coils" geometric configurations and material properties of their adjoining media.

Preferably, the recoil controlling device comprises reinforcement "coils," "rings," "hoops" ranging in size from about 0.250 inches to about 3.00 inches, including O.D. ranging between 0.330 to 2.00 inches O.D, and an impact reinforcement attenuating method having material composed of coiled plastic material, wherein said layer of filler or bonding material comprises synthetic plastic material, and an impact reinforcement attenuating method having material composed of coiled plastic material, wherein each hemisphere or strip is molecularly oriented in the same direction of the of the length of the safety helmet or strip, and a impact reinforcement attenuating method having a apparatus having attenuating material composed of coiled plastic material, wherein each strip is of a synthetic plastic material selected from the group consisting of polypropylene, polyethylene, linear low density polyethylene, polyamides, high density polyethylene, polyesters, polystyrene, polyvinyl chloride, their copolymers and mixtures thereof, impact reinforcement attenuating method having material composed of coiled plastic material, wherein the width of each strip in the range of from about 0.005 to about 2.00 inches, and an impact reinforcement attenuating method having material composed of coiled plastic material, wherein the gauge/thickness of each strip is in the range of from about 0.01 to about 0.50 inches.

Preferably, the layer of filler or bonding material comprises synthetic plastic material selected from the group consisting of linear low density polyethylene, ionomers, polyvinyl chloride, ethyl vinyl acetate, ethyl propyl copolymers, polyethylene copolymers, low density polyethylene, their copolymers, vinyl copolymers and mixtures thereof linear low density polyethylene, ionomers, polyvinyl chloride, ethyl vinyl acetate, ethyl propyl copolymers, polyethylene copolymers, low density polyethylene, their copolymers, vinyl copolymers polyolefin, polypropylene, polystyrene, polyethylene, polyurethane, polyvinyl alcohol (water soluble), burlap, silk, carbon, Kevlar®, or other natural or hybrid materials and mixtures thereof, and an impact reinforcement attenuating method having material composed of coiled plastic material, wherein the thickness of each laminate filler or bonding layer is in the range of from about 0.01 to 0.50 inches, and an impact reinforcement attenuating method having material composed of coiled plastic material, and an impact reinforcement attenuating method having material composed of coiled plastic material, wherein said layer of filler or bonding material comprises synthetic plastic material, and an impact reinforcement attenuating method having material composed of coiled plastic material, wherein each strip is of a synthetic plastic material consisting of selected from the group consisting of polypropylene, polyethylene, linear low density polyethylene, polyamides, high density polyethylene, polyesters, polystyrene, polyvinyl chloride, their copolymers and mixtures thereof impact reinforcement attenuating method having material composed of coiled plastic material, wherein the width of each strip in the range of between about 0.02 to about 1.00 inch, and an impact reinforcement attenuating method having material composed of coiled plastic material, wherein the thickness of each strip is in the range of from about 0.01 to about 0.250 inches, and an impact reinforcement attenuating method having material composed of coiled plastic material, wherein said layer of filler or bonding material comprises synthetic plastic material selected from the group consisting of linear low density polyethylene, ionomers, polyvinyl chloride, ethyl vinyl acetate, ethyl propyl copolymers, polyethylene copolymers, low density polyethylene, their copolymers, vinyl copolymers and mixtures thereof linear low density polyethylene, ionomers, polyvinyl chloride, ethyl vinyl acetate, ethyl propyl copolymers, polyethylene copolymers, low density polyethylene, their copolymers, vinyl copolymers polyolefin, polypropylene, polystyrene, polyethylene, polyurethane, polyvinyl alcohol (water soluble), burlap, silk, carbon, Kevlar® or other natural or hybrid materials and mixtures thereof, and an impact reinforcement attenuating method having material composed of coiled stainless steel metal, metal alloys and other hybrid materials, and an impact reinforcement attenuating method having material composed of coiled stainless steel, and an impact reinforcement attenuating method having material composed of coiled carbon fibers, and an impact reinforcement attenuating method having material composed of coiled interlocking graphene loops and hoops, and an impact reinforcement attenuating method having material composed of coiled plastic material, wherein the thickness of each filler or bonding layer is in the range of from about 0.00005 to 0.250 inches, and an impact reinforcement attenuating method having material composed of a coiled sleeve of woven plastic material, and a generally dome shaped reinforcement structure such as helmet(s) liners further comprising a length a coiled dome comprising a length of dome structure, the length of said dome being open at least one end, and the impact reinforcement "coils" attenuating apparatus device, wherein the reinforcement "rings," "hoops" sizes range from about 0.250 to 3.00 includes O.D. ranging between 0.330 to 2.00 inches O.D, and an impact reinforcement attenuating method having material composed of woven plastic material, wherein said layer of filler or bonding material comprises synthetic plastic material, and an impact reinforcement attenuating method having material composed of woven plastic material, wherein each hemisphere or strip is molecularly oriented in the same direction of the of the length of the helmet reinforcement or strip, and an impact reinforcement attenuating method having a apparatus having material composed of woven plastic material, wherein each strip is of a synthetic plastic material is selected from the group consisting of polypropylene, polyethylene, linear low density polyethylene, polyamides, high density polyethylene, polyesters, polystyrene, polyvinyl chloride, their copolymers and mixtures thereof, and an impact reinforcement attenuating method having material composed of woven plastic material, wherein the width of each strip in the range of from about 0.005 to about 2.00 inches, and an impact reinforcement attenuating method having material composed of woven plastic material, wherein the thickness of each strip is in the range of from about 0.01 to about 0.50 inches.

Preferably, said layer of filler or bonding material comprises synthetic plastic material selected from the group consisting of linear low density polyethylene, ionomers, polyvinyl chloride, ethyl vinyl acetate, ethyl propyl copolymers, polyethylene copolymers, low density polyethylene, their copolymers, vinyl copolymers and mixtures thereof linear low density polyethylene, ionomers, polyvinyl chloride, ethyl vinyl acetate, ethyl propyl copolymers, polyethylene copolymers, low density polyethylene, their copolymers, vinyl copolymers polyolefin, polypropylene, polystyrene, polyethylene, polyurethane, polyvinyl alcohol (water soluble), burlap, silk, carbon, Kevlar® or other natural or hybrid materials and mixtures thereof, and an impact reinforcement attenuating method having material composed of woven plastic material, wherein the thickness of each filler or bonding layer is in the range of from about 0.01 to 0.50 inches, and an impact reinforcement attenuating method having material composed of woven plastic material, and an impact reinforcement attenuating method having material composed of woven plastic material, wherein said layer of filler or bonding material comprises synthetic plastic material, and an impact reinforcement attenuating method having material composed of woven plastic material, wherein each strip is of a synthetic plastic material consisting of selected from the group consisting of polypropylene, polyethylene, linear low density polyethylene, polyamides, high density polyethylene, polyesters, polystyrene, polyvinyl chloride, their copolymers and mixtures thereof, and an impact reinforcement attenuating method having material composed of woven plastic material, wherein the width of each strip in the range of between about 0.02 to about 1.00 inch, and an impact reinforcement attenuating method having material composed of woven plastic material, wherein the thickness of each strip is in the range of from about 0.01 to about 0.250 inches.

Preferably, the layer of filler or bonding material comprises synthetic plastic material selected from the group consisting of linear low density polyethylene, ionomers, polyvinyl chloride, ethyl vinyl acetate, ethyl propyl copolymers, polyethylene copolymers, low density polyethylene, their copolymers, vinyl copolymers and mixtures thereof linear low density polyethylene, ionomers, polyvinyl chloride, ethyl vinyl acetate, ethyl propyl copolymers, polyethylene copolymers, low density polyethylene, their copolymers, vinyl copolymers polyolefin, polypropylene, polystyrene, polyethylene, polyurethane, polyvinyl alcohol (water soluble), burlap, silk, carbon, Kevlar® or other natural or hybrid materials and mixtures thereof, and an impact reinforcement attenuating method having material composed of woven plastic material, wherein the thickness of each filler or bonding layer is in the range of from about 0.00005 to 0.250 inches, and an impact reinforcement attenuating method having material composed of a woven sleeve of woven plastic material.

In accordance with another preferred embodiment of the present invention, a generally dome shaped reinforcement structure such as safety helmet(s) is provided comprising a length a woven reinforcement dome shaped structure comprising a length of dome structure, said dome being open at least one end, wherein the safety helmet is designed for playing football, wherein the safety helmet is designed for motorcycle riding, wherein the safety helmet is designed for playing baseball, wherein the safety helmet is designed for playing lacrosse, wherein the safety helmet is designed for playing polo, wherein the safety helmet is designed for playing hockey, wherein the safety helmet is designed for ballistic helmets, wherein the safety helmet is designed for driving racecars, wherein the safety helmet is designed for piloting aircraft, wherein the safety helmet is designed for construction safety, wherein helmet comprising a coiled attenuating apparatus, wherein helmet comprising a mesh attenuating apparatus, wherein helmet comprising a woven attenuating apparatus, wherein the configuration of the recoil attenuation apparatus contains coils is encased in plastic or plastics, wherein the configuration of the recoil attenuation apparatus contains coils is encased in plastic or plastics for playing football, wherein the configuration of the recoil attenuation apparatus contains coils is encased in plastic or plastics for motorcycle riding, wherein the configuration of the recoil attenuation apparatus contains coils is encased in plastic or plastics for playing baseball, wherein the configuration of the recoil attenuation apparatus contains coils is encased in plastic or plastics for playing hockey, wherein the configuration of the recoil attenuation apparatus contains coils is encased in plastic or plastics for playing lacrosse, wherein the configuration of the recoil attenuation apparatus contains coils is encased in plastic or plastics for playing polo, wherein the configuration of the recoil attenuation apparatus contains coils is encased in plastic or plastics for construction safety, wherein the configuration of the recoil attenuation apparatus contains coils is encased in plastic or plastics for ballistic helmets, wherein the configuration of the recoil attenuation apparatus contains coils is encased in plastic or plastics for driving racecars, wherein the configuration of the recoil attenuation apparatus contains coils is encased in plastic or plastics for piloting aircraft, wherein the configuration of the recoil attenuation apparatus contains mesh is encased in plastic or plastics, wherein the configuration of the recoil attenuation apparatus contains mesh is encased in plastic or plastics for playing football, wherein the configuration of the recoil attenuation apparatus contains mesh is encased in plastic or plastics for motorcycle riding, wherein the configuration of the recoil attenuation apparatus contains mesh is encased in plastic or plastics for playing baseball, wherein the configuration of the recoil attenuation apparatus contains mesh is encased in plastic or plastics for playing hockey, wherein the configuration of the recoil attenuation apparatus contains mesh is encased in plastic or plastics for playing lacrosse, wherein the configuration of the recoil attenuation apparatus contains mesh is encased in plastic or plastics for playing polo, wherein the configuration of the recoil attenuation apparatus contains mesh is encased in plastic or plastics for construction safety, wherein the configuration of the recoil attenuation apparatus contains mesh is encased in plastic or plastics for ballistic helmets, wherein the configuration of the recoil attenuation apparatus contains mesh is encased in plastic or plastics for driving racecars, wherein the configuration of the recoil attenuation apparatus contains mesh is encased in plastic or plastics for piloting aircraft, wherein the configuration of the recoil attenuation apparatus contains woven materials is encased in plastic or plastics, wherein the configuration of the recoil attenuation apparatus contains woven materials is encased in plastic or plastics for playing football, wherein the configuration of the recoil attenuation apparatus contains woven materials is encased in plastic or plastics for motorcycle riding, wherein the configuration of the recoil attenuation apparatus contains woven materials is encased in plastic or plastics for playing baseball, wherein the configuration of the recoil attenuation apparatus contains woven materials is encased in plastic or plastics for playing hockey, wherein the configuration of the recoil attenuation apparatus contains woven materials is encased in plastic or plastics for playing lacrosse, wherein the configuration of the recoil attenuation apparatus contains woven materials is encased in plastic or plastics for playing polo, wherein the configuration of the recoil attenuation apparatus contains woven materials is encased in plastic or plastics for construction safety, wherein the configuration of the recoil attenuation apparatus contains woven materials is encased in plastic or plastics for ballistic helmets, wherein the configuration of the recoil attenuation apparatus contains woven materials is encased in plastic or plastics for driving racecars, wherein the configuration of the recoil attenuation apparatus contains woven materials is encased in plastic or plastics for piloting aircraft.

The current invention provides safety helmets, such as a football, motorcycle and motocross, construction, polo, hockey, riot and police, aircraft, lacrosse, baseball and other helmets and further includes ballistic military helmets. The helmet(s) includes a force attenuating reinforcement layer or layers inside the helmet shell in a variety of form(s), such as mesh(es) "netting," "weaves," and/or "hoops" or in any combination or layers as needed in the helmet shell(s) having an outer surface, a front region, a rear region, and two side regions. A jaw flap extends from each ear flap towards the front region of the shell. A crown, defined by a raised portion of the shell, extends between the front and rear regions of the shell. The crown has a front portion that is flush with the helmets inside outer surface at the front region of the shell, and an intermediate portion raised from the outer surface of the side regions of the shell. The crown also has a rear portion that is flush with the helmets inside outer surface at the rear region of the shell. The width of the crown generally increases from the front portion to the rear portion. The helmet shell includes at least one venting port or opening, which can be located generally in the crown or proximate thereto.

The current invention further encompasses a self-adjustable multilayer memory force attenuating foam helmet liner for a wide variety of protective helmets is disclosed. The adjustable helmet multi-layer force attenuating layers in a liner comprises at least two liner walls having a peripheral surface adapted to substantially conform to, and fit within, the protective helmet(s) for sufficient engagement and comfort with the head of a wearer of the protective helmets. The at least two multiple layer liner wall includes an outer surface and an inner surface. The outer surface is adapted to be disposed adjacent the interior surface of the helmet and the inner surface is adapted to be spaced from the interior surface of the helmet whereby the multi-layer memory force attenuating foam liner may be inserted into the protective helmet and self adjusts to the head of the wearer of the protective helmet. The multi-layered memory foam adjustable helmet liner further includes at least one expandable band disposed along a portion of the outer surface of the liner wall, whereby at least one expandable band provides for the adjustment of the liner to the head of the wearer of the protective helmet. A protective helmet having an adjustable helmet liner is also disclosed.

The current invention further comprises an improved reinforcement force attenuating impact recoil control device comprising a variety of inventive reinforcement(s) for use in a variety of safety helmet(s). In one embodiment, encompasses a wide variety of force attenuating reinforcement apparatuses as stated herein that are articulated so that the displacement of impacts results in a force component outside the impact axis of the impact of the helmet(s). The impact force attenuating control device(s) can be incorporated into a wide variety of helmet(s) of a variety of sizes and configurations to produce impact reduction and/or weight reduction and other advantages.

The reinforcement "rings" "coils" attenuates the impact(s) highly non-linear system(s) derives from their tunable dynamic response, encompassing linear, weakly nonlinear and strongly nonlinear impact(s) regimes, control the varying static and dynamic applied load(s). The inventive method and apparatuses systems attenuates the propagation of highly nonlinear solitary waves (HNSWs). The discreteness of the system makes the reinforcement(s) granular system highly tunable. Additionally, the propagation properties of these impact waves, such as the traveling pulse width, wave speed, further including number of separated pulses (singular or train of pulses), etc., may be controlled by reinforcement(s) modifying one or many of the parameters, such as the reinforcement(s) particle's dimension, material properties, static and dynamic force amplitude, the type and duration of the initial excitation (impact) applied to the reinforcement system(s), and/or the periodicity of the chain having the ability to control the wave properties in such chains as needed.

As an example, the particles in the reinforcement(s) "chains" as point masses connected by nonlinear Hertzian springs. It does not capture many features of the 3-dimensional elastic particles such as the elastic wave propagation within the reinforcement(s) particles, the local deformation of the reinforcement particles in the vicinity of the impact contact point, the corresponding changes in the contact area, and the collective vibrations of the reinforcement(s) particles among others. Which takes into account many of these characteristic features, such as considering them as 3-dimensional deformable bodies of revolutions and describes the nonlinear dynamic response of 1-dimensional granular chains composed of reinforcement(s) particles having various geometries and orientations as needed. The reinforcement particles' geometries and orientations provide additional design parameters for controlling the dynamic response of the reinforcement attenuating system(s).

Additionally, the tunable and compact nature of these waves can be used to tailor the properties of HNSW's for specific applications, such as information carriers for actuation and sensing of mechanical properties and boundary effects of adjoining media in Non-Destructive Evaluation (NDE) and Structural Health Monitoring (SHM). Furthermore encompasses, using experiments and numerics, to obtain the characterized interface dynamics between granular media and adjoining linear elastic media, the coupling may produce temporary localization of the incident waves at the boundaries between the two media and their decomposition into reflected waves, such as the formation of reflected solitary waves propagating back from the interface, which are sensitive to the geometric configuration and material properties of the adjoining media, the basic physics and tenability of nonlinear granular media, and may further establish a theoretical and numerical foundation in the applications of HNSWs as information carriers.

Other features and advantages of the invention will be apparent from the following specification taken in conjunction with the following drawings.

BRIEF DESCRIPTION OF THE DRAWINGS

FIG. 12 is a bottom view of the monolithic football helmet of the present invention of FIGS. 1A.

FIG. 13 is a partial perspective view of the crown of the football helmet of FIG. 1A and FIG. 12, showing a three-layered memory foam (having three different compression characteristics) crown pad in accordance with the present invention.

FIGS. 42A-42C illustrate a wide variety of annular/spring "coils" "rings" having reinforcement configurations can be adapted for this purpose.

FIG. 43A illustrates a section of a apparatus coming out of an unmodified circular loom wherein the woven warp and weft strands are partially shown to illustrate their orientation; FIG. 43B is a perspective illustration of a small section of the detailed woven structure including the corresponding section of bands made with the present invention; FIG. 43C illustrates a prior art mesh made from a section of a woven generally dome, oval or flat structure coming out of an unmodified circular loom, after the top opening of the sectioned structure is sewn closed; and forming a safety helmet having reinforcement apparatus; FIG. 43D illustrates a reinforcement mesh made from a section of a woven generally oval, ovoid, curvilinear structure coming out of a circular loom modified with the present invention, after the top opening of the sectioned generally oval, ovoid, curvilinear structure is sewn and/or linked closed.

DETAILED DESCRIPTION OF THE PREFERRED EMBODIMENTS

Figure 1A:
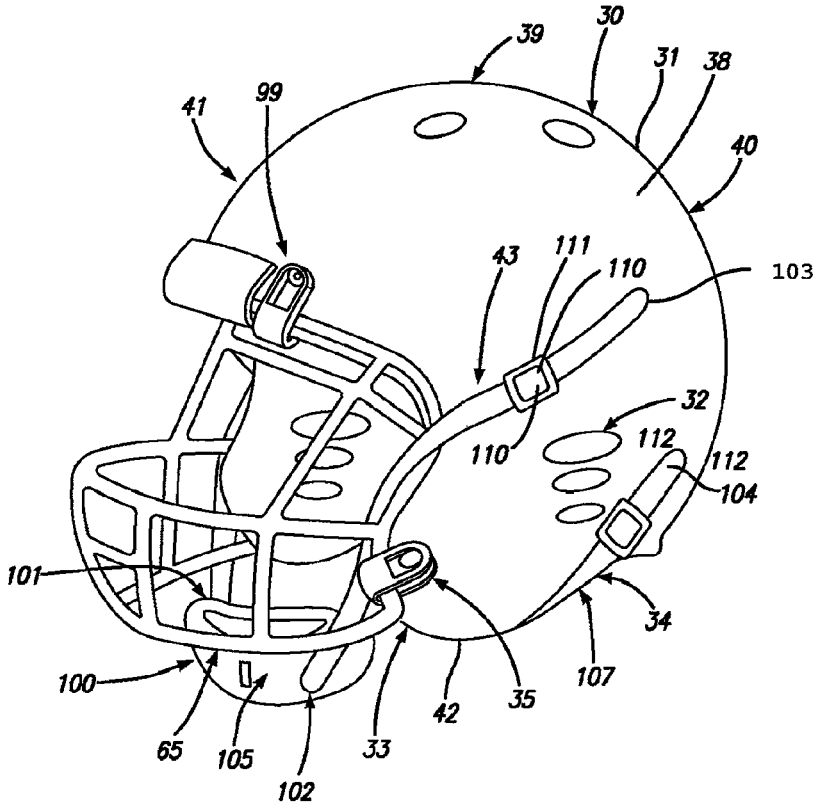
FIG. 1A is a perspective view of an embodiment of a football helmet showing a face guard of the present invention.
Figure 1B:
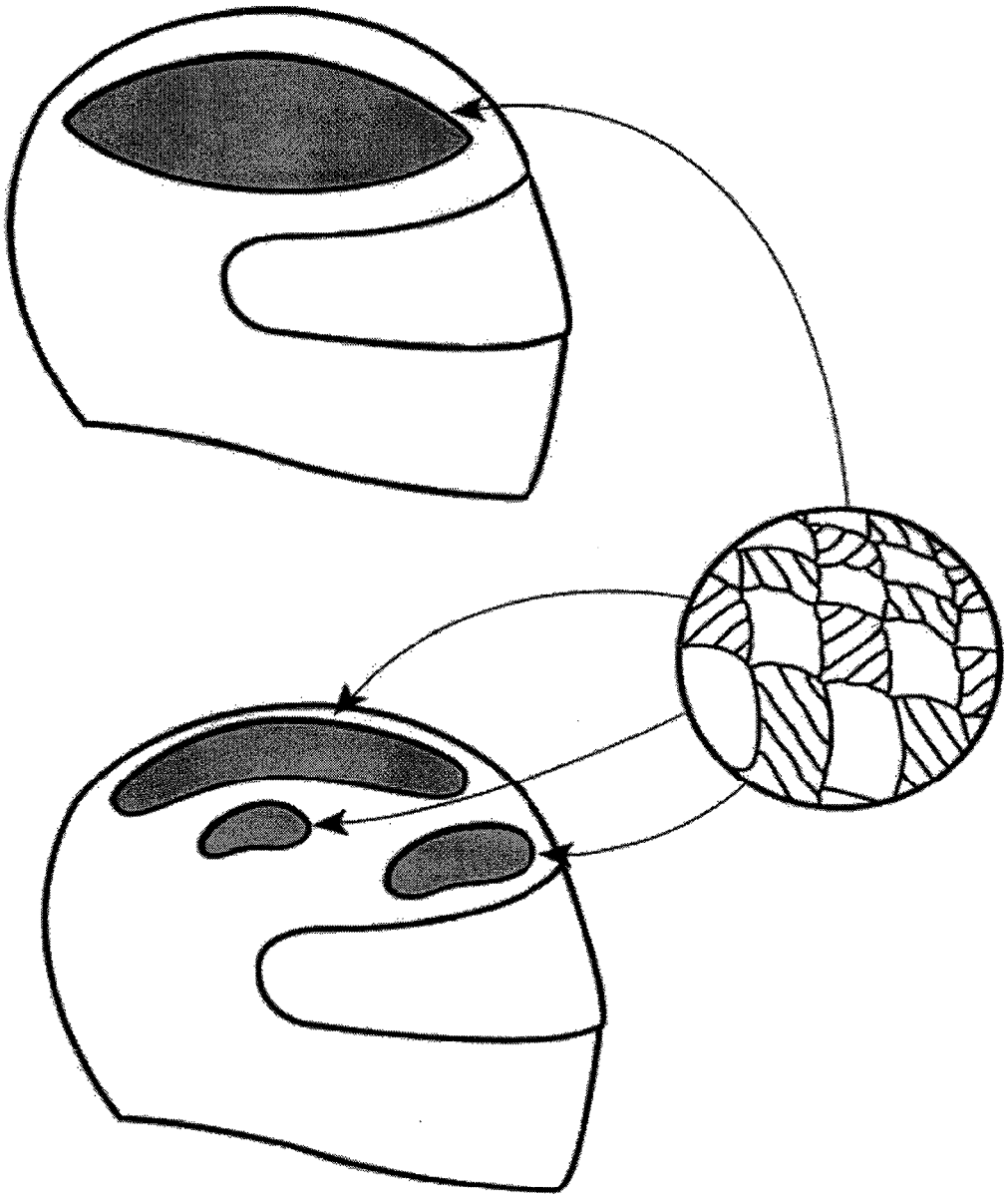
FIG. 1B PRIOR ART
FIG. 1B is a perspective of an embodiment of prior art motorcycle helmets illustrating that the prior art is not aware or does not consider the use of attenuating recoil return "annular" "rings" "coil" reinforcement(s) nor other attenuating mesh/net reinforcement attenuating inventive apparatuses.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments. Where references are made to numerals on a particular figure, it should be understood that like numerals generally refer to the same or similar features as among all the figures.

Reference in this specification to "one embodiment" or "an embodiment" means that a particular feature, structure, or characteristic described in connection with the embodiment is included in at least one embodiment of the-disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. However, the use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "upper," "lower," "side," "short," "long," "up," "down," and "below" used herein are merely for ease of description and refer to the orientation of the components as shown in the figures. It should be understood that any orientation of the components described herein is within the scope of the present invention.

For the purpose of this specifications it will be clearly understood that the word(s) "alternate," "alternatively," "alternately," "optional," or "optionally" mean that the subsequent described event of circumstances may or may not occur, and that the description includes instances where said event or circumstances occurs and instances in which it does not.

In FIGS. 1A, 2A, 3, 14, 19 and 20, a reinforced football helmet 30 in accordance with the present invention is shown to generally include: an outer shell 31, ear flap 32, each ear flap 32 including a jaw flap 33, a chin protector connector 34, a face guard 35, and face guard connectors.

Outer shell 31 is preferably made with any suitable reinforcement or combination of reinforcements components and apparatuses as stated herein such as plastic material(s) having the requisite strength and durability characteristics to function as a football helmet(s), or other type of protective helmet(s), such as polycarbonate plastic materials, one of which is known as LEXAN®, and optionally may include fiber-reinforced polymer plastic, fiberglass and resin/Kevlar® composite, fiberglass, polycarbonate alloy, fiberglass and or other thermoplastic resin sets as is known in the art.

Figure 7:
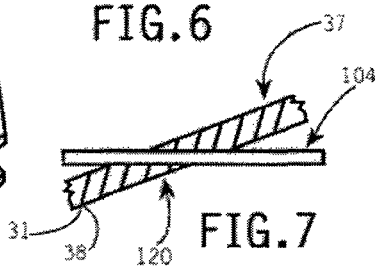
FIG. 7 is a partial cross-sectional view of the football helmet of FIGS. 1A and 2.
Figure 19:
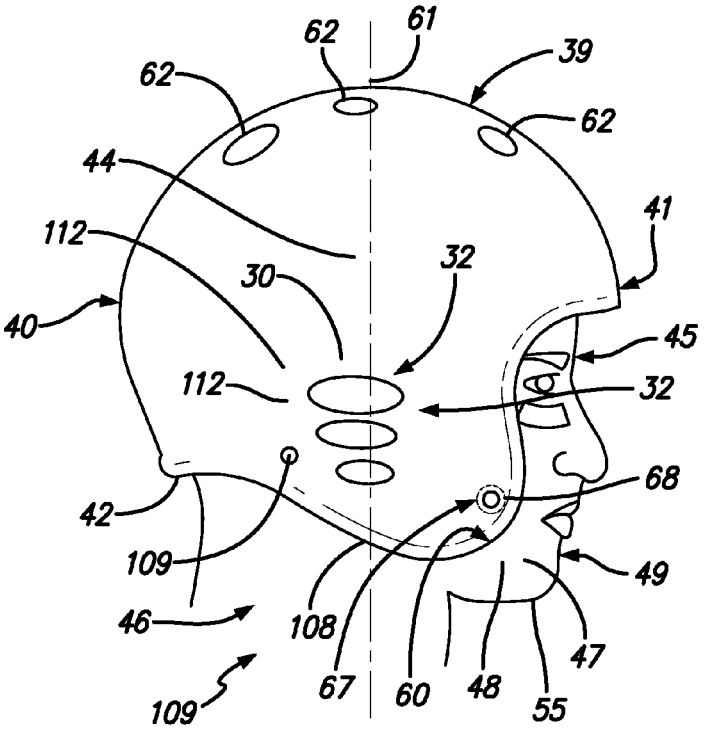
FIG. 19 is a side view of the helmet of the present invention, illustrating the chin protector connecters of the football helmet of FIG. 1A, including a wearer of the helmet being partially shown, including a general outline of a multi-layered ear flap being also shown in phantom lines.
Figure 20:
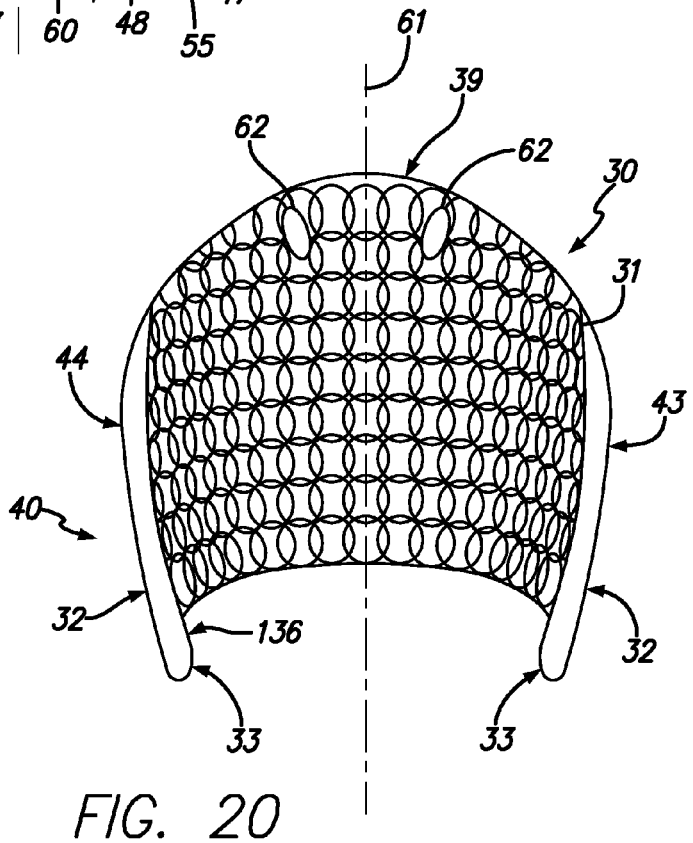
FIG. 20 is a back view of the football helmet of the present invention of with attenuating recoil return "annular" "rings" "coil" reinforcement(s) of FIG. 1A.

Outer shell 31 has an inner wall surface 37 (FIG. 1A, 2, 7, 12, 13, 14, and 20) and an outer wall surface 38 (FIG. 7). Shell 31 further includes a crown 39, a back 40 (FIG. 20), a front 41 (FIG. 19), a lower edge surface 42, and two sides 43 (FIGS. 1A, 2A, 14, and 20) and 44 (FIGS. 19 and 20). As is known in the art, and as herein is described in greater detail, reinforced shell 31 the reinforced shell is adapted to receive the head 45 of a wearer 46 (FIG. 19) of the helmet 30, the wearer 46 having a lower jaw 47 (FIG. 19) having two side portions 48 (FIG. 19), only the right side portion 48 of jaw 47 being illustrated. Outer shell 31 includes an outer surface and an inner surface, and both outer and inner surfaces generally form a curved plane.

As shown in FIG. 19, the lower jaw 47 terminates generally adjacent to the chin 49 of the wearer's head 45 toward the front of the head 45, and the lower jaw, (mandible) 47, generally ends its connection with the upper jaw generally adjacent, and forwardly of ears 50 of wearer 46.

Figure 2A:
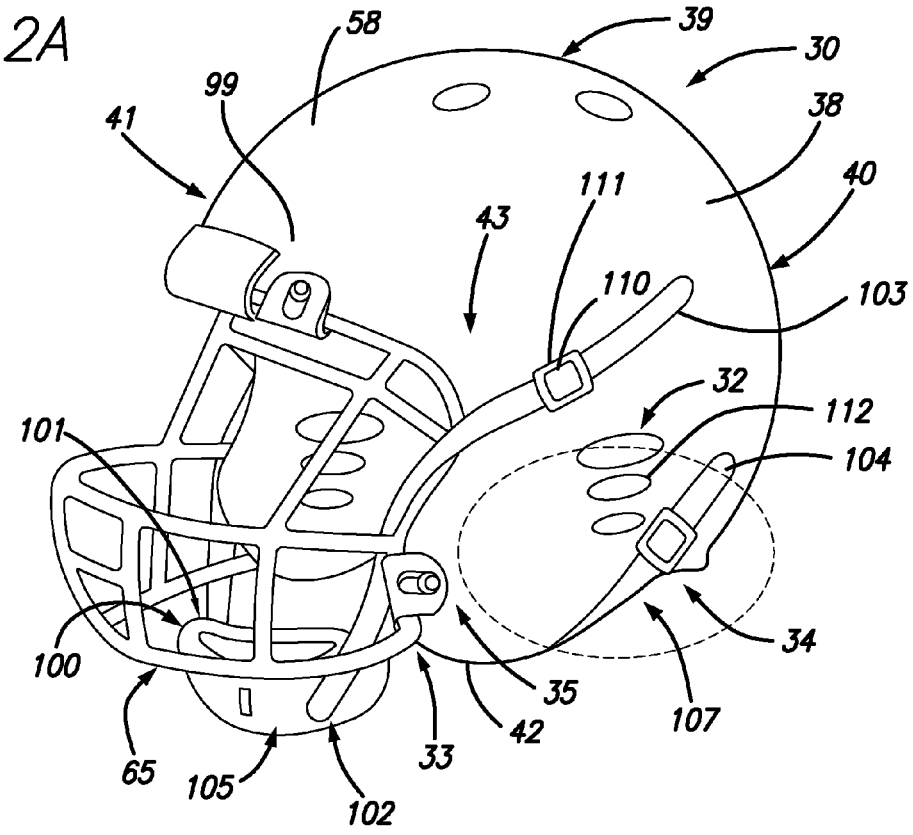
FIG. 2A is perspective view of another embodiment of a football helmet showing a face guard of the present invention.

Still with reference to FIGS. 1A, 2A, 14 and 19, each side 43, 44 of the reinforced shell 31 includes an ear flap 32, the left ear flap 32 being shown in FIGS. 1A and 2A and the right ear flap 32 being illustrated in FIG. 19, and ear flaps 32 are adapted to generally overlie an ear 50 (FIG. 19) and portion of a cheek 52 of the wearer 46.

Each ear flap 32 generally extends downwardly from its respective side 43, 44, and in general extends in a direction extending from crown 39 downwardly toward the lower edge surface 42 of reinforced shell 31. Each ear flap 32 includes a jaw flap 33, the left hand jaw flaps 33 being illustrated in FIGS. 1A, 2A, 12, and 14, and the right jaw flap 33 being illustrated in FIG. 19. Each jaw flap 33 extends from it corresponding ear flap 32 forwardly toward the front 41 of the reinforced shell 31, and as seen in FIGS. 1A and 2A as adapted to generally extend to overlie a side portion 48 of the lower jaw 47 of the wearer 46 of the reinforced helmet.

As shown in FIGS. 1A, 2A, and 20, jaw flap 33 is shown to extend forwardly to overlie a forwardly disposed portion 55 of lower jaw 47 disposed toward the chin 49 of wearer 46 (shown in FIG. 19 of the wearer).

In this regard, it should be noted that the reinforced impact attenuating helmets 30 of the present invention are generally made with outer shell(s) 31 of varying thickness shapes and sizes, dependent upon the application and size and shape of the head of the particular wearer of the helmet.

In FIG. 19, helmet 30 is shown superimposed upon what is theorized to be an average size head of a wearer of the helmet 30, whereby jaw flap 33 (FIGS. 1A and 2A) is shown to generally overlie the entire side portion 48 of lower jaw 47, including the forwardly disposed portion 55 of lower jaw 47 adjacent the chin 49 of wearer 46, including overlying the side of the chin 49 of wearer 46.

Since FIG. 19 is not a representation of all sizes and shape of heads and all types of chin structures, such as chins, which may greatly extend outwardly away from the head of the wearer, it should be understood that it is perhaps possible that someone wearing a reinforced helmet 30 in accordance with the present invention may have a slight side portion of his or her chin extending outwardly beyond the outer periphery of jaw flap 33. It is believed that jaw flap 33 will overlie at least the forwardly disposed portion 55 of the lower jaw 47 of virtually all wearers of helmets 30. In this regard, the outer periphery 60, shown in phantom lines in FIG. 19, of a multi-layered memory foam ear flap, without the jaw flap 33 of the present invention generally does not overlie a forwardly disposed portion 55 of the lower jaw (mandible) 47 of a wearer of a conventional football helmet. Furthermore, the ear flap of a prior art conventional football helmet virtually never overlies the chin 49 of a wearer of a conventional helmet.

With reference to FIGS. 12, 19, and 20, the outer helmet shell 31 has a vertical, longitudinal axis 61 generally extending downwardly from crown 39, and each ear flap 32 generally lies in a plane which is substantially parallel to the longitudinal axis 61 of shell 31. The inner surface of the helmet shell 31 generally forms a curved plane. Each jaw flap 33 also generally lies in a plane, which is substantially parallel to the longitudinal axis 61 of the outer shell 31. The crown 39 of shell 31 may be provided with at least one, and preferably a plurality of ventilation ports, openings, or air vents, 62, which permits the regulation of the passage of the air. Through shell 31, as an option or optionally may employ slidably adjustable ports for adjusting or regulating air flow and humidity regulation etc. as needed 31. Vents 62 permit air adjacent the head 45 of wearer 46, which has been heated by being in contact with scalp 45, to be vented and passed outwardly through openings 62, which may contribute to greater heat dissipation thus improving comfort being afforded the wearer 46 of helmet 30. As shown in FIGS. 1A, 2A and 12, the lower edge 42 of the shell 31 defines a circumference, and the shell 31 is configured such that the terminal ends of the jaw flaps 33 reside in the same or single quadrant of an X-Y coordinate system.

Figure 3:
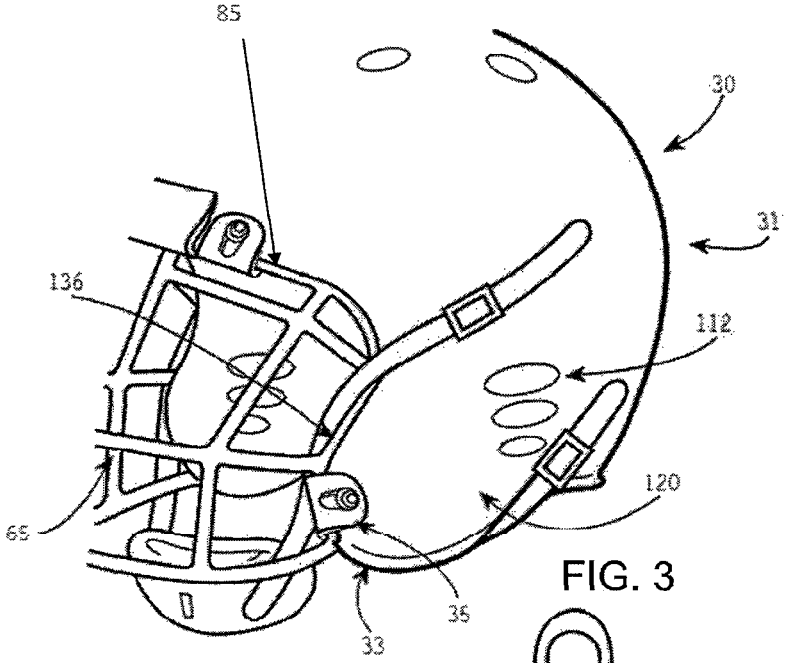
FIG. 3 is a perspective view showing an embodiment of the monolithic face guard using the receiving channel and helmet of the present invention.
Figure 8:
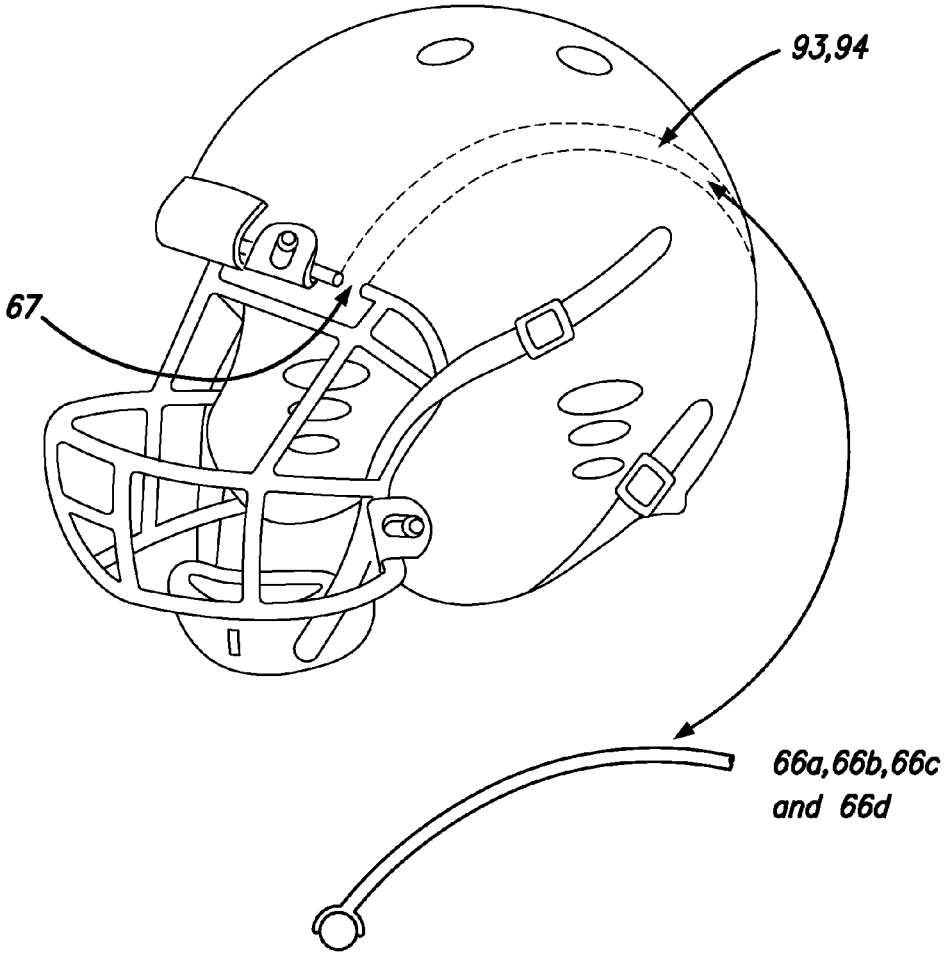
FIG. 8 is a partial exploded view of the monolithic football helmet with face guard of the present invention.
Figure 9:
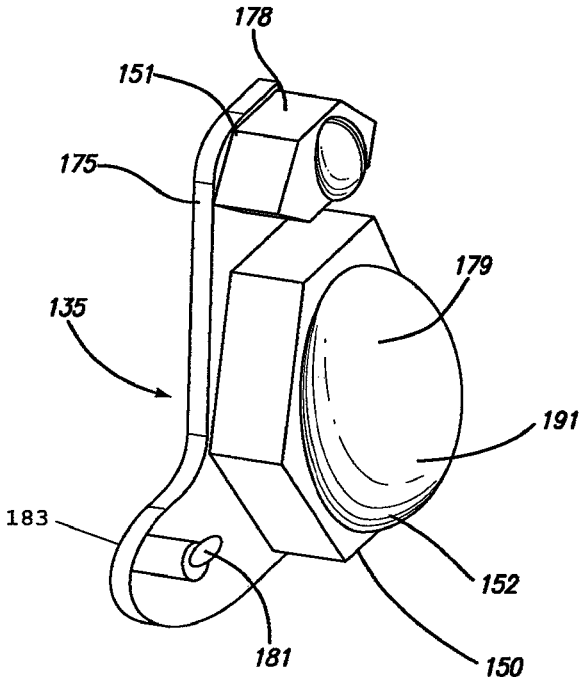
FIG. 9 is a cross-sectional view of the multi-layer memory foam pad member of the current invention.
Figure 10:
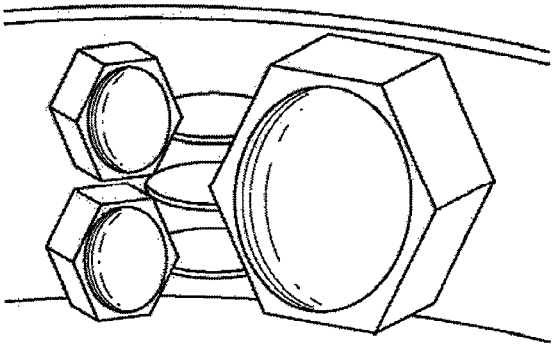
FIG. 10 is a partial cross-sectional view of the multi-layer memory foam pad member of the present invention of FIG. 12.

With reference to FIGS. 1A, 2A, and 3, the face guard connector 35 of the present invention will be described in greater detail. Face guard 65 FIGS. 1A, 2A, and 3 is preferably shaped and figured and formed having a variety of reinforcement(s) as stated herein or of a monolithic bars or rod members 66 (FIGS. 4 and 8), which may be manufactured and formed of any suitable material having the requisite strength and durability characteristics to function as face guards, as is known in the art.

Figure 2B:
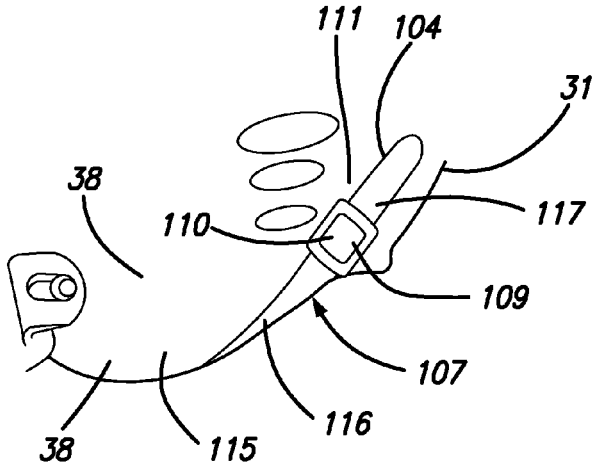
FIG. 2B is a perspective view of the portion of the helmet, jaw flap, chin strap and ear ports of FIG. 2A taken along the lines 38-38.
Figure 2C:
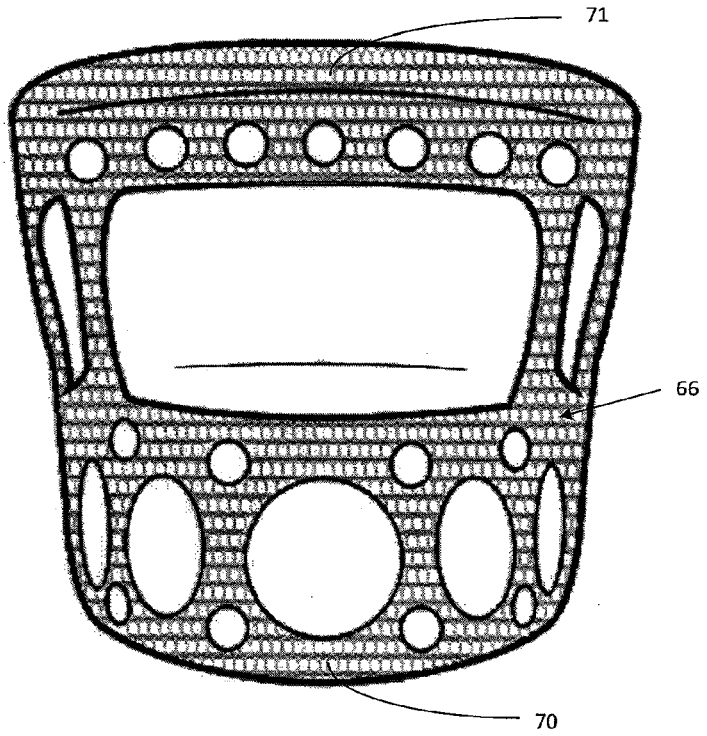
FIG. 2C is a partial perspective view of the helmet face guard of the present invention with attenuating recoil return "annular" "rings" "coil" reinforcement(s).

FIG. 2C illustrates one of many possible configurations of the face guard member 66 may be formed of a reinforcing metallic material, such as any suitable metals or plastics, as is known in the art, the reinforcement members 66 optionally may be provided with reinforcement "mesh" "coils" "rings" or "loops" a suitable plastic coating.

Additionally, the face guard members 66 may be of a solid or tubular cross-sectional configuration. Alternatively or optionally, face guard members 66 may be formed of any suitable plastic material preferably in a generally arched flat plane, preferably manufactured and maintaining a molecular orientation this material also having the requisite strength and durability characteristics to perform the functions of a football helmet face guard(s) including other safety helmets and face guards as needed.

The face guard connectors 35 are adapted to connect a portion of the faceguard in to the helmet(s) receiving grove or channel in the helmet(s) shell edge 31. A face guard connector 35 is disposed on each side 43, 44 of shell 31. One embodiment of face guard connector 35 is shown in FIGS. 2, 2A, and 3, while another embodiment of face guard connector is illustrated in FIG. 17.

In general, the two embodiments of face guard connector 35 are substantially similar, whereby the same components will be described with identical reference numerals, and primed reference numerals will be used in connection with components having the same, or similar functions, but different structures or configurations as needed.

Figure 5A:
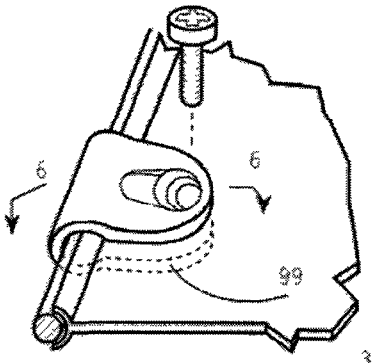
FIG. 5A is a perspective view of a removable monolithic face guard and helmet of FIGS. 1A, and 2A-2B.
Figure 5B:
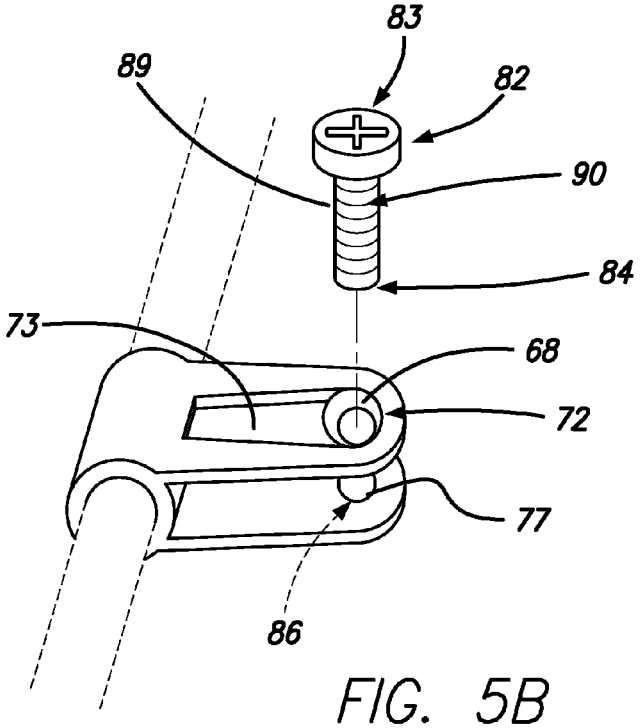
FIG. 5B is a perspective view of a monolithic face guard and helmet of FIGS. 1A, and 2A-2B, taken along lines 77-77.
Figure 17:
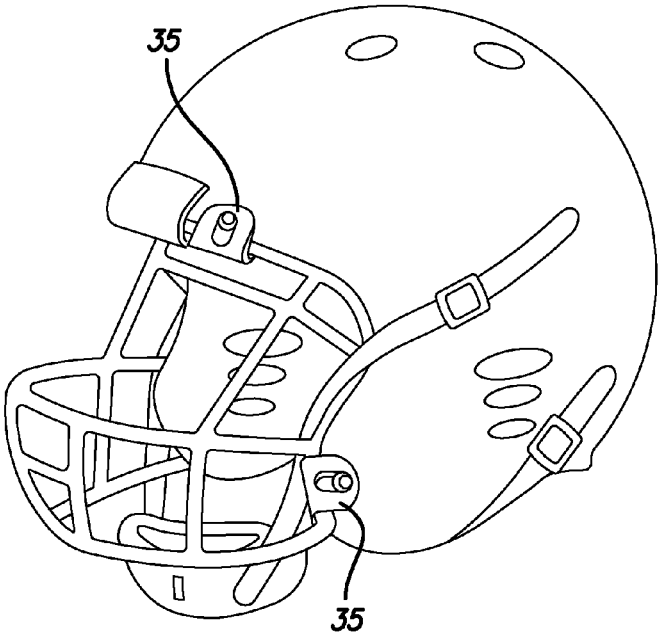
FIG. 17 is a partial perspective view of the face guard and the helmet of FIG. 1A.
Figure 18:
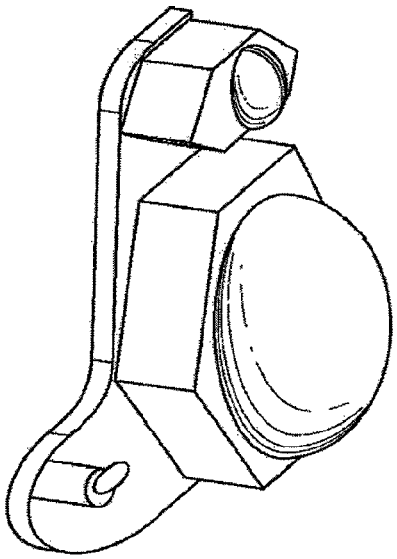
FIG. 18 is also a partial cross-sectional view of the multi-layered memory foam pad member of FIG. 15.

The details of the face guard connector 35 used in connection with the helmet 30 of FIGS. 2A, 3 and 17, are illustrated in FIGS. 3 and 5A and 5B, and the details of construction of the face guard connector 35 of FIG. 2A, 3 and 17 are illustrated in FIGS. 5A and 5B. With reference to FIGS. 2A, 3, and 17, face guard connector 35 of the present invention is shown to be adapted to substantially attenuate such as directionally transfer and distribute a wide range of impact forces, exerted upon the face guard 65 transferring, through the reinforced helmet shell 31. Preferably, face guard securement member 67 (FIG. 19) is a removable and replaceable grommet 68 (FIGS. 5 and 19) disposed in an opening 69 formed in a side 43, 44 (FIG. 20) of shell 31. Grommet 68 may be formed of any suitable elastomeric material(s) which will function so as to substantially permit and attenuate and directionally control the distribution of an impact force or forces, exerted upon the face guard 65, throughout reinforced shell 31 of helmet 30. Preferably, grommet 68 is formed of synthetic rubber. In this regard, face guard 65 can incur and transfer to and attenuate a wider range of impact forces encountered in a variety of directions during a game such as football.

For example, as a player strikes the ground upon being tackled, his or her face guard might strike the ground at the lower most center 70 (FIG. 2C) of face guard 65, which would be an upwardly exerted force upon face guard 65. Similarly, another player's knee or helmet, or hand, might push downwardly upon the bar member 71 (FIG. 2C) of face guard 65, thus exerting a downwardly extending impact force upon face guard 65. Additionally, a player's face guard might be impacted in the direction from one of the sides 43, 44 of helmet 30, which would be a side or lateral impact force being exerted upon face guard 65. Of course, it would be readily apparent to one of ordinary skill in the art that an impact force could be exerted upon face guard 65 from any direction in which it is possible to strike, or impact against, face guard 65. As will be hereinafter described in greater detail, as an impact force is exerted upon face guard 65, 67, or grommet 68, functions to transfer and absorb, or attenuate, the impact force exerted upon the face guard, and to substantially control and directionally distribute and dissipates impact forces throughout the reinforced shell as described herein 31.

Grommet 68 may be a circular shaped member 72 as shown in FIG. 5, a bushing 77 may be disposed within the opening 73, which passes through grommet 68. Preferably, the bushing is made of a suitable plastic material having the requisite strength and durability and transfer characteristics to function as part of a safety helmet face guard attenuating apparatus connector. Preferably, bushing 77 is formed of a suitable thermoplastic material, such as SURLYN® Bushing 77 may include a cap member having an upper wall surface and a lower wall surface, with the lower wall surface being disposed adjacent the inner wall surface 37 of the shell 31 (FIGS. 7 and 12). A bolt 82 (FIG. 5) having first and second ends 83, 84 may be passed through each bushing and the face guard connector body members, or clips, 85 (FIG. 5A) of each face guard connector 35. A nut 86 receives the second end 84 of the bolt 82.

By bolt 82 being rotatable threaded and rotated with respect to nut 86, face guard(s) 65 may be secured to each side 43 (FIG. 2A), 44 (FIG. 20) of shell 31. It should be noted that although bolt 82 is inserted from the outside of shell 31, its disposition may be reversed, although it is preferred to be inserted from outside the shell, for ease of removal as an option should a player be injured and it becomes necessary to remove face guard 65. The upper wall surface of each cap member may include a recess, which receives a corresponding nut 86. The recess of the cap member preferably mattingly receives the corresponding nut 86 and the recess restricts rotational movement of the nut with respect to the shell 31. Preferably, the nut 86 is a I-nut, which includes an upper member 89 and a threaded cylindrical member 90, which is received and disposed within bushing 77.

Figure 4:
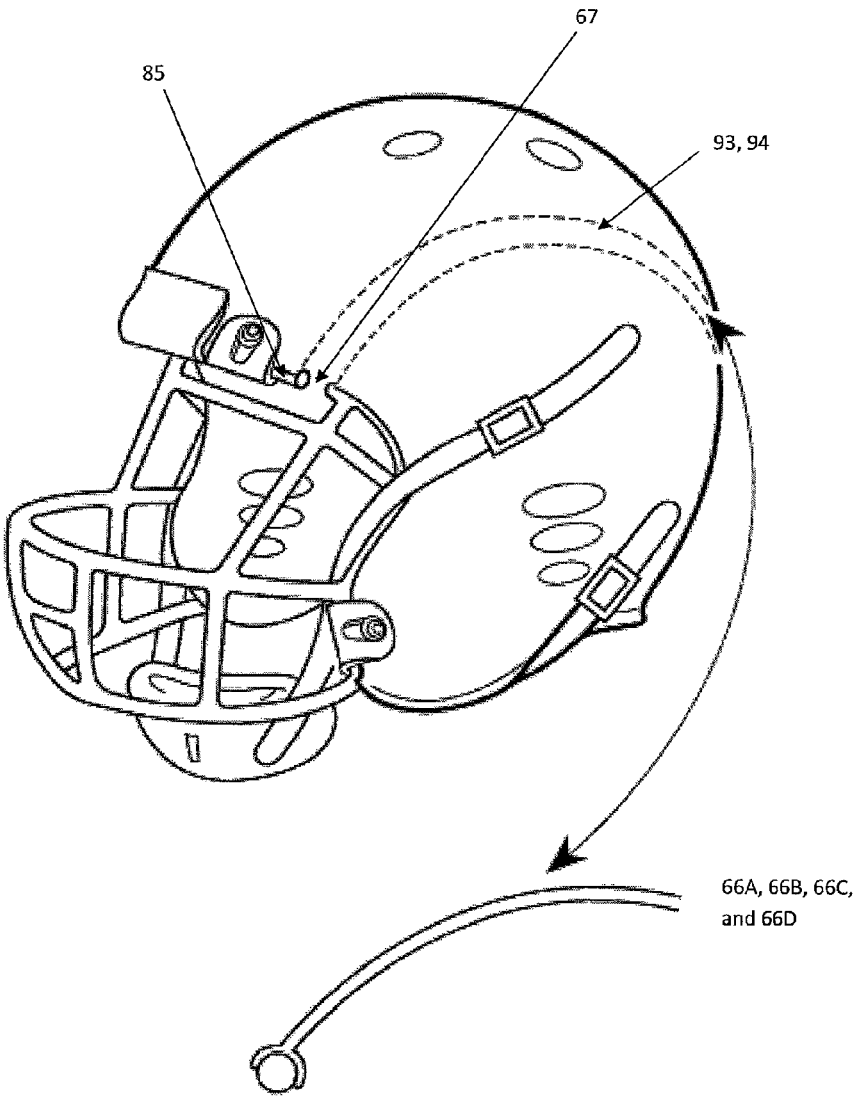
FIG. 4 is a perspective view of the face guard and the helmet of the present invention.

Each of the face guard connectors 35 (FIG. 17) of the present invention includes a face guard helmet body connector member 85 (FIG. 3 and FIG. 4). Face guard connector 35 has an inner surface, or inner wall surface, and outer surface, or outer wall surface. Referring now to FIG. 4, the face guard connector body member 85 connects to one or more bar member, or flexible connecting rod, 66A, 66B, 66C, and 66D. The one or more bar members, or flexible connecting rod, 66A, 66B, 66C, and 66D works in conjunction with at least one channel or receiving channel 93, 94 that is disposed in a substantially parallel relationship in or through the helmet, helmet shell, or helmet reinforcement layer, as shown in FIG. 4. Multiple, channels also may be used, also disposed in a substantially parallel relationship. Receiving channel 93, 94 may be curved and may generally be parallel to the curved plane of the inner surface of the shell or outer shell 31. Face guard receiving channel or groove 93, 94 each receive all or a portion of the one or more bar members, or flexible connecting rod, 66A, 66B, 66C, and 66D, including but not limited to one-half of its length. Preferably, face guard 65 on both of its sides includes further bar members having a opening 67. Face guard receiving channel or groove 93, 94 may be curved, and the curve generally may be parallel to the curved plane of the inner surface of the helmet or helmet shell. The one or more bar members, or flexible connecting rod, 66A, 66B, 66C, and 66D, flex or bend as they are pushed through the curved receiving channel, which in turn operates to hold the face guard in place on the helmet. In an alternate preferred embodiment, at least one of the channels 93, 94, is formed in the inner surface of the face guard connector body member 85 and the bar member 66*b*, 66*d* is received within the at least one receiving grove or channel, whereby the bar member 66*b*, 66*d*, is disposed between the inner surface of the face guard connector body member 85, and the outer wall edge 38 of shell 31. Face guard connector body member 85, as well as face guard connector body member, to be hereinafter described, may be made of any suitable material having the requisite strength and durability characteristic to sufficiently transfer and attenuate and function as an apparatus part of a face guard connector, and to effectively attenuate and transfer impact stress.

Generally composed of, such as a thermoplastic material(s) being preferred. An opening may be formed in the face guard connector body member 85 to provide flexibility to body member 85 so that it can more readily conform (fit) to the receiving groove or channel outer contour edge of the helmet shell 31 as in FIGS. 4 and 8.

With reference to body member 85 of FIG. 3 and FIG. 4, an alternate preferred embodiment of body member 85 may optionally include an access passageway formed in the receiving groove or channel outer surface of face guard body member. An access passageway is aligned with an inflation port disposed in a shell, and is adapted to provide access to inflation port and permit the memory foam shock absorbing and attenuating liner, to be described herein, to be inflated. The access passageway may be a circular shaped notch formed at one end of face guard body member.

Figure 6:
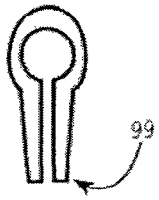
FIG. 6 is a cross-sectional view of the face guard of FIG. 5, taken along line 6-6 of FIG. 5A.

Helmet 30 as seen in FIGS. 2, 2A, and 3 may be provided with the inventive face guard connectors 99, of which is illustrated in FIG. 5A, which are used to secure the side and upper portion of face guard 65 into the receiving edge 41 (FIGS. 1A and 2A) of helmet shell 31. The details of construction of face guard clips 99 are shown in FIGS. 5A and 6. Upon the removal of bolts 82 from face guard connectors 35 and the removal of face guard connector body members 85, face guard 65 may be completely removed 99, in the event that it is necessary to gain access to the face of a player, or to better assist in removing the helmet 30 of a player. In this regard, no tools, other than a screw driver are necessary to remove bolts 82 and face guard connector body members 85. The frictional engagement forces between bushing 77 and nut 86 restrain nut 86 from rotation while bolt 82 is being unthreaded there from.

Although the face guard connector 35 of the present invention has been described in particular with respect to its use with a football helmet 30, it should be noted that face guard connector 35 could, and in particular and, its receiving grove or channel member 93, 94 could be utilized in connection with a wide variety of face guard configurations and a wide variety of protective helmets. For example, other types of helmets, with which a face guard of some type is used, include for example, lacrosse helmets, hockey helmets, among others.

With reference to FIGS. 1A, 2 and 2A, each helmet optionally may include a chin protector connector 34 for connecting a portion of a chin protector 100 to shell 31. Chin protector 100 may be of a variety of conventional design and has two sides 101, 102 and at least two flexible members 103, 104 associated with each side 101, 102 of the chin protector. Only flexible members 103, 104, associated with side 102 of chin protector 100 are illustrated. The at least two flexible members, or strap members, 103, 104 are adapted to engage with one of the chin protector connectors 34 on the sides 43, 44 of shell 31. Chin protector 100 may include a variety of conventional chin cups 105 as is known in the art. Conventional chin protector connectors 34, in accordance with the present invention, are shown in FIGS. 1A, 2A, 2B, and 3.

With respect to FIGS. 1A, 2A and 19, chin protector connector 34, 107, 108 (FIG. 19) formed in the lower edge surface 42 of shell 31, 43, 44 of the shell 31. As shown in FIGS. 1A and 2A, at least one of the flexible members 103, 104 on each side of the chin protector 100 passes over at least one 107 of the elongated receiving arches 107, 108 on each side 43, 44 of the shell 31.

As is known in the art, chin protector 100 has upper and lower flexible members 103, 104, on each side, and the upper flexible members, or flexible strap members 103 are releasably secured to the helmet shell 31 as by a conventional snap connector, the male portion of the snap 109 (FIGS. 2A, 2B, and 19), cooperating with a female snap connector 110 carried by a bracket 111 mounted on upper strap 103.

Helmets 30 as an option may be provided with three ear ports or openings 112 in each ear flap 32, and the ear openings 112 are adapted to be disposed adjacent an ear 50 (FIG. 21E) of the wearer 46 (FIG. 19) to permit the transmission of a wide range of sounds to the wearer (over the prior art ear ports) 46. Ear openings 112 may be provided with a generally elongated rectangular or ellipses configuration, with ear openings 112 generally having elongated rectangular shaped configurations with an additional smaller opening are preferred being at the main ear openings 112. Preferably the ear openings or port(s) 107, 108 are disposed in the lower edge surface 42 of the shell 31, and as seen in FIG. 19, and the ear opening or ports 107, 108 are preferably disposed substantially, directly parallel to the ear ports or openings 112. As seen in FIG. 2B, a first portion 115 of each lower flexible member 104 is disposed adjacent the inner wall surface 37 of shell 31, a second portion 116 of strap member 104 passes over elongated arch 107, and a third portion 117 of the flexible member, or lower strap member 104 is disposed adjacent the outer wall surface 38 of shell 31. The third portion 117 of each lower strap member 104 is preferably releasably secured to a portion of the chin protector connectors 34 disposed on the outer wall surface 38 of helmet shell 31.

As an option the strap 104 is releasably secured by a male and female snap connector 109, 110, and bracket 111, as previously described. The foregoing described chin protector 100 is generally referred to as a 4 point hookup, or a "high hookup" chin protector, or chin strap, which is theorized to provide better stability of the reinforced attenuating helmet system 30 with respect to the wearer's head, particularly upon the player sustaining an impact force to helmet 30.

Because as previously described, the ear flaps 32 of the current invention are generally disposed to lie in a plane which is substantially parallel to the longitudinal axis 61 of the outer shell 31, the elongated receiving arches 107, 108 of chin protector connector 34 serve to provide a wider range of chin and jaw fittings having improved fit and stability of the lower chin straps, or flexible members 104, by preventing the lower strap 104 from being free to slide around the outer wall surface of ear flaps 32. In general, if a helmet 30 is subjected to a generally downward impact force upon face guard 65, helmet 30 tends to roll forwardly around a virtual pivot point located slightly above the ear port openings 112.

This impact rolling effect is typically resisted by a force acting between the lower strap connectors 109, 110 and the chin 49 of the wearer of the helmet. The further away from the virtual impact pivot point the lower snap connection of lower chin strap 104 is located theoretically, the better the resistance of the helmet 30 to impact recoil rolling. Forces the chin strap 107 assists in resisting and attenuating the undesired impact rolling effect by redirecting the strap's force line of action to a location farther away from the virtual impact pivot point(s).

As an option, the strap may be positioned and secured on the internal side wall of the safety helmet.

With reference to FIGS. 1A, 2A, and 7, another embodiment of the chin protector connector 34 will be described herein. In this embodiment, chin protector connector 34, and at least one of the flexible members 103 upon releasing the lower snap connections associated with lower strap members 104, the chin protector 104 may be loosened or adjusted with respect to the chin of the wearer of the helmet, whereby the wearer of the helmet may remove helmet 30 from the wearers head. It is not necessary to disengage, or unsnap, the upper flexible strap members 103, in order to remove helmet 30.

Helmets 30 as an option depending upon application of the present invention may include a multi-layer memory foam shock attenuating liner 125 (FIGS. 16A and 16B) associated by the liner connector with the inner wall surface 37 of shell 31. Preferably, the shock absorbing liner 125 is releasably connected to the inner wall surface 37 of shell 31 by the liner connector. Preferably the liner connector includes a hook and loop fastener assembly system or apparatus, which is generally referred to as a VELCRO® attachment, as by placing portions of the hook and loop assembly on the shock attenuating liner 125 and the inner wall surface 37 of the shell 31, as is known in the art.

Figure 14:
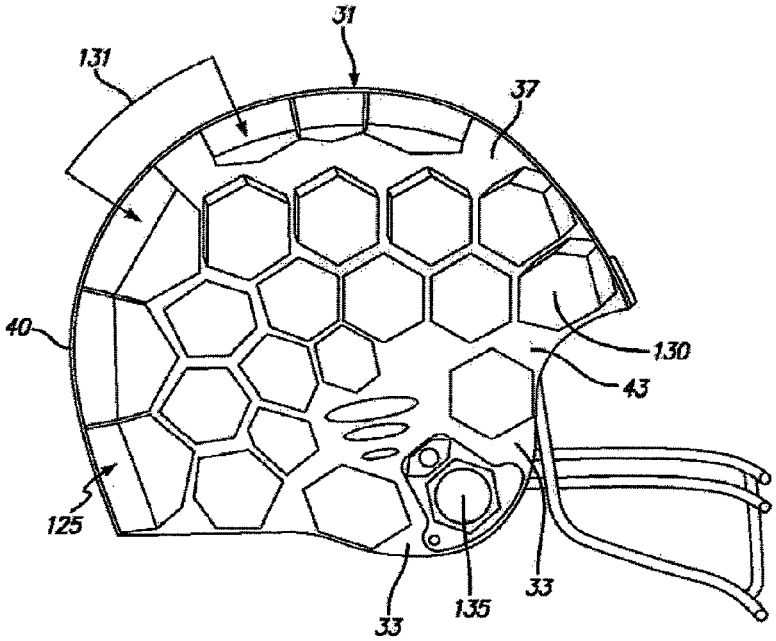
FIG. 14 is a partial perspective view of a multi-layered memory foam shock absorbing liner in accordance with the present invention, corresponding to the memory foam shock absorbing liner shown in FIGS. 12, 13, 15, and 16A and 16B.
Figure 16A:
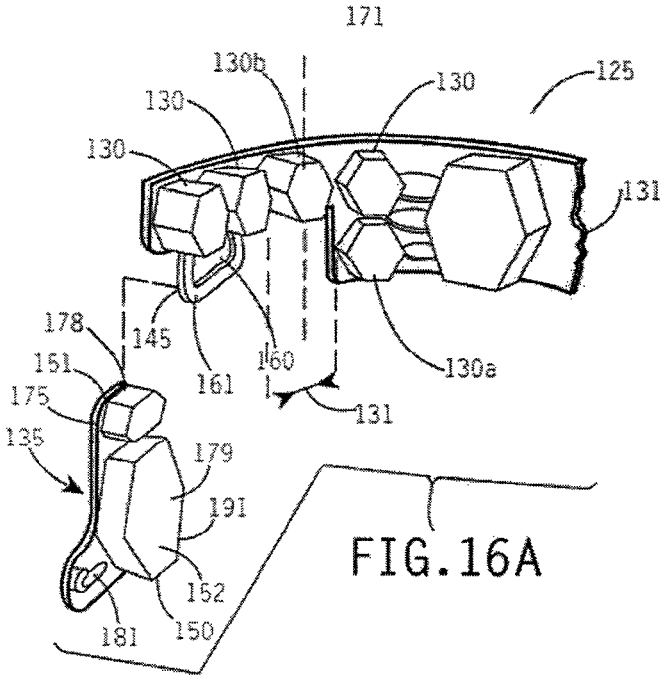
FIG. 16A is a partial perspective view of a multi-layered memory foam shock absorbing and attenuating liner provided with another embodiment of the multi-layer memory foam pad member, of the present invention, as is shown in FIG. 14, and is a perspective view of one specific embodiment of the self-adjustable multi-layered memory foam force attenuating helmet liner of the present invention.
Figure 16B:
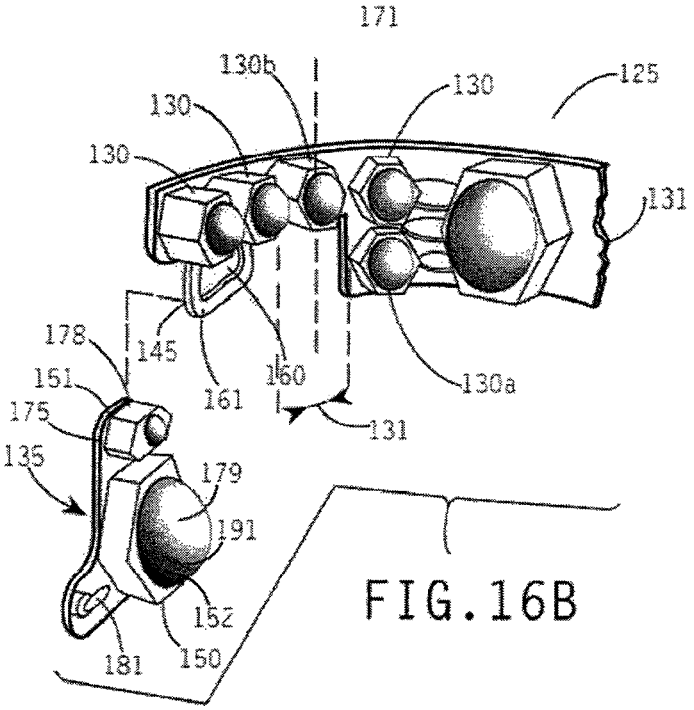
FIG. 16B is a planar view of the helmet multi-layered memory foam liner of the self adjustable helmet liner shown in FIG. 1A and 14.

As shown in FIGS. 12, 13, 14 and 16A and 16B, shock absorbing memory foam liner 125 generally includes a plurality of memory foam members 130 which are adapted to synergistically attenuating a wide variety of impact shock forces exerted upon the shell 31, and the plurality of attenuating members 130 are disposed along the inner wall surface 37 of the back 40 and sides 43, 44 of shell 31. As an option or optionally, shock attenuating absorbing liners 125 may each include an inflation valve 131 (FIG. 16A, which would mate with an opening, or port, disposed near the rear 40 of the shell 31, whereby shock absorbing attenuating liners 125 could be inflated as desired. Shock absorbing liners 125 each include at least two memory foam pad members 135 disposed upon the inner wall surface 136 (FIG. 20) of a portion of each of the jaw flap 33 of shell 31. Other embodiments of memory foam pad members 135 are illustrated. The first embodiment of memory foam pad member 135 is shown in FIGS. 14, 16A, and 16B. Another embodiment of memory foam pad member 135 is illustrated in FIGS. 16A and 16B. Although the at least two memory foam pad member, or jaw pad, 135 could be formed integral with the plurality of memory foam pad members 130 of impact attenuating liners 125, the memory foam pad members 135 are preferably releasably secured to the plurality of memory foam members 130 forming attenuating liner 125. As seen in FIGS. 12, 16A, and 16B each of the memory foam attenuating liners 125 have first and second ends 140, 141, and the attenuating liners 125 have a connector member 145 disposed at each of the ends 140, 141. Each of the connector members 145 (FIGS. 16A and 16B) are adapted to connect to the memory foam attenuating liner 125 at least two of the attenuating pad members 135 (FIG. 14, 16A and 16B) disposed upon the inner wall surface 136 (FIGS. 3 and 20) of a portion of the jaw flap 33.

As shown in FIGS. 9, 14, 15 and 16A and 16B, one embodiment of the at least two memory foam impact attenuating pad member 135, may be jaw pad 150. Another embodiment of the at least two impact attenuating pad member 135 may be seen in FIGS. 9, 15, 16A and 16B as jaw pad 150. Each of the impact attenuating pad members 135, or jaw pads 150 include at least two, and preferably three impact attenuating pad members 151, 152, 153, (FIGS. 9, 12, 15, 16A and 16B) in the case of the embodiment of jaw pad 150 (though the preferred embodiment can include two impact attenuating pad members). As previously described, each of the impact attenuating pad members 135, or jaw pads 150, are releasably secured to the impact attenuating members 130 of the multi-layer memory foam shock absorbing liners 125 by a connector member 145. Preferably the connector member 145 is a sling 160 that suspends at least at least one of the impact attenuating pad members that comprise jaw pads 150. For example, as shown in FIGS. 1A, 8, 9 and 14, impact attenuating pad member 151 is suspended from sling 160. Alternatively, impact attenuating pad member can be suspended from sling 160 (FIGS. 16A and 16B). Sling 160 has an opening 161 that receives the outer configuration, or periphery, of attenuating pad member 151 therein, preferably in a closely conforming or mating, snug fitting relationship. Alternatively, the sling can have an opening, which receives the outer periphery of impact attenuating pad member of the jaw pad, again in preferably a mating, snug fitting relationship. It should be noted that since each of the jaw pads 150 also include some hook and loop fastener material such as VELCRO®, 162, 163 (FIG. 8), to releasably secure jaw pads 150 to the inner wall surface 37 of shell 31, and preferably to the inner wall surface 136 of a portion of the jaw flap 33 of the shell 31, the mating relationship between the impact attenuating pad members 151 with openings 161 is not required to be a snug, frictional relationship. It may rather be a loose fitting relationship for positioning purposes only, to position the jaw pads 150 in their desired location. With the hook and loop fastener material acting to releasably secure the jaw pads 150.

With reference to FIGS. 14, 16A, and 16B when impact shock attenuating memory foam liner 125 is associated with the inner wall surface 37 of shell 31, including the at least two impact attenuating pad member 135, or jaw pad 150 being associated with impact shock attenuating liner 125, protective ear channels 170 (FIG. 12) is formed on each side of the shell 31 between at least one of the impact attenuating members 130 of the impact shock attenuating liner 125 and at least one impact attenuating pad member 135, or jaw pad 150. Each ear channels 170 is disposed adjacent the ear openings 112 formed in ear flaps 32. For example, with reference to FIG. 12, ear channels 170 is formed and bounded by on one side, by impact attenuating member 130*a* (FIGS. 16A and 16B), and on the other side by impact attenuating pad members 151 and 152. The upper end of ear channel 170, as illustrated, is bounded by impact attenuating member 130*b* (FIGS. 16A and 16B). Similarly, as seen in FIGS. 16A and 16B, ear channels 170 (noted by the three ear ports) is bounded by impact attenuating member 130*a* on one side, and by impact attenuating pad members 151 and 152 on the other side. The top of the ear channel(s) 170 may be bounded by impact attenuating member 130*b*. Each of the ear channels 170 preferably extends along an axis 171 (FIGS. 12, 16A and 16B), which is disposed substantially parallel with the slight vertically arched, longitudinal axis 61 of the shell 31 extending from the crown 39 of the shell 31 to the lower edge surface 42 of the shell 31 adjacent the ear flap 32. The ear channels 170 are thus substantially unobstructed from the ear openings 112 to the lower edge surface 42 of the shell 31 below the ear openings 112, whereby the wearer of the helmet may easily put on, or take off, the helmet 30 without substantial contact between the ear of the wearer and the memory foam pad members 130 and memory foam pad members 135 of the impact shock absorbing memory foam liners 125. These inventive hearing safety ear port channels 170 will help to improve the accurate sound transmissions and hearing of the helmet wearer over the prior art as the top port will transmit the high frequencies, the mid port will transmit the low frequencies, and the bottom port will transmit the medium frequencies. As an option or optionally, the ports may be slightly arched or ellipsed to be aligned with the curves of the ears. Furthermore, the three ear ports may be offset to more accurately transfer the sound encountered when wearing the safety helmet and further prevent penetration from digits (fingers) and prevent and/or minimize whistling sounds and irritation to the player's ears.

Figure 21A:
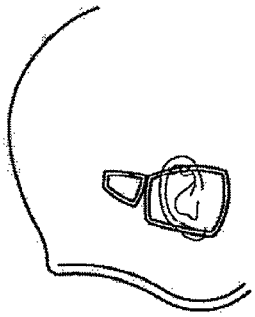
FIGS. 21A through 21D illustrate four examples of different ear ports known within the prior art from well-known manufacturers to act as an example of the wearers ear.
Figure 21B:
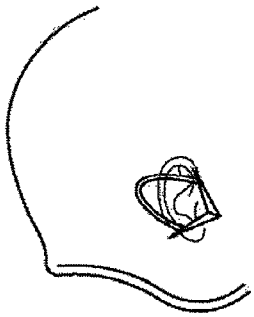
Figure 21C:
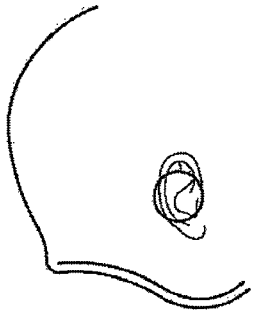
Figure 21D:
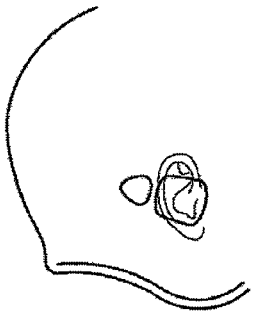
Figure 21E:
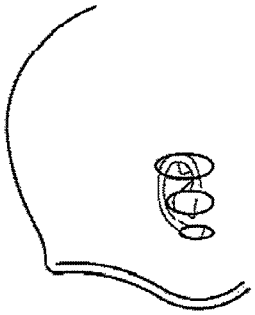
FIG. 21E illustrates the example of the present invention of the ear port.

FIGS. 21A through 21D illustrate four examples of different ear ports known within the prior art from well-known manufacturers. FIG. 21E illustrates the present invention.

Furthermore, the limitations of the prior art ear ports include: the ear ports are easily penetrated by digits and thumbs, thus do not afford protection from digits.

The prior art's ear ports designs create a weak configuration in the helmet. They produce, additionally, a wide range of sound distortions, such as from horns, drums, loudspeakers, etc. and often create a highly distorted, high-pitched whistling sound when running when wearing such helmets.

With reference to FIGS. 9, 15, 16A and 16B the construction of jaw pad 150 are illustrated. In general, memory foam pad member 135, or pads 151, 152, 153, may include a layer of padding material 175 (FIGS. 9, 15, 16A and 16B), or two layers of padding material disposed in a chamber, or housing, 178, 179. The chambers 178-179 may be formed of any suitable plastic material(s) having the requisite strengths and durability and impact attenuating characteristics, to function as attenuating members, or pad members, for a football helmet and safety helmets in general. If desired, all of the chambers 178-179 could be filled with a single or multiple layer of padding material, or some of the chambers could be filled with a multiple layer; optionally other chambers could be filled with two or more layers of impact attenuating padding material(s) or any suitable combination as needed. Two or more different attenuating layers are preferred.

Alternatively, at least one of the impact attenuating pad members 135, or attenuating pads 151-153 as an option may also include a fluid or gas such as a pressurized fluid or gas, such as nitrogen or air. In the jaw pad 150 shown in FIGS. 9, 12, 15, 16A and 16B, pads 151 and 153 (FIG. 12) are filled with a single or multiple layer of impact shock attenuating padding material, and pad 152 in addition to at least one layer 176 of padding material includes a gas or fluid, and the fluid or gas may be pressurized as needed.

Figure 15:
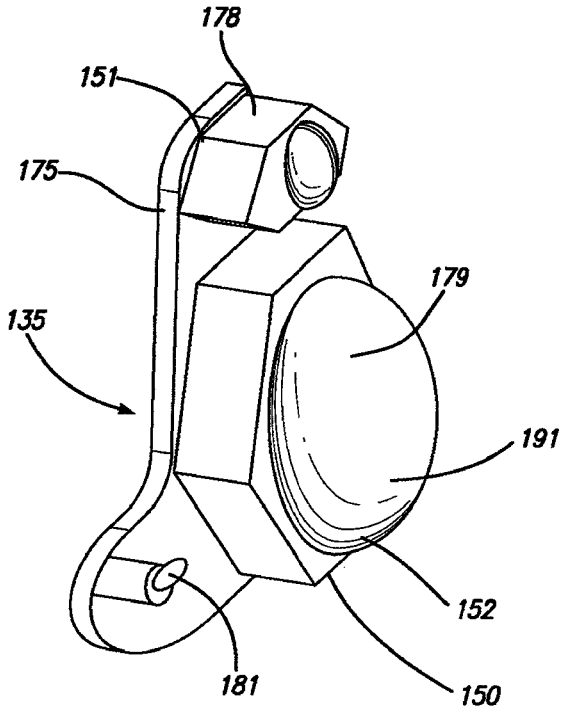
FIG. 15 is a partial exploded perspective view of the liner of the helmet and the FIG. 1A and 14 of the present invention.

Preferably, the fluid or gas is nitrogen or air. As shown in FIGS. 15 and 16A, pad 152 preferably includes within its respective housing, or chamber, 179, two layers of attenuating padding material. Having a variety of different impact shock attenuating padding materials having different impact control characteristics can be used for layers 175 and 178. For example, PVC nitrile foam, rubber foam, memory foam or polyurethane foam are examples of attenuating foam(s) and padding materials, which may be utilized, as are known in the art.

When multiple layers of attenuating padding material are preferably utilized, such as in pads 152, the first layer of 175 may be one of the foregoing types of foam materials, which is generally referred to as an impact energy, or force attenuating, memory foam, and the surface layer(s) of foam padding material 179 is a "softer" foam, generally referred to as a fitting, or comfort, foam, generally dome and ellipsed dome shaped surfaces are preferred. Examples of materials in construction of the foregoing described pads may also be found in U.S. Pat. No. 3,882,547, which patent is incorporated herein by reference.

The pressurized nitrogen or air gas or fluid, may be provided to the interior of chamber, or housing, 179, as by an air channel 181 in gas communication with the interior of housing 179 at one end, and in gas communication at its other end with a suitable inflation valve. The inflation valve may include an inlet orifice 183 (FIG. 9) which permits access to a compressible needle valve member, which has an exit orifice in gas communication with air channel 181 (FIGS. 16A and 16B). A conventional hand held pump having a conventional inflation needle may be inserted through the needle valve member, as is known in the art, to provide the desired amount of pressurized fluid, or nitrogen or air into air channel 181, to thus inflate chamber, or housing, 179, as desired. The inflation of chamber 179, in combination with the memory foam padding material contained therein may assist in properly sizing the helmet, including jaw pad 150, to the shape of the head of the wearer of the helmet. Air or gas channel 181 (FIG. 9) may be formed by any conventional plastic material formed in the shape of air or gas channel 181, such as by one or two layers of a suitable thermoplastic material which maybe conventionally heat sealed together into the desired configuration shown in FIGS. 9 and 16B. Inflation valve may include an annular seat, which is received within the confines of opening when inflation valve is folded back upon jaw pad 150 after pad 152 has been inflated, as desired, as shown in FIGS. 14, 16A and 16B.

With reference to FIG. 9 or 15, and 16A and 16B, jaw pad 150 also may include a chamber, which may include a single, solid layer of memory foam, and the pad 152 preferably may have multiple layers of different memory foam having different characteristics disposed within chamber, or housing 179. If it is desired to provide for a fluid or gas within chamber 179, pad 150 may also include an inflation valve as previously described, in gas communication with an air channel 181, which in turn is in fluid or gas communication with the interior of chamber 179. Inflation valve for pad 150 is associated with an inflation port, disposed in the outer wall surface 38 of shell 31, inflation port in turn passing through the shell 31 to the inner wall surface 37 of shell 31. Thus, the inflation valve of jaw pad 150 is accessible from the exterior of shell 31, whereas inflation valve of pad 150 is accessible from within shell 31. Chamber, or housing, 179 for pad 152 of jaw pad 150 may have any suitable outer configuration; however, a generally pentagon/polygonal configuration as illustrated in FIGS. 16A and 16B. The two outer wall surfaces 190, 191 of chamber 179, which define one side of ear channels 170 are of a generally elongated rectangular shape, with no sharp protrusions extending into ear channel 170. Housing, or chamber 179 of jaw pad 150 may have at least three sides, five sides being illustrated and preferred in the embodiment of FIGS. 15 and 16A and 16B. It should be readily apparent to one of ordinary skill in the art that jaw pad 150 may have more than three sides, as well as could have only an outer circumference, were it to be generally formed in the shape of an ovoid or oval, preferably having an ellipsed dome external surface.

With reference to FIGS. 12 and 13, a crown impact shock absorbing memory foam pad 200 is preferably disposed adjacent the inner wall surface 37 of shell 31 beneath crown 39. As an option or optionally, crown impact shock absorbing memory foam pad 200 is inflatable, and includes an inflation valve 201, which is received within an opening formed in the crown 39 of shell 31, which permits crown impact shock absorbing memory foam pad 200 to be inflated. Crown 200 may also include a positioning member 202, or snap member 203, or push-in-plug 204, which is received within an opening 205 in shell 31, to position and retain crown pad 200 within shell 31. Crown shock absorbing pad 200 may be of any suitable construction, and may include a single or multiple layers of different suitable impact shock absorbing memory foam material(s) disposed therein. As seen in FIG. 12, the front 41 (FIGS. 1A and 2A) of shell 31 optionally may include a conventional brow pad 210, as is known in the art.

As seen in FIGS. 1A, 2A, 9, 14, 15, 16A, 16B, and 19, the helmets 30 of the present invention, including jaw pads 150, when compared with previously proposed helmets, provide for a substantial amount of reinforcement having energy, or force attenuating characteristics, synergistically transferred to and combined with multi-layered memory foam impact attenuating layers, or padding material, including one or more adjustable pentagonal or octagonal memory foam pads (as shown, for example, in FIGS. 11-14 and 16A), disposed in front of the coronal plane of the body of the wearer of the helmet and below the basic plane of the head of the wearer of the helmet. The lining also may be comprised of rounded pads, as shown in FIGS. 9, 10, 15, and 16B.) The impact energy, or force attenuating, multi-layered memory foam materials, or padding material, is preferably a PVC nitride foam and/or a polyurethane foam preferably, having a density of about at least approximately 5 PCF (pounds per cubic foot) and at least about a 25% compression deflection (ASTM D-1056 standard) of 8 PSI (pounds per square inch).

The impact energy, or force attenuating, multi-layered memory foam, or padding materials, is preferably a PVC nitride foam or a polyurethane foam preferably, having a density of at least about 0.50 PCF (pounds per cubic foot) and at least about a 25% compression deflection (ASTM D-1056 standard) of about 0.90 PSI (pounds per square inch).

The ellipsed dome surface comfort layer force attenuating, self-adjusting memory foam, material, is preferably a PVC nitride foam or a polyurethane foam preferably, having a density of at least about 0.10 to 0.40 PCF (pounds per cubic foot) and at least about a 25% compression deflection (ASTM D-1056 standard) of about 0.10 to 0.40 PSI (pounds per square inch).

As is known to those of skill in this art, the coronal plane is the frontal plane that passes through the long, or longitudinal, axis of the body, and the basic plane is a transverse plane that generally passes near the ears and the lower orbital rims of the eyes of the body.

The invention further relates to a reinforced protective and safety helmet(s). More particularly, the invention relates to a protective helmet having a self-adjustable multi-layered memory foam impact force attenuating helmet and liner for permitting the protective helmet to be comfortably worn by individuals having different shaped and sized heads.

Figure 11:
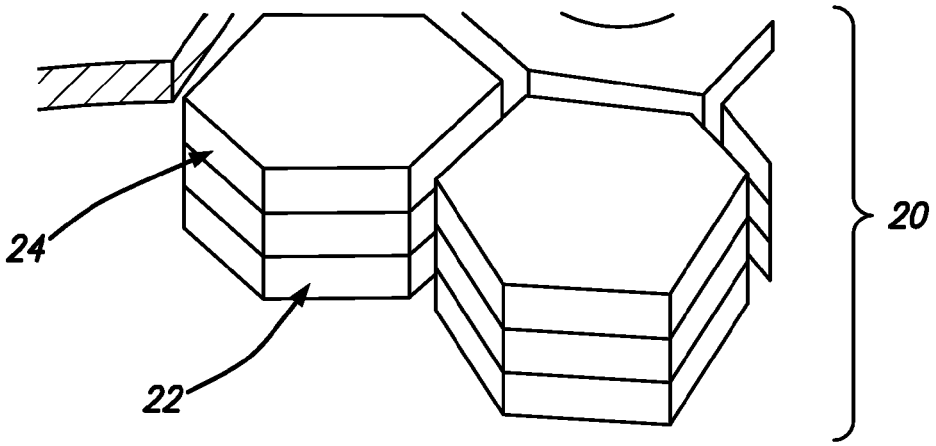
FIG. 11 is a side view of the multi-layer memory foam pad member of the present invention of FIGS. 12 and 13.

The present invention is directed to a protective helmet FIG. 1A, 2A, and in particular an adjustable helmet liner 20 (FIG. 11) for permitting individuals having different sized and shaped heads to wear the protective helmet. Referring now to FIG. 11, in one specific embodiment, an adjustable multi-layered memory foam force attenuating helmet liner 20 includes at least one liner wall 22. The at least one liner wall 22 includes an inner surface 24, an outer surface, and a peripheral surface. In the embodiment shown in FIGS. 2A and 12, the at least one liner wall 22 further includes a first side wall 30, a second side wall 40, and a rear wall 50. First side wall 30, second side wall 40 and rear wall 50 (FIG. 12) may have any suitable shape desired or necessary to sufficiently and comfortably capture the head of the individual wearing the protective helmet in the adjustable helmet multi-layered memory foam liner 20, but as shown in FIGS. 16A and 16B may be generally polygon/pentagon oval, ovoid, round, square, triangular, or rectangular shaped, preferably having an external ellipsed domed surface, or as needed.

The first side wall 30, second side wall 40, and rear wall 50 each include at least one side edge. In the embodiment in which any one or more of the first side wall 30, second side wall 40, and/or rear wall 50 are generally polygon/pentagon or circularly or oval shaped (not shown) as needed, the first side wall 30, second side wall 40, and/or rear wall 50 include one side edge. In other embodiments, the first side wall 30, second side wall 40, or rear wall 50 include a plurality of side edges. In the embodiment shown in FIGS. 2A, 3, 16A, 16B, and FIG. 12, the first side wall 30, second side wall 40, and rear wall 50 are each generally polygon/pentagon, oval, rectangular-shaped. In this embodiment, the first side wall 30 includes a first side edge 31 (FIGS. 3 and 12), a second side edge 32 (FIGS. 12 and 20), a third side edge 33 (FIGS. 3, 12 and 20), and a fourth side edge 34. First side wall 30 also includes a first longitudinal axis 35 (FIG. 2A). Second side wall 40 includes a fifth side edge 41, a sixth side edge 42, a seventh side edge 43, an eighth side edge 44, and a second longitudinal axis 45. Rear wall 50 includes a ninth side edge, tenth side edge, eleventh side edge, a twelfth side edge, and third longitudinal axis. Although the shape of the first side wall 30, second side wall 40 and rear wall 50 may be of any suitable shape, preferably, the first side wall 30, second side wall 40 and rear wall 50 are slightly concave on the inner surface 24 to generally conform to the variable curvatures of the head of the individual wearing the protective helmet 90.

The suitable size of first side wall 30, second side wall 40 and rear wall 50 may be any suitable size desired or necessary to adequately capture the head of the individual wearing the adjustable helmet liner 20. For example, the first side wall 30, second side wall 40 and rear wall 50 optionally may be smaller for use by children and adolescents and larger for adults. Therefore, the desired size is easily determined by persons skilled in the art. Still referring to FIGS. 2A, 3, 12, 16A, 16B, 19 and 20, first side wall 30, second side wall 40, and rear wall 50 are adapted to connect to each other by first attachment wall 38, second attachment wall 48, and third attachment wall 58. First attachment wall 38, second attachment wall 48, and third attachment wall 58 are adapted to connect to each other at apex 60. In the specified embodiment, first side wall 30, second side wall 40, and rear wall 50 include at least one multi-layered memory foam impact force attenuating impact absorption pad.

The size and shape of the first attachment wall 38, second attachment wall 48, and third attachment wall 58 may be any suitable size or shape desired or necessary to adequately properly capture the head of the individual wearing the multi-layered memory foam force attenuating adjustable helmet liner. For example, as shown in FIG. 2A, 19, the first attachment wall 38, second attachment wall 48, and third attachment wall 58 are preferably polygon/pentagon, rectangular or ovoid shaped. The dimensions of the first attachment wall 38, second attachment wall 48, and third attachment wall 58 are easily determined by persons skilled in the art. As discussed above in connection with the size of the first side wall 30, second side wall 40, and rear wall 50, the size of the first attachment wall 38, second attachment wall 48, and third attachment wall 58 are smaller for children and adolescents and larger for adults or as needed.

In a specified embodiment encompasses that, the adjustable helmet liner 20 includes at least one expandable or adjustable band. The expandable or adjustable band may be secured to the adjustable helmet liner 20 by any device or method known by persons skilled in the art. The expandable or adjustable band is secured to the first side wall 30, second side wall 40, and rear wall 50 by securing members. Securing members may be grommets, screws, rivets, or any other securement device known in the art. In the embodiments in which securing members are grommets, screws, rivets or any other device that requires the securing member to be placed through the first side wall 30, second side wall 40, and/or rear wall 50, the first side wall 30, second side wall 40 and/or rear side wall 50 may include at least one side wall aperture 47.

Referring now to FIG. 12, adjustable helmet multi-layered memory foam impact force attenuating liner 20 is disposed within a wide variety of protective helmets. Protective helmet may be a football, lacrosse, baseball, motorcycle, hockey, military helmet i.e. (Ballistic) (FIG. 51) or any other transportable device worn on the head of an individual to capture the head of the individual within the protective helmet. As shown in FIG. 12, protective helmet is a football helmet and includes a helmet inner surface, a helmet outer surface, and various multi-layered pad structures disposed along the helmet inner surface to adsorb and attenuate forces to the outer surface of the reinforced protective helmet and attenuate and dissipate the impact forces such that the strength of the force is lessened before reaching the head of the individual wearing the protective helmet. The various multi-layered memory foam force attenuating pad structures may be any shape, configuration or sized desired or necessary to comfortably capture the head of the individual wearing the protective helmet and may be placed at any location along the helmet inner surface, such location is readily known by persons skilled in the art.

Spaces are located along the helmet inner surface and in between the pad structures. The self adjusting and adjustable multi-layered memory foam force attenuating helmet liner 20 is placed within these spaces and secured to the protective helmet. As shown in FIG. 12, adjustable helmet liner 20 is secured to the protective helmet by placing securing members through helmet liner apertures and protective helmet apertures.

In another preferred embodiment, after the self adjusting and adjustable helmet liner 20 is connected to the protective helmet, a multi-layered memory foam force attenuating crown pad is disposed over the apex of the adjustable helmet liner 20 to provide improved impact force attenuation and improved fit and comfort between the top of the head of the individual wearing the protective helmet and the self-adjusting and adjustable helmet liner 20.

In one preferred embodiment, the multi-layers helmet liner are enclosed in a moisture resistant material layer provides a nearly linear force-deflection curve, which allows for maximum comfort throughout the compression range and impact shock attenuation operation or cycle. The different characteristics of the multi-foam layer(s), which may be the top layer(s) and closest to the user head, acts as a comfort engagement layer between the user and the multi-foam layered helmet liner may be contoured to match the user's engagement head area, which provides for proper positioning and function when using the helmet. In other applications, the multi-foam layers helmet liner materials whose values are varied and materials having different material thickness and different sizes may be shaped in other ways so as to spread the contact surface as greatly as possible.

The upper surface of the multi-layered memory foam layers is molded to conform to a human's head. The lower surface of the foam layer is molded to mate with the upper surface of the linear-response plastic helmet liner cushioning materials.

Moisture-resistant materials are particularly preferred for the helmet(s) liners so as to prevent water from infiltrating the impact cushioning layers.

A particularly preferred cushioning material comprises two to eight thermoformed sheets of plastic that, when formed with a cavity of a particular geometry, mimic a linear spring when compressed. The seat cushioning material has pentagon or generally square cavities on the top and bottom of two sheets of plastic that are joined at the middle of the pad(s). The generally polygonal/octagonal pads allow for compression to occur in a generally linear force/deflection environment when a user receives an impact. The straight walls of the attenuating pads compress evenly on both sides of the plastic, providing for this near-linear curve. The preferred method of construction is to multi-sheet thermoform the plastic materials because of speed and cost. This method will form and adhere the multiple layers and pieces together in one operation.

This invention allows for a generally linear force-deflection curve for the majority of the deflection that is seen when (a) impact(s) compress(es) the pad(s).

The pad material using generally ellipsed dome, which provides a greater degree of fit and comfort and improved feel than the prior art.

Having a helmet liner with a linear impact force deflection curve minimizes the pressure points that are felt by the subject when wearing and using the helmet and allows for greater fit and comfort. Other products (like different types of foams) provide for an exponential force-deflection curve during attenuating compression. This can place pressure points on areas of the head of the wearer that may cause discomfort when wearing a helmet for long periods of time. A helmet liner with a linear force-deflection curve can minimize this discomfort and reduce pressure points.

As an option, alternative forms of helmet liners and impact force attenuating technology can also work in this invention, for example by providing an external hemisphere at the bottom of the generally square or rectangular pad(s). The added helmet liner(s) hemisphere pad(s) supports the square pad at the same point that this impact occurs, thereby increasing the steepness of the attenuation curve and producing a more nearly linear response curve.

Additionally, alternative methods of construction may include vacuum forming or multiple sheet thermoforming. Both of these methods may require the multiple sheets of plastic to be secured via a secondary operation such as, but not limited to: sonic welding or hot gun welding known within the art.

In a specified embodiment encompasses that the variables include: the material type; the thickness of the material; the size of the ellipsed dome projections; the height of the projections; the radius of the mating surfaces of the projections; the radii on the [side] edges of the projections; and, the optional presence of an imbedded hemi-ellipsoid projection at or near the center of the generally polygon/pentagon square pad projections for added stiffness.

Additionally, the various dimensions of the materials whose values may be varied to affect the response curve of the material to impact deflection. In certain embodiments, it may be desired to adjust these variables so as to achieve a nearly linear force versus a non-linear displacement response or as needed depending upon the application or as needed.

Additionally, the current invention encompasses previously unavailable impact and attenuation recoil technology encompassing multidimensional, structural "coil" "ring" system having enhanced impact recoil reflection and other control characteristics. Employing inventive annular reinforcement apparatus having many sizes and having varied and diverse annular components apparatuses(s) and methods of using synergistic reinforcement in helmets and other transportable safety equipment encased (cast) in a wide variety of plastics and resins or composites employing inventive reinforcements methods and apparatuses, such as but not limited to "rings," "curves," "loops," "hoops," "turns," "coils," "spirals," helices, polyhedrons, and a wide variety of reinforcement grid works and "meshes," "woven," and/or "nets" providing a wider range of reinforcement strengthening functions. These terms as used herein may be used interchangeably in this disclosure. The FIG. 22 figure illustrates overlapping rings, which form linked, multiple-chain attenuation reinforcement apparatuses.

In an illustrative embodiment encompasses one of many possible configurations having overlapping "coils," "loops," etc.

Figure 23:
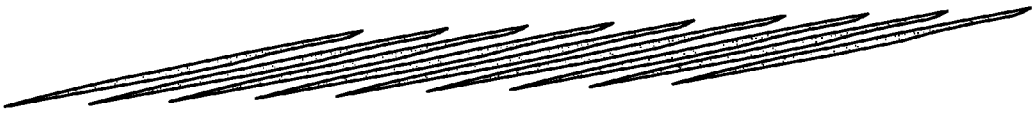
FIG. 23 illustrates an exaggerated side view for illustrative purposes for clarification of the invention, such that the "coils" "rings" that preferably overlap sufficiently (not loop through one another.

The filler or bonding helmet materials, such as plastics and resins may be encapsulated (bound) within each internal reinforcement "ring" that is pre-engineered and spaced and thus binds multiple overlapping "coils," "rings" together due to their close spacing distance(s). The closely embedded high tensile strength reinforcement "rings" resist outward bulging forces. FIG. 23) illustrates an exaggerated side view for illustrative purposes for clarification of the invention, such that the "coils" "rings" that preferably overlap sufficiently (not loop through one another). For illustration purposes the reinforcement angles of FIG. 23—the separations are exaggerated to make the separation clear.

As an example, the high tensile reinforcement range reinforcement "coils" "rings" bind together the internal filler or bulk, making a stronger and more structurally reinforced monolithic safety helmet(s) as illustrated above in FIG. 4). Any helmet shape or form can be economically reinforced having a variety of attenuating advantages as illustrated in FIG. 1A and FIG. 20. Note in this figure that the corners are not reinforced by smaller rings. Due to the ends lacking equal reinforcement density. As for example, but not limited to smaller rings could be configured to provide sufficient reinforcement as needed as in the FIGS. 24 and 25.

Having previously unavailable impact attenuating wave guiding/directing and transferring displacement and impact recoil stress transferring characteristics including acceleration effects (guided stress transfer). As the reinforcement apparatus "coils," "rings" provide a higher percentage of compression transfer as compared to tension transfer thus the current invention operates on a different principle with the art. More specifically having improved surface accelerations and stress transferring characteristics. In an exemplary embodiment, the overlapping "coils" "loops" may be configured to overlap each other between one to ten overlaps four or five "loops" "coils" overlaps being preferred.

Additionally, the current invention further encompasses non interlocking "loops" "coils" to suit a variety of applications and further encompasses a wide range of filament diameters and gauges as needed. In a specified embodiment encompasses that the helmet(s) seams(s) may be designed and configured and manufactured to be the "strongest" reinforcement section or portion of the helmet(s). As an example, limitations of the prior art motorcycle helmet is incomplete reinforcement placement and the placement (is not positioned in the primary impact or stress areas or zones). Furthermore, the prior art does not employ sufficient reinforcement nor do they employ reinforcement, filaments in force attenuating geometries or configuration (that does not, employ "ring" recoiling patterns) or other significant force attenuating patterns as disclosed herein.

The "rings," "coils" reinforcement material(s) depending upon the application can be specifically engineered and manufactured or variably configured as an example. Reinforcement "loops" (or "coils" "rings"), which reinforce the bulk composite materials encases the reinforcement "rings" thus considerable mass/weight savings are achieved by minimizing bulk zones to volume ratio which are closest to the reinforcement(s). As an example, the reinforcement "coils" "rings" encircles the outer perimeters of the composite rings, (where reinforcement most benefits the composite rings). The bulk filler material(s), such as resin or plastic(s) known within the art bonds "welds" together "ring" "chains" "coils" of reinforcement. Note that without "bulk" filler material, the "coils" are loose "coils" or wires. The larger individualized "rings" "coils" may be used separately or may be combined as needed depending on the specific application.

In a specified embodiment encompasses hooked, or interlocking "rings" or "ringlets," may be configured in reinforcement tubes and micro tubes in the form of micro "fibers." Graphene "coils" or tubes are preferred. Graphene is most preferred in hollow cylinders having a mesh pattern(s) is most preferred such as for ballistic helmets and a variety of extreme safety helmet applications.

The inventor theorizes that the majority of the brain damage results from (or at) the impact(s) acceleration point transition from compression to tension IE produces brain slapping, back lash resulting in short term and long term injuries and damage and different speeds from the different impacts produce different types of injuries as the prior art does not consider or ignores these and other impact "frequencies" that need to be significantly modulated to provide short and long term impact protection when wearing a helmet. In a specified embodiment encompasses that filler or bonding the resin(s) may be mixed with or contain a wide variety of micro "ring" "coils" fibers as needed.

Additionally the prior art is not aware or does not consider the use of annular reinforcement or "mesh" "net" reinforcement(s) in helmets or other transportable safety equipment. The current invention encompasses reinforcement geometries are as separate and distinct from the prior art and provides a wider range of impact attenuation and displacement. As an example, prior art helmets having carbon fibers only on a portion of the helmet or only on certain segments of the helmet.

Figure 22:
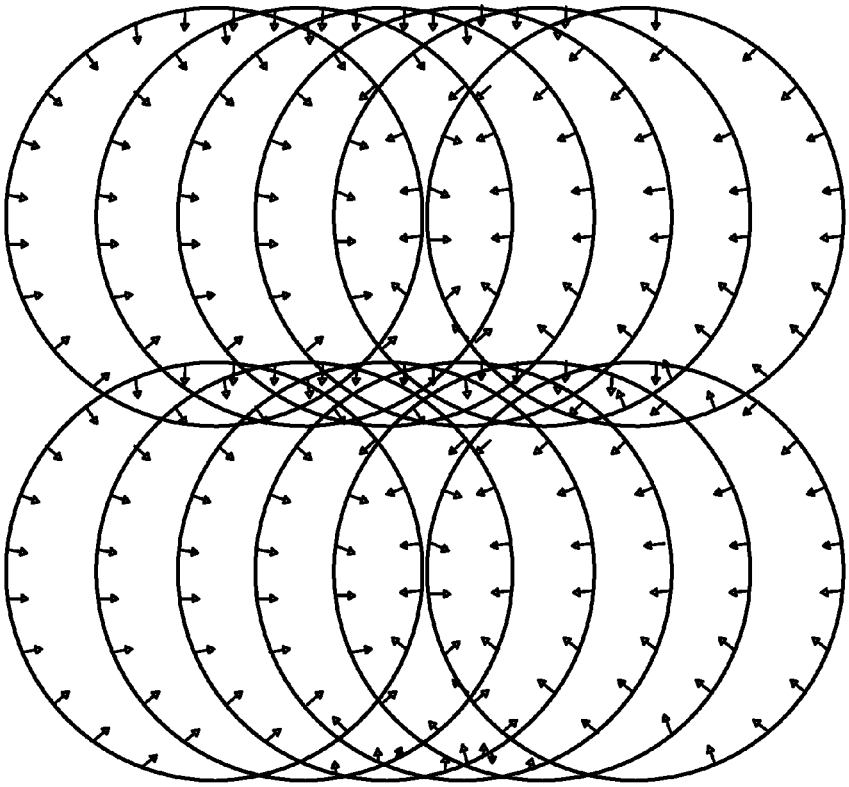
FIG. 22 illustrates overlapping rings which form linked, multiple-chain attenuation reinforcement apparatuses and. an illustrative embodiment encompasses one of many possible configurations having overlapping "coils," "loops," etc.
Figure 24:
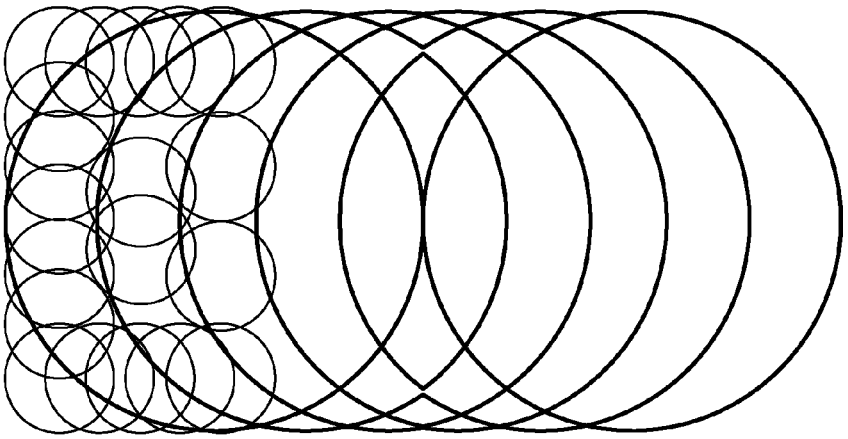
FIG. 24 illustrates over lapping rings also showing where the rings or coils do not have to be limited to one size, and could incorporate smaller rings, which could be configured to provide sufficient reinforcement as needed.
Figure 25:
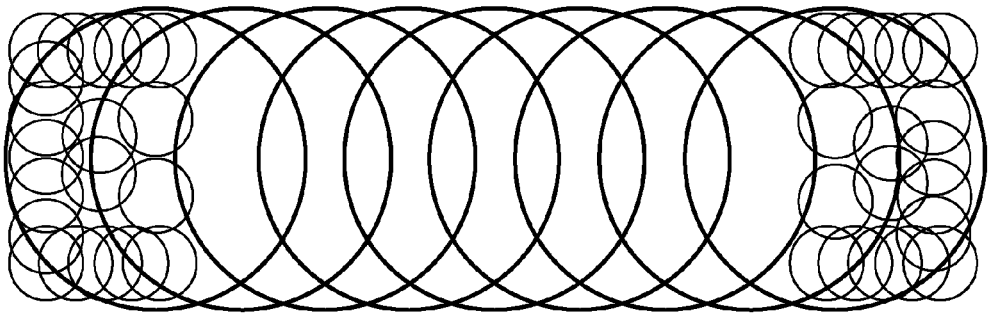
FIG. 25 illustrates the reinforcement "coils" "rings" encircles the outer perimeters of the composite rings, where reinforcement most benefits the composite rings.
Figure 27:
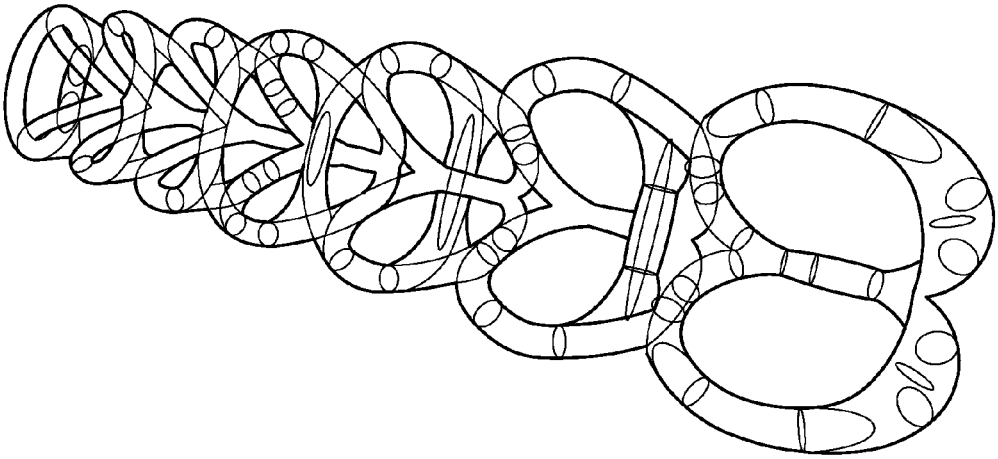
FIG. 27 illustrates as a further example, the adjoining "coils" "rings" may share volumes. A wide variety of possible reinforcement patterns can be positioned and "bonded" inside the bulk "coils" "rings" or "shells". These bonds can be achieved by the embedding of these stronger "ring" "coil" configurations within the less costly filler or bonding materials, such as plastic(s) and resins, well known with the art. In other exemplary embodiment the inventive apparatus and methods encompasses that the "rings" "coils" are preferably strategically pre-engineered and configured to be overlapped sufficiently to "share the attenuating shells."

Referring now to FIGS. 22, 24, and 25, the preferred embodiment encompasses apparatuses such that the "rings," "coils", "hoops" sizes range from about 0.250 to 3.00 inches in outer diameter ("O.D."), preferably ranging between 0.330 to 2.00 inches O.D. Most preferably, ranges between about 0.400 to about 1.20 inches O.D. That is suitable for the highly complex forces (bulging) and complex wave forms and frequencies encountered during safety helmet impacts. In other exemplary embodiment(s) encompasses having overlapping "reinforcement" layers preferably centered over the separated "seams" and or the more critical "impact zones", i.e. preferably over the ears and the forehead of a helmet are preferred. The leave in place, cast in place, annular "coil," "ring" reinforcement components are most preferred. Graphene in a wide variety of "ring" "coil" patterns are most preferred. An object of the invention is to meet or exceed existing "prior art" football and other safety helmets performances. Illustrated in FIG. 27 are three rings showing composite rings that may be bonded together in composite reinforcement "ring" "coil" structures having shared volumes.

Figure 26:
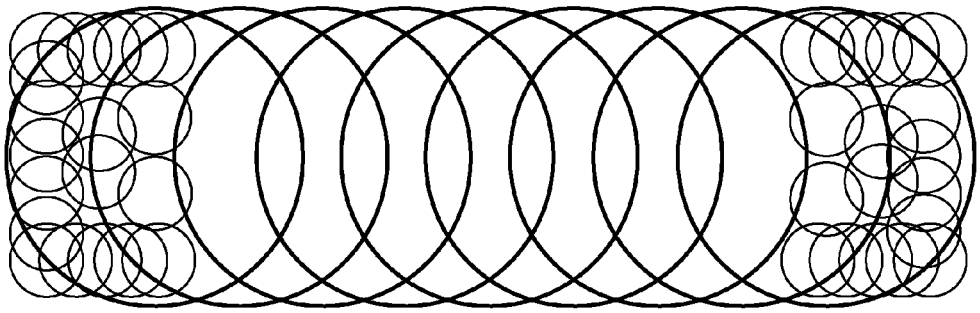
FIG. 26 illustrates that the reinforcement material(s) (coils) provides displacement and other efficiencies when designed and configured in "wraps" the reinforcement material(s) within its bounds.

As an example, FIG. 26 illustrates one of many possible configurations of a stress attenuating displacement reinforcement "rings" "coil" apparatus and the smaller (micro) bulk "rings" function in the inventive attenuating apparatus having improved compressive reinforcement material(s) and characteristics that are suitable and compatible with a variety of filler or bonding plastics and resins known within the art.

As an option or optionally manufacturing the helmet(s) "shell" may be from a multi-layered laminating construction process encompassing that each layer contains the same or different reinforcement configurations that are bonded with a variety of plastics and resins as known with the art.

FIG. 26 illustrates that the reinforcement material(s) (coils) provides displacement and other efficiencies when designed and configured in "wraps" the reinforcement material(s) within its bounds. The "rings" "coils" achieve more reinforcement by encircling and therefore improve the binding the "bulk" filler or bonding material (such as plastic composite materials). Thus having two different composite materials may achieve more functionally efficient strength and attenuation characteristics, primarily from this strategic arrangement of both materials.

In a specified embodiment, the "rings" "coils" may be manufactured from a wide variety metals, such as high carbon steel stainless steels and their alloys. In a wide range of gauges as needed preferably terminating the "rings" "coils" with hooks and or coils is preferred.

As an example, filler or bonding for the attenuating reinforcement "loops" "coils" members may be obtained by embedding high tensile ring shaped geometric configurations (one of many possible configurations) into lesser filler or bonding materials that bind and compress and/or cement the bulk filler or bonding plastic and or resins together as known in the art.

Additionally the prior art does not position their inefficient reinforcement at or near the helmet surface (in the primary stress zone) where is needed. Nor is it positioned near the outside and or inside surface of the helmets structural shell.

As a further example, Kevlar® and carbon fibers are composite structure types that are much stronger than the bulk filler or bonding material alone and are more economical than the stronger material alone. The helmet(s) shell specifications can vary widely depending upon their intended use and applications to meet a wide variety of uses and the composite criteria(s). The following advantages are theorized for the "rings" "coils" in helmet(s) shell composites and other transportable safety equipment and having a longer potential operating life than the prior art. 1) Normal, bulk filler or bonding resin shrinkage may be better tolerated, thus improving shrinkage and micro cracking control. 2) Additionally dynamic composite "ring" "coil" structures impact stresses transfers are mitigated circuitously realizing significantly more potential of the materials instead of compounded linearly as in the prior arts use of generally inefficient woven filaments in costly safety ultra high performance helmets. 3) Deformation by impact is better tolerated. 4) Linear compression enhances inward binding to offset longitudinal buckling. 5) Linear tension tends to bind. 6) More efficient manufacturing process and less difficulties. 7) Process avoids the wastes of subtractive cutting or fitting. 8) Simplified tooling saves labor and materials and general handling. 9) Annular modularity adapts to digitally controlled production. 10) "Ring(s)" "coils" can inter-penetrate one another intact, note that most mesh types cannot. 11) Design configurations and adjustment are more easily accommodated.

The inventive methods and apparatus attenuating "rings" "coils" may be more readily configured in thin-shell reinforced structures such as safety helmets and other transportable safety equipment as stated herein.

In other specified embodiment, the current invention encompasses any suitable filler or bonding plastic and or resin process or systems such as but not limited to lay-up application, lamination(s) process, or other methods of manufacture may benefit. "Rings" "Coils" emplacements during extrusions of composite bulk filler or bonding is applicable both to manual labor as well as in automated systems.

In an exemplary embodiment encompasses that the filler or bonding resin/plastic filler preferably contains micro "rings" "coils" preferably range between about 0.010 to about 0.250 inches O.D. or as needed.

The current invention encompasses methods of construction/manufacture of safety helmets(s) not specifically stated here in.

As an example, the "rings" "coils" may be configured and placed in a wide variety of patterns and configuration such as pre-engineered overlapping patterns, as the filler or bonding and filling material is being applied such as casting or injection molding such as continuous spooled wires, filaments. Roving filaments such as (or many carbon derived filaments such as graphene) may be spooled into the desired patterns as needed as their configuration(s) and flexibility may allow simpler handling and manufacture processes. Note that stiffened wires, bars or "rings" "coils" may require customized tooling designs. Note stiffer materials often implies greater strength and reduced elongation properties, which are generally more preferred. Note that, simplistic, hand assembly can be more readily obtained. Note: generally, manual hand assembly work more easily translates into robotic manufacturing development.

FIG. 27 illustrates as a further example, the adjoining "coils" "rings" may share volumes. A wide variety of possible reinforcement patterns can be positioned and "bonded" inside the bulk "coils" "rings" or "shells". These bonds can be achieved by the embedding of these stronger "ring" "coil" configurations within the less costly filler or bonding materials, such as plastic(s) and resins, well known with the art. In other exemplary embodiment the inventive apparatus and methods encompasses that the "rings" "coils" are preferably strategically pre-engineered and configured to be overlapped sufficiently to "share the attenuating shells".

As these overlapping annular "rings" "coils" reinforcements having surface deformations is most preferred. The "recoil" "rings" "coils" may be sized and dimensioned to suit a wide variety of transportable safety equipment applications as needed.

Figure 28:
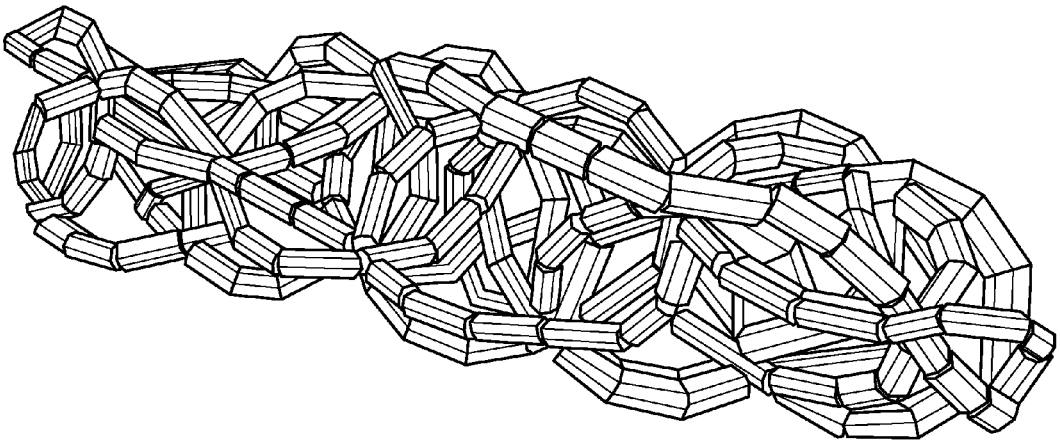
FIG. 28 illustrates one of many possible configurations of the modeled "rings" "coils" maybe mapped as an example in tetra-helix geometric formations of tetrahedrons.

In an exemplary embodiment, the current invention further encompasses additive molding processes such as Rapid Prototyping such as having shared-shell(s). FIG. 28 illustrates one of many possible configurations of the modeled "rings" "coils" maybe mapped as an example in tetra-helix geometric formations of tetrahedrons. The intersection interferences most easily adapts to additive construction processes such as in rapid prototyping. Note for electronic polarization purposes, tetra helix mapping offers other characteristics. (By calculating the optimized "ring" "coils" relationship or code). The "coils" "rings" may improve impact force attenuation in new and highly complex ways.

As an example, FIG. 28 illustrates surface deformations that are highly efficient at interfacing filler or bonding with a wide variety of filler or bonding materials surfaces in a tetra-helix ringed geometric configuration (having thicker "rings"). Note that the "rings" each share more volume than the intersections alone do.

Figure 29:
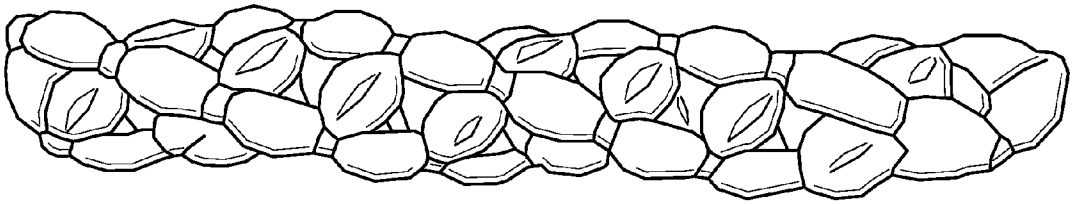
FIG. 29 illustrates a tetra helix geometric configuration having complex surface deformations or patterns as an option may be formed and configured by generally straight segments joined together as tetrahedrons.

As a further example, FIG. 29 illustrates a tetra helix geometric configuration having complex surface deformations or patterns as an option may be formed and configured by generally straight segments joined together as tetrahedrons.

Figure 30:
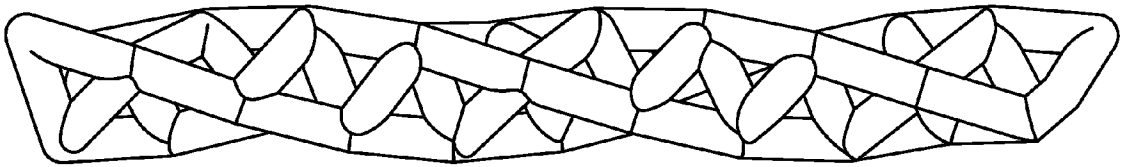
FIG. 30 illustrates an additional example of having efficient "rings" "coils" surface deformations or patterns in three dimensional "rings" configurations, where the structural bond may be configured by overlapped rings which are suitably embedded in molded plastic and or resin materials as stated herein additionally. A 3-Dimensional reinforcement modular filler or bonding structure(s) (as an example), may be formed by overlapping 3 Dimensional "rings" "coil" reinforcement(s) in apparatuses or components as needed.
Figure 31:
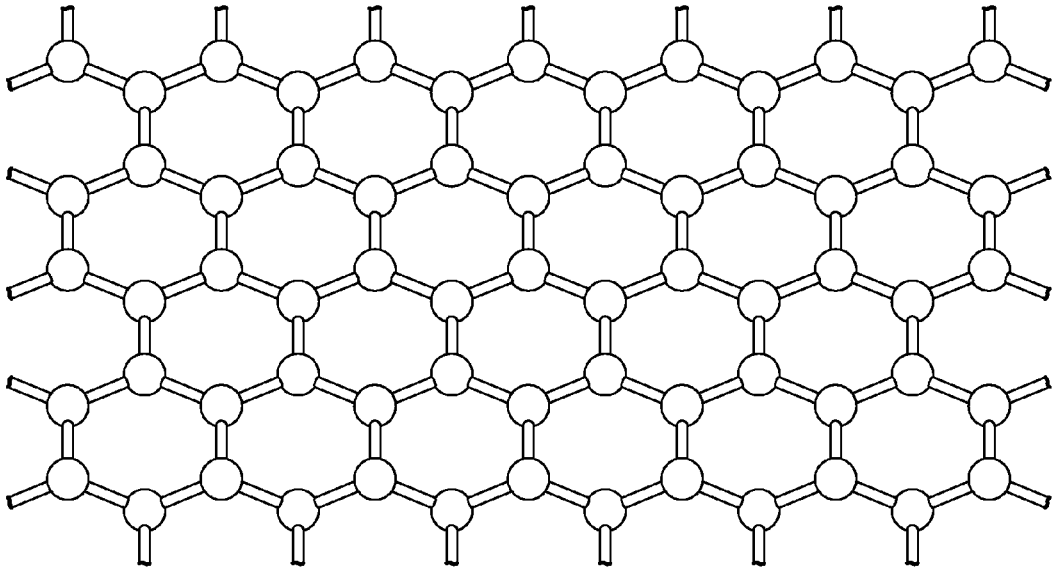
FIG. 31 illustrates grapheme as used herein is an allotrope of carbon, having a structure that is one-atom-thick planar sheets of $sp^2$-bonded carbon atoms that are packed densely having a honeycomb shaped crystal lattice.
Figure 32A:
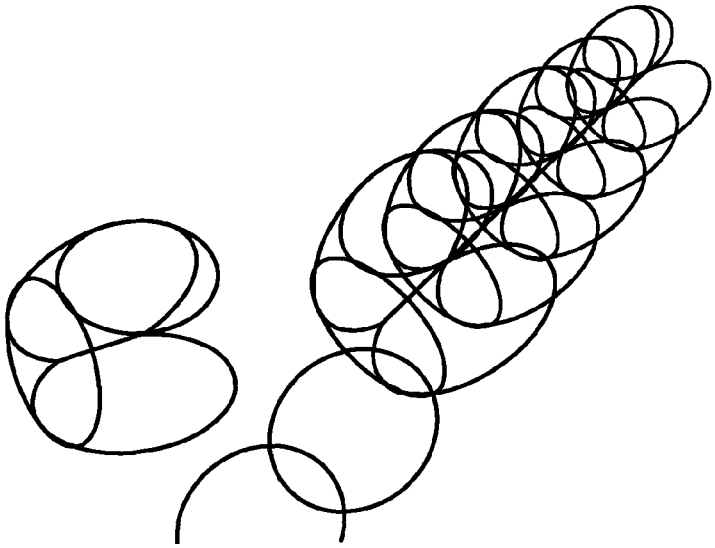
FIGS. 32A-32D illustrate, as examples, reinforcement "cubes" having six faces having overlapping reinforcement "cubes" with as few as four ringed-faces. As an example, but not limited to unitary many possible manufactured reinforcements configurations.
Figure 32B:
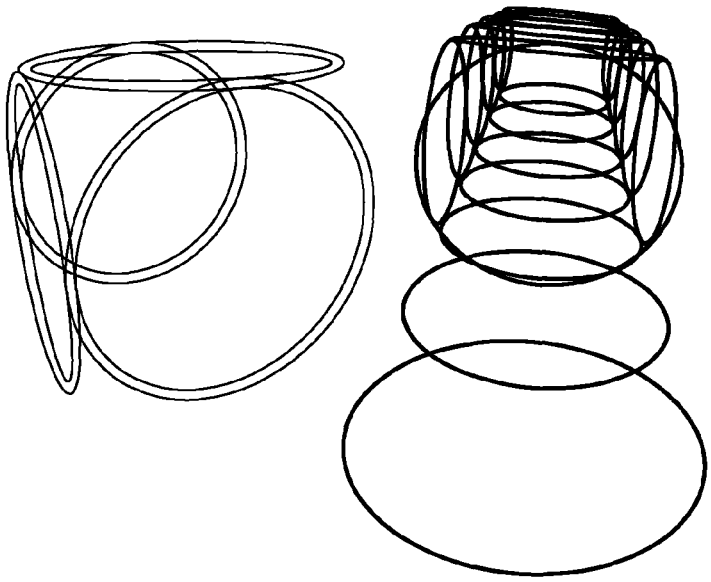
Figure 32C:
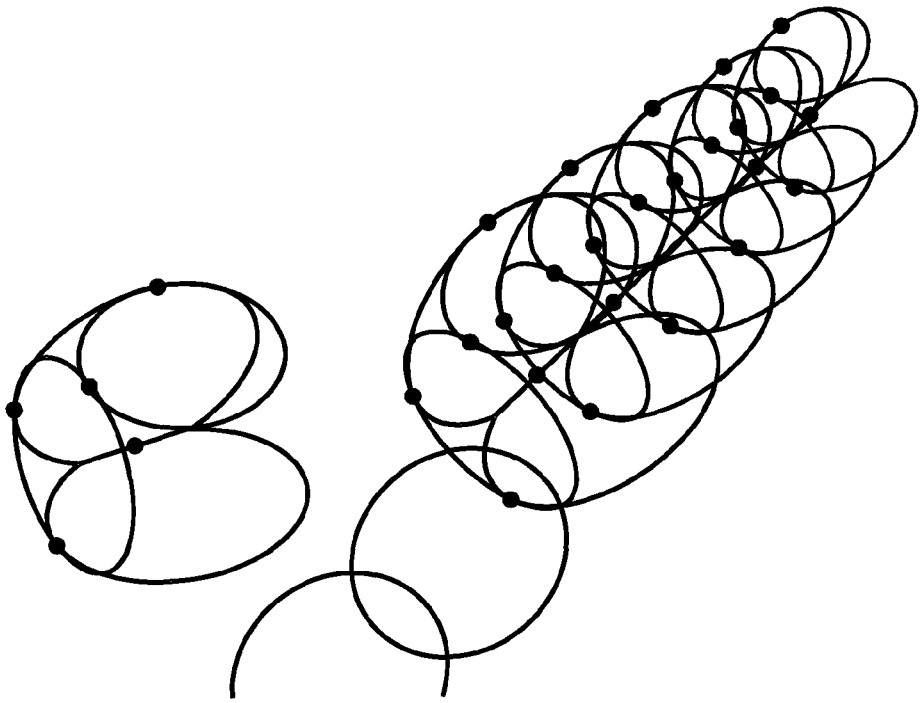
Figure 32D:
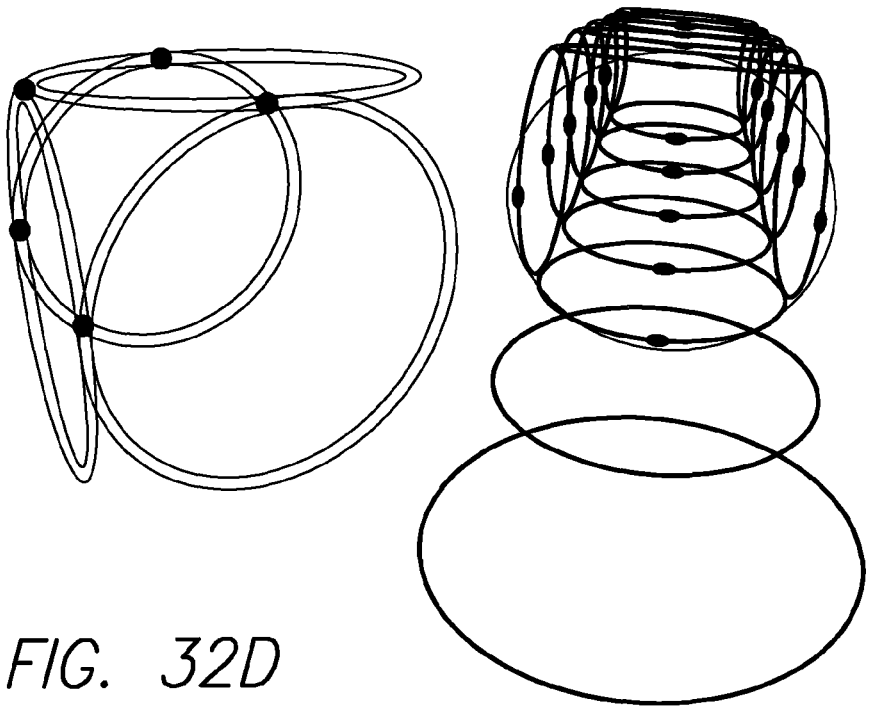

FIG. 30 illustrates a additional example of having efficient "rings" "coils" surface deformations or patterns in three dimensional "rings" configurations. The structural bond may be configured by overlapped rings which are suitably embedded in molded plastic and or resin materials as stated herein additionally. A 3-Dimensional reinforcement modular filler or bonding structure(s) as for example maybe formed by overlapping 3 Dimensional "rings" "coil" reinforcement(s) in apparatuses or components as needed.

Additionally, having versatile structural reinforcement in arrays or configurations of the current invention such as modules (to be embedded in the composite material). As for example, cubical geometric form having overlaps can be achieved by a suitable draft angle, which interlocks and nests the cubical and/or curvilinear reinforcement units together. These unit "cubes" may overlap more densely than as illustrated to obtain very dense, reinforcements when necessary or required such as but not limited to high or ultra high performance safety helmets such as motorcycle and ballistic helmet.

The term grapheme as used herein is an allotrope of carbon, having a structure that is one-atom-thick planar sheets of $sp^2$-bonded carbon atoms that are packed densely having a honeycomb shaped crystal lattice.

Such as but not limited to, and is a basic building block for a wide variety of graphitic materials and dimensionalities such as but not limited to a wide variety of "coils," "loops," "rings," "nets," "meshes," and "weaves" and other configurations as needed. Such as wrapped up into 0D fullerenes, and rolled into 1D nanotubes or stacked into 3D graphite etc. Graphene is a highly conductive single carbon layer of the graphitic structure can be considered as the final member of the series such as but not limited to anthracene, coronene, naphthalene etc. additionally the term graphene may be used to designate individual carbon layers in graphite intercalation compounds. Use of the term "grapheme layer" as used here in maybe considered for the general terminology of carbons. Note: the graphene substance was discovered to be present in ordinary graphite in 2003. Additionally, graphene has greater electron mobility and is more efficient heat dissipation than silicon, thus enables the continuation of Moore's Law. Note: several researchers have discovered several methods of manufacturing graphene substances.

As an example, reinforcement "cubes" having six faces having overlapping reinforcement "cubes" with as few as four ringed-faces. As an example but not limited to unitary many possible manufactured reinforcements configurations such as in the noted illustrations. A lightweight helmet(s) composed of reinforcement carbon fibers or filament and its variants etc. as described herein such as incorporating into the inventive face guard coiled "rings" "loops" reinforced frames, made with filler or bonding composites or plastics or metals as needed depending upon the application.

In several specified embodiments that the inventive reinforcements may be suitably positioned and secured and cast together for reinforcing the lesser composites. The "ring" faces comprising one reinforcement module (or cube) may be pre-engineered and manufactured, such as but not limited to continuous bar, rod, cable, wire, or filament(s) etc. as needed. As an option, having consecutive flat "loops" that are twisted at orthogonal junctures for positioning adjoining "loops" "coils" at intersections as needed and may vary for different attenuation reinforcements and applications as needed. In a specified embodiment encompasses that the ends of the reinforcement members "loops" "coils" may extend their "coils" looping, or preferably they have hooked and or coiled ends as needed.

In other specified embodiments encompasses for having economic advantage, the lesser reinforcement material can be used for terminal anchoring, contained within each reinforcement unit as needed. In a specified embodiment encompass a method aspect for computer controlled bending and twisting a wide variety of attenuating reinforcements configurations that preferably allows accurate cubic scaling for manufacture of a wide variety of reinforcement "loops" "coils" in a wide variety of reinforced safety helmets.

Figure 33:
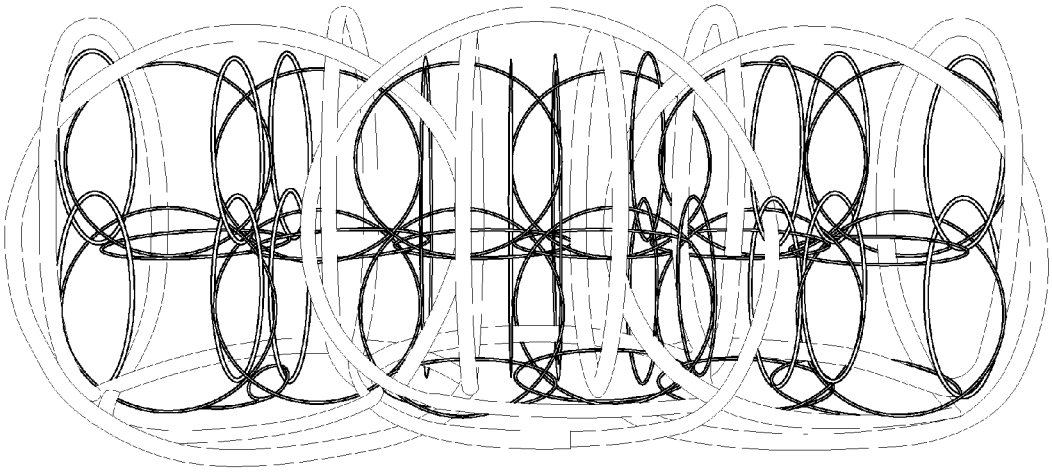
FIG. 33 illustrates employing inventive annular reinforcement having enhanced impact recoil attenuation control and characteristics such as in applications in a wide variety of safety helmets. As a further example, the cubes may be "rings" forms in long, self interlocking intersecting chains.

FIG. 33 illustrates one of many possible configurations for scaled "ring" "loops" reinforcement having a wide variety of geometric cages. Employing "rings" "loops" that are scaled preferably, having overlapping each row to form a series of modular reinforcement "ring" "loops" cages. Note the state of diminished "ring" density along the structure edges. As an option, attenuation compensation may be designed and manufactured such as to increase the edge reinforcements preferably at or near surface strengths. FIG. 33 illustrates how employing diminished ring density may be incorporated having smaller rings positioned near the surfaces. As an option, the 3D dimensional attenuating "meshes" may be "woven" or configured such as by overlapping individual cube rings as illustrated in FIG. 33.

Figure 34:
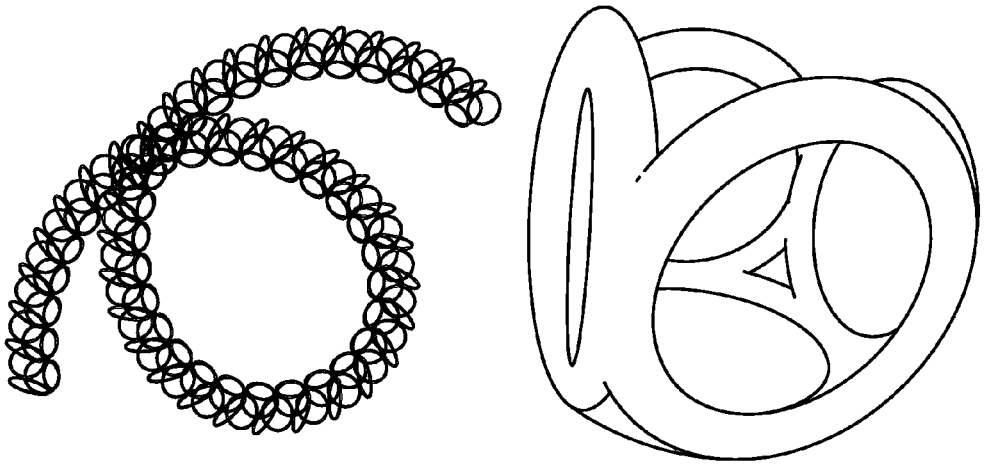
FIG. 34 further illustrates 3-Dimensional chain or bridge configuration as a further example, the cubes may be "rings" forms in long, self interlocking intersecting chains.
Figure 35A:
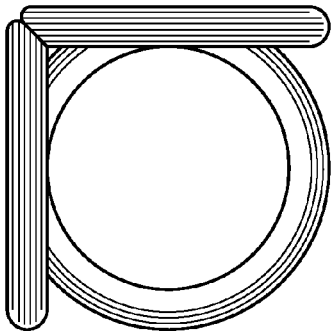
FIGS. 35A-35D illustrate further, a series of "ring" "coil" interfaces or junctions that may be employed. A key object and advantage of the current invention is employing the methods and apparatus of "ring" "coil" reinforcement(s) is having shared shell volumes, (volumes of the bulk "ring" "coil" material or in this illustration example of efficient engineered composites).
Figure 35B:
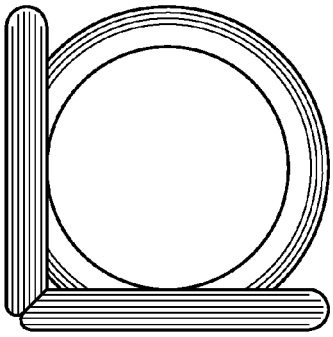
Figure 35C:
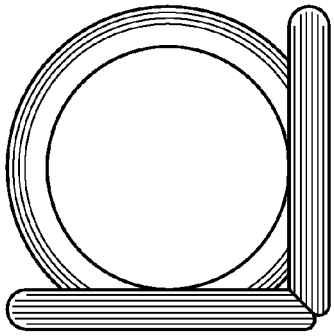
Figure 35D:
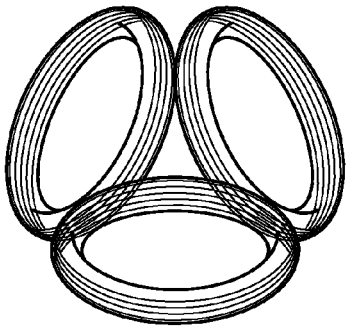

Additionally, the 3-Dimensional chain or bridge configuration in FIGS. 33 and 34 illustrate employing inventive annular reinforcement having enhanced impact recoil attenuation control and characteristics such as in applications in a wide variety of safety helmets. As a further example, the cubes may be "rings" forms in long, self interlocking intersecting chains. A reinforcement attenuating structure of this type preferably is made with extremely durable and high strength composites such as polypropylene, Kevlar®, carbon composites, preferably composed of graphene or its variants or as needed.

Additionally modeling subdivisions having a wide variety of possible "rings" and or "coils" fusion(s). As a further example, three "rings" or "coils" are illustrated to show multiple reinforcement "rings" or "coils", such as circling the outer portion of "coils" "rings" having the advantage that the inner-circumference of each "ring" requires less reinforcement having enhanced 3-dimensional impact recoil attenuation control and characteristics due to having the advantage of previously unavailable compressive function(s) of this inner void or zone. Therefore the inventive reinforcement(s) is preferably positioned near the outside helmets surface or the inside surface or optionally the inside surface where it is most efficient and required. As an option the "rings" or "coils" can configured in a weave orthogonally to encircling all the bulk "rings". In several exemplary embodiments encompasses methods and apparatuses having an innovative advantage of reinforcing 3Dimensional "cube" "rings" or "coils" is to leverage the tensile strength advantages upon a compressive space. Having the inner "ring" or "coil" volume of filling with filler or bonding plastic(s) resin(s), without the central bulk, (without a filled "aperture hole"), that encases the necessary and significant reinforcement structural framing. The ("large aperture holes") additionally having mass/weight savings and potentially having cost savings.

As a further example, a series of "ring" "coil" interfaces or junctions can be employed. A key object and advantage of the current invention is employing the methods and apparatus of "ring" "coil" reinforcement(s) is having shared shell volumes, (volumes of the bulk "ring" "coil" material or in this illustration example of efficient engineered composites). The reinforcement "rings" "coils" preferably penetrate and are secured orthogonally through adjoining reinforcement rings. Note the "ring" segments allow for ease of attachment and securement, as in contrast to the prior art use of woven filaments which cannot easily interpenetrate intact. "Coil" "ringed" "meshes" more easily interpenetrate, and conjoin (secure) as for example but not limited to by manual labor and may also be adapted to robotic manufacture or rapid prototyping manufacturing assembly etc. Thus additional attenuation "effective rings" result in additional attenuation efficiencies from within the joined or overlapping zones as needed.

Figure 36A:
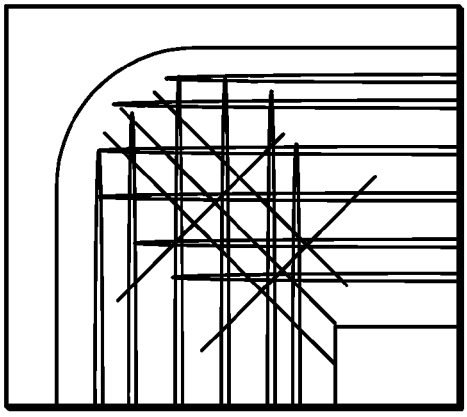
FIGS. 36A-36C illustrate, as an option, an additional application of smaller "rings" that preferably are orthogonally positioned and may be placed to reinforce the shared shell zones as needed.
Figure 36B:
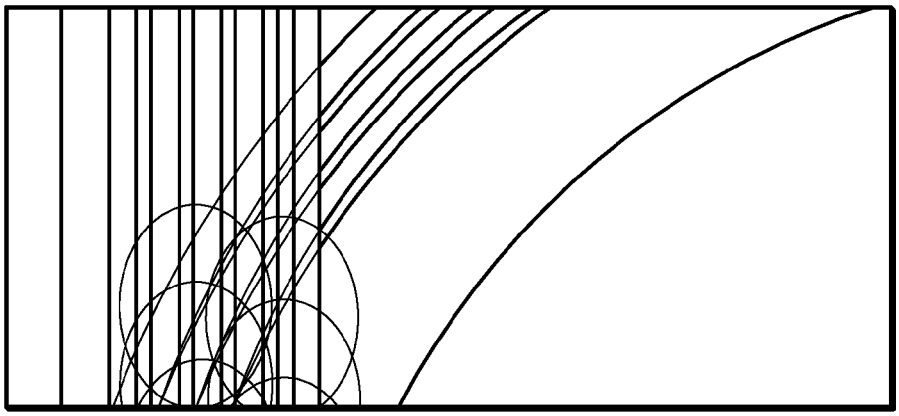
Figure 36C:
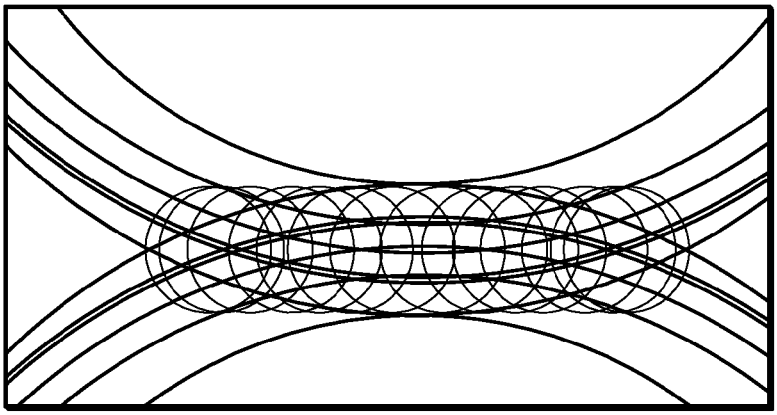

As an option, as illustrated in FIG. 36, additional application of smaller "rings" preferably are orthogonally positioned may be placed to reinforce the shared shell zones as needed. These smaller "rings" must sufficiently pervade the "zone" to help sufficiently resist shearing and other highly complex impact forces. As for example the external tension stresses transfer are conducted (guided) along the larger primary attenuating "rings" present a delaminating potential when subject to sever impact which may effectively be attenuated or "arrested" by employing smaller "ring" "coil" reinforcement apparatuses in a variety of pre-engineered locations and a variety of configurations as needed depending upon the application.

As an option, the individual "rings" as for example generally are in flat or round "rings" "coils" are wound around the "main" reinforcement "rings," to provide more complex attenuating reinforcement preferably positioned and secured at the larger reinforcement junctions. Having these and other objects and advantages of "ring" "coil" reinforcement attenuating apparatuses(s) of the current invention.

In other specified embodiments encompasses impact attenuation and displacement characteristics having improved characteristics are obtained by having pre-engineered overlapping distances of the annular "rings" such that, the stresses at junctions are distributed along the said "rings" "coils" as for example. Instead of localizing the ring junctions to a single point at (its intersection), the junctions impact recoil attenuation control apparatus having characteristics are thus more efficient and reflected and thus returned and are thus diffused more broadly as is needed in the art. The more broad diffusions of this highly complex impact stress force will therefore have the inventive advantage of not presenting compounded stresses at one single point along a reinforcement member or members. Thus any point of greater stress, within the composite(s) can receive stronger composites such as a wide variety of face guards or as needed.

Figure 37:
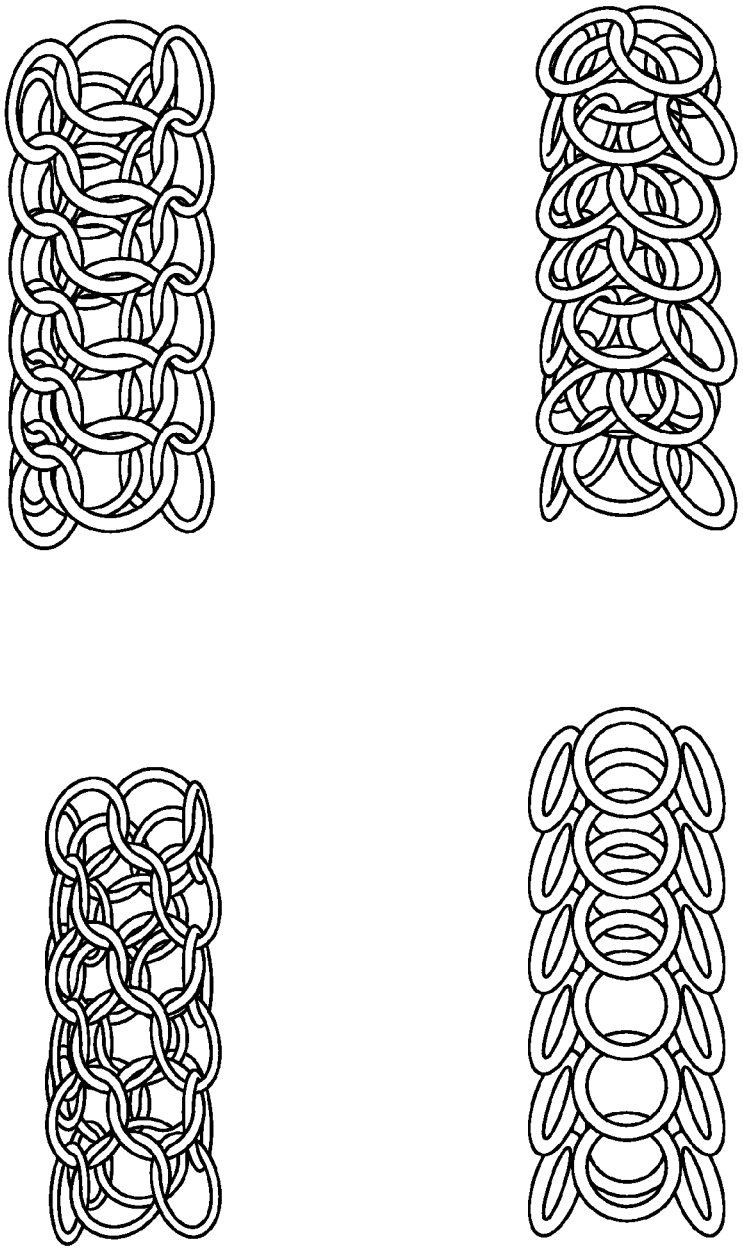
FIG. 37 illustrates an example of many triangular-ring reinforcement(s), which can be compared with this cubic form, having further advantages on the basis of equal total weights and spans (such as ballistic helmets and body armor and body armor plates and face guards).
Figure 38:
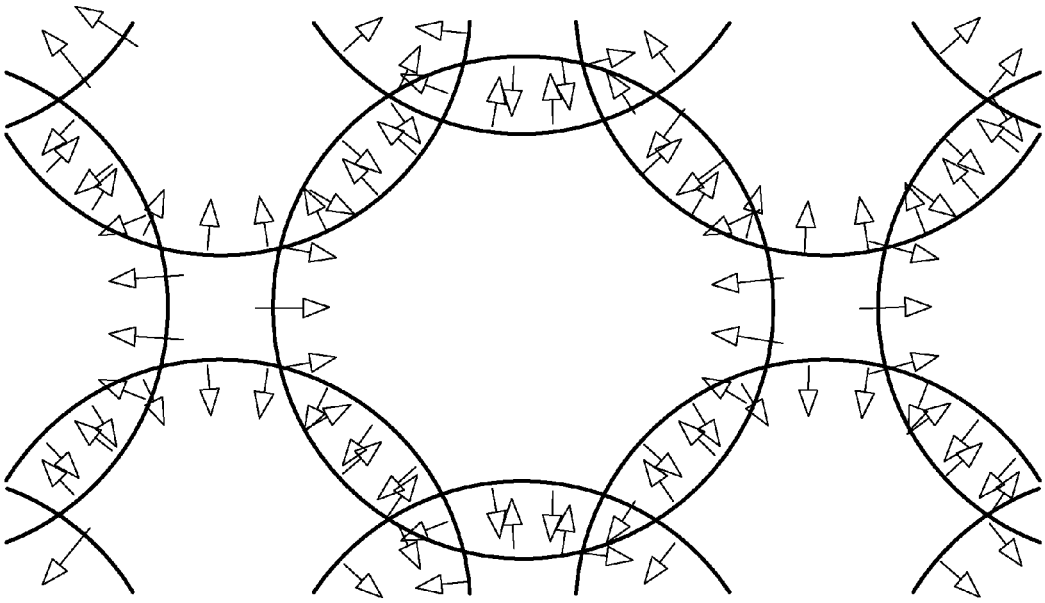
FIG. 38 illustrates additional attenuating reinforcement geometries ranging from simple to highly complex geometric configurations such that the "rings" "coils" may be configured as needed.

FIG. 37 is an example of many triangular-ring reinforcement(s), which can be compared with this cubic form, having further advantages on the basis of equal total weights and spans (such as ballistic helmets and body armor and body armor plates and face guards) as an option or additionally, may be configured in polygonal configurations such as but not limited to six sided or hexagonal forms of (hex rings) reinforcement(s) is illustrated herein to compare one of many possible additional geometries for material selection(s) as required for specific reinforcement applications and performances as needed.

Furthermore depending upon the specific application there are many possible attenuating reinforcement geometries ranging from simple to highly complex geometric configurations such that the "rings" "coils" may be configured as needed. Such as but not limited to polygon/pentagon geometric configurations having surface or 3-Dimensional configurations and other possible geometries for a wide variety of safety equipment and helmet applications.

As an example, this framework illustrates a complex reinforcement apparatus to be cast in place in safety equipment and helmet(s) or other manufacturing process as needed.

As an example, the generally "O" shaped "rings" "coils" (annular apparatus reinforcement) may also have additional significant reinforcement and attenuation characteristics. As an example, a manufactured helmet(s), which could become readily accepted and easily tested in the safety helmet industry, may be an "O" "ring." The dimensions and configurations of such "rings" "coils" could vary in a manner equivalent to and sizing as needed or required, such as by employing multiple sizes of "rings" "coils" and casting (encasing) in place with filler or bonding plastics or resins to improve its strength and other characteristics. Such "rings" "coils" may be composed of and manufactured using strong plastics and other materials such as but not limited to polypropylene, glass filaments, carbon Kevlar®, or a wide variety of suitable metals, as known in the art.

Additionally the "O" rings may be manufactured by a variety of extruded processes through methods' and apparatus known within the art. As an example, direct extrusion of the "rings" or "coils" may potentially save the prior art conventional step of wire manufacture. As for example, "coil" "ringed" extruding methods known within the art may be a hollow extruded member shortened depending upon the application to provide accurate and consistent diameters and radii as needed such as donuts or torus(es) or as needed.

As a further example of reinforcement geometric configurations, of the annular "rings" "coils" may be configured with X, Y & Z axes, optionally may be joined at six intersections. The "rings" "coil" may be configured and manufactured in a wide variety of arrayed matrices and cast in place (stabilized) by a variety of plastics and resins known within the prior art. As an option, the "rings" may be joined by joining bridging interlocking "rings" or the like, in triplet-XYZ or ABC formed prior to the manufacturing process.

The inventor theorizes a synergy of a generally curved, oval, ovoid, hemispheric curvilinear shape for construction/manufacturing processes such as manufacturing a wide variety of safety equipment including helmets, encompasses a combined manufacturing method(s). Having the advantages of each of these materials and methods are synergistically manufactured. The inventive "rings" "coils" reinforcements configurations is an innovative improvements of safety helmet(s) having enhanced reinforcement impact recoil control and previously unavailable attenuation characteristics. The specific reinforcement(s) and components specifications may vary as needed depending on specific use and availability of materials and depending upon the application. In some specific applications, the apparatuses and methods of the current invention may fit within the conventional "monolithic" helmet definition.

Figure 39:
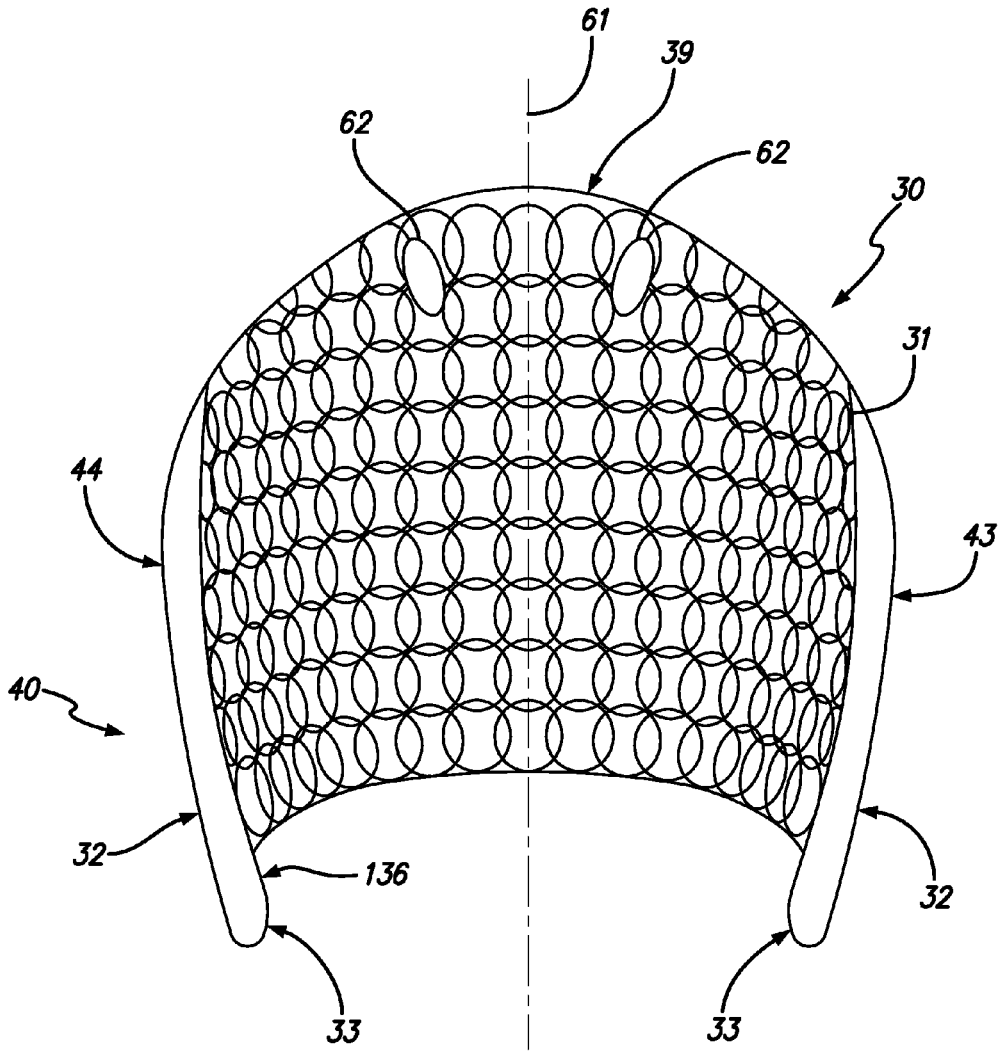
FIG. 39 further illustrates a position of "rings" used as reinforcement in a football safety helmet for use of "mesh," "woven," "nets" for reinforcement of helmet shells.

FIGS. 20 and 39 illustrate a position of rings or coils 300, used as reinforcement in a helmet FIG. 2A. It is contemplated and intended to be within the scope of the present invention that any type of rings or coils disclosed herein may be used. In addition, any type of weave, mesh, or net may be used, also of the type disclosed herein. Such rings, coils, weave, mesh, or net may comprise continuous, fixed linkage between elements. Rings or coils 300 may be a series of linked rings or coils, and the series of linked coils may be arranged in overlapping rows to form a curved plane that is generally parallel to the curved plane of the inner surface of the helmet shell 31. FIGS. 20 and 39 show a cutaway view of a preferred embodiment of the present invention, in which the rings or coils 300 are exposed and shown positioned adjacent or proximate the inner surface of the helmet shell 31. Filler or bonding material (of any type disclosed herein, including but not limited to resin or plastic) is used to entirely or partially encase the rings or coils 300, to form a reinforcement layer that is positioned adjacent or proximate the inner surface of the helmet shell 31, as will be understood from FIGS. 20 and 39. The shell 31, together with the reinforcement layer, are combined to form a basic helmet assembly. The amount by volume of filler or bonding material used to encase the rings or coils 300 may be about the same on either side of the curved plane of the series of linked coils, such that the curved plane of the series of linked coils is located in approximately the middle of the reinforcement layer. Alternatively, adjustments can be made as to the amount of filler or bonding material that is used on either side of the rings or coils 300 (or to the position of rings or coils 300 themselves), such that the rings or coils 300 may be closer to, or farther from, the middle portion of the reinforcement layer. Weave, mesh, or net material also may be used in place of, or in conjunction with, rings or coils. The patterns and arrangements of the rings, coils, weave, mesh, or net may be any disclosed herein (or known to those of skill in the art), including but not limited to those patterns and arrangements shown in FIGS. 22 through 38 and FIGS. 41 through 52. The materials used to form the rings, coils, weave, mesh or net may be any disclosed herein (or known to those of skill in the art), including but not limited to metal, steel, micro tubes, carbon steel, alloy steel, stainless steel, tool steel, Kevlar®, polypropylene, or graphene.

Rings or coils 300 may also comprise "untied" rings as an option or as an alternative. Also, the rings, coils, weave, mesh or net may be configured to provide a laminated structural reinforcement apparatus that ranges between 1 to 10 laminated layers or base on which to "apply" the binding resin(s) (as shown, for example, in FIGS. 44-50. The use or rings, coils, weave, mesh, or net combines previously unavailable inventive methods and the apparatus having "coils" "rings," (one nonlinear row at a time). However, the "rings" may use a much wider selection of plastics or resins that economically improves the ultimate strength and having enhanced impact attenuation control characteristics for the helmet(s) in an exemplary embodiment encompasses that this inventive synergy allows previously unavailable methods and apparatus and materials is the employment of micro-"rings" "fibers", "meshes" "nets" as the choice(s) of reinforcement(s) and apparatus. The methods and apparatuses of the current invention encompass a wide variety of scales of implementation for a wide variety of enhanced impact attenuation control characteristics and applications as needed.

FIG. 39 is an illustrative embodiment encompassing "Compressive Chain" (FIG. 39), "rings" or "coils" sufficiently overlap to provide enhanced recoil attenuation zones which overlap. The compressive units of embedded filler or bonding plastics and or resin(s) binds the overlapping reinforcement "rings" "coils" into an impact force attenuating apparatus. This innovative apparatus, produces and obtains an extension of the tensile range and strength over the entire reinforcement(s) surface(s) or near surface of the constructed helmet(s). This is an object of the invention.

The pre-engineered overlapping of "rings" "coils" in a helmet(s) shell or body transmits the tensile properties of reinforcement from one "ring" "coils" to the next. Particularly in compound curves such as safety helmets, note that this is a significant innovation, since "mesh" and "netting" is generally planar, (it cannot easily be elastically formed in generally curved shapes without kinks, which may cancel out the primary tensile property). Additionally compound curves having other structural advantages such as reducing the surface area required to enclose a given volume or space. Thus through "recoil" "rings," "coils" technology having synergy and curvature, cost may be advantageously reduced such as in reinforced safety helmets. This is an object of the invention.

Employing the methods and apparatus of the current invention "rings" "coils" in the form of compressive linkage configurations for attenuation reinforcement having "rings" "coils" is new, only in that the inventor has not noticed this particular approach of reinforcement and impact and shock, recoil control reduction and attenuation characteristics in safety helmets published, nor discussed, nor suggested previously.

Advantages over the prior art safety helmets are: 1) ease of placement or annular reinforcement; 2) less filler or bonding plastic or resin including micro-shrinkage during curing phase; 3) unrestricted curvilinear helmet shapes and sizes; 4) lighter helmet(s) shell practicalities; 5) use of rawer material, hence savings through local economies; 6) combined monolithic-structure and finish process in a one continuous manufacturing step; 7) address and reduces a wider range of impacts over the prior art; 8) lighter weight to strength ratio, and 9) ease of casting with resins including micro-fibers and micro-"coils".

The advantages over "mesh" "net" formed reinforcement include: 1) ease in encapsulation thorough filler or bonding resins (cement) coating all "ring" "coil" reinforcement surfaces. By contrast, generally the penetration of plastics and resins through overlapping meshes is more difficult. 2) "Meshes" and "nets" costs more industrial effort (time) to manufacture. "Rings" "coils" configurations may be efficiently mass-produced, or as an option or alternatively in contiguous flat wire coiled spirals. 3) Shipping, and mass handling of "rings" "coils", rods or wire is simpler than restrictively sized mesh products. 4) Reduces and suppresses wider range of impacts having previously unavailable controlling characteristics than the prior art.

In other specified embodiments encompass methods and apparatuses that operate on different principles. In other specified embodiments, the current invention encompasses a wide variety of O.D. sizes (outside diameters) of "rings" "coils" apparatuses (spacing). In a specified embodiment encompass a method and apparatus such that smaller "rings" "coils" may replace some of the filler or bonding and filling resin(s) (filler) as an option or alternative "rings" "coils" designs may employ several "ring" sizes and layers, or if necessary for denser coverage of "rings." Denser "ring" coverage (or more rings per unit of area) may require "rings" having thicker or thinner gauges reinforcement(s) as needed.

The use of reinforcement materials, such as plastic(s) carbon fibers, fiberglass or other high tensile strength materials is encompassed by the current invention including other composite materials that are suitable for a wide variety of safety equipment including helmets.

In an exemplary embodiment encompasses that the inventive methods and apparatus is that: high tensile "rings" "coils" reinforcements may be combined with the low cost compressive "filler" material(s), such as plastics and/or resins; as an example, the "rings" may be "chained" by compressive linking instead of by tensile continuum. Therefore a new inventive apparatus and methods of "compressive transferring and chaining" is encompassed in this disclosure herein and having the advantage of less/weight/mass.

In a specified embodiment, the "recoil" "rings" apparatuses may be sized and dimensioned and combined to suit a wide variety of transportable safety equipment applications as needed including modular helmets and drop jaw helmets.

The current invention encompasses using a wide variety of "mesh" "net(s)" patterns known within the art. The inventor theorizes that potentially the helmets having a longer operating and shelf life over the prior art safety helmets. As separate and distinct from the prior art and provides a wider range of impact attenuation and displacement characteristics and having inventive and unique reinforcement geometries. As a non-limiting example, the overlapping reinforcement loops "coils" "rings" may be configured to overlap ranging between one to ten overlaps or as needed four or five overlapping "hoops" being most preferred, that encompasses a wide range of filament diameters (gauges) as needed. The prior art football and other safety helmets does not employ efficient reinforcement, generally only having woven filaments in motorcycle helmets having configurations (that does not employ recoiling patterns) or other efficient attenuating geometric patterns.

In other exemplary embodiments encompasses that the "rings" "coils" provide a previously unavailable characteristics having a higher percentage of compression impact attenuation transfer as compared to the prior art's tension transfer.

In a specified embodiment, the current invention further encompasses non-interlocking loops to suit a wider variety of reinforcement and linking applications.

FIG. 22 illustrates one of many possible "coil" "loop" reflective configurations encompassed in the present invention. The inventive recoil "rings" "coils" or other possible geometric reinforcement configurations having a wide variety of sizes, gauges and surface engagements or surface patterns may be pre-engineered and preferably optimized, such as in "coils," "loops," through other testing procedures and calculations known within the art.

The "mesh" or "nets" apparatuses employed in the current invention methods for 3-dimensional impact force attenuation preferably encompasses a variety of surface patterns or deformations as needed.

In several specified embodiments, the helmet(s) encompasses enhanced impact and recoil attenuation having improved control characteristics unavailable in the prior art.

Furthermore, this invention relates to safety helmet(s) in general and as well as to improved methods and devices for reducing the consequences of other impacts having enhanced attenuation characteristics and further improving performance in safety helmet(s). In a particular embodiment, the device(s) relates to the control or management of the 3-dimensional impact(s) including the highly complex impact and recoil forces for a wide variety of safety helmet(s). Such as the impacts incurred when playing a wide variety of sports including football that the encountered impacts waveforms induces various side effects that have been proved detrimental. Impact control operations have traditionally been ignored or overlooked particularly in football helmets. A common but unsatisfactory features among all these prior art safety helmets "mechanisms" is that they do not prevent the wide range of undesirable side effects encountered during the normal course of use or play, which accounts for a wide variety of short and long term injuries and adverse side effects encountered when playing football.

Thus, the mechanisms found on current helmet(s), although reliable and widely employed, nevertheless suffer from a number of limitations and deficiencies. For example, limitations of the prior art such as in motorcycle helmets is employing incomplete use of woven mesh reinforcement and its incomplete placement and lack of complete coverage only at the critical stress zone (is not positioned in the primary impact or stress areas or zones).

And does not employ significant reinforcement or efficient acceleration effects (guided stress transfer) and is unaware of that "coils" "rings" provides a higher percentage of compression transfer as compared to tension transfer. As an example, the prior art employs none of or inefficient reinforcement geometries, generally using woven filaments in configuration (that does not, employ the current invention's recoiling attenuating patterns) or other attenuating geometric patterns. Additionally, generally football helmets do not employ any significant force attenuating apparatuses nor having materials and/or layers nor having impact attenuating guiding/directing and/or transferring displacement and recoil stress transferring apparatuses and characteristics and do not employ any synergistic combinations of reinforced safety helmet shell having synergistic impact stress transferring characteristics that synergistically transfers to and from the inventive attenuating multilayer memory foam pads as stated herein.

Figure 40:
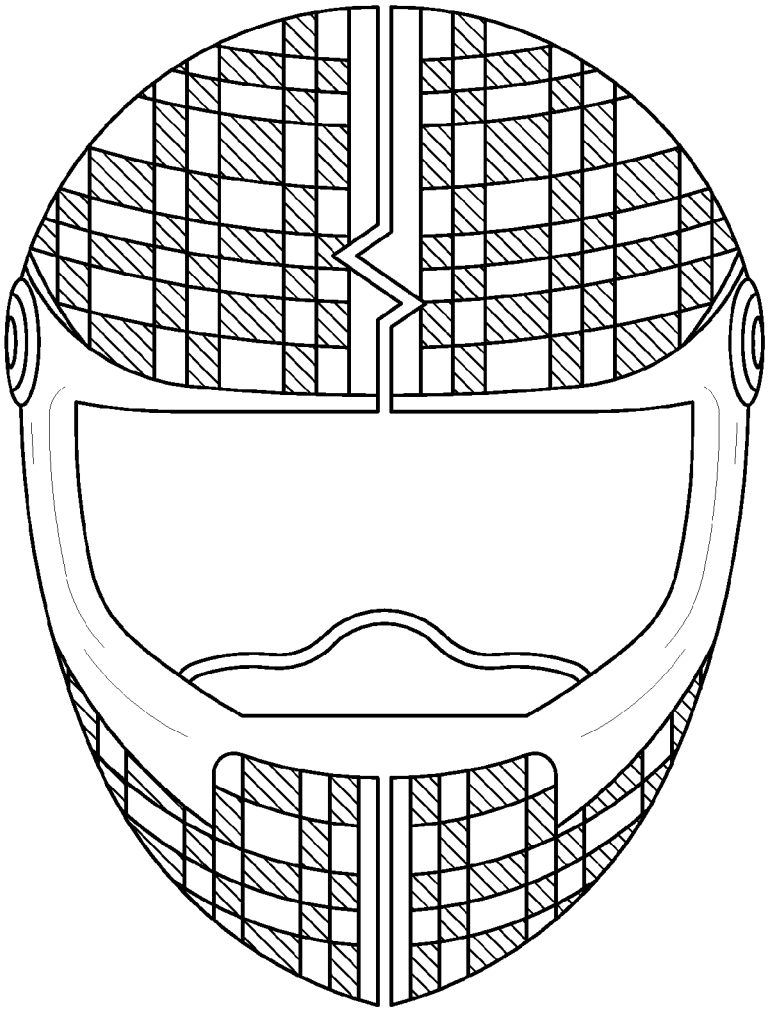
FIG. 40 PRIOR ART
FIG. 40 illustrates prior art motorcycle safety helmets.
Figure 41A:
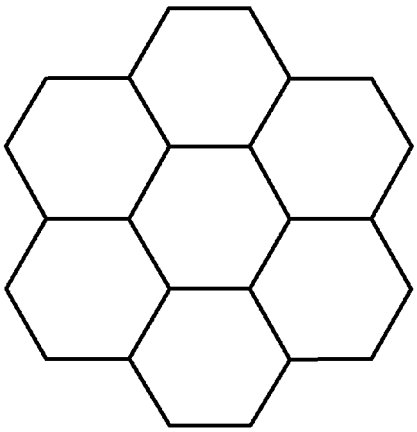
FIGS. 41A-41D illustrate the four most preferred examples of the inventive "net," "mesh" reinforcement attenuating configurations.
Figure 41B:
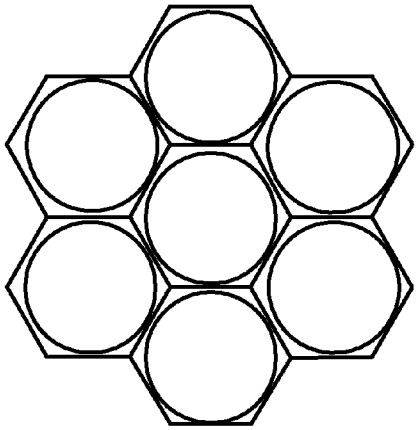
Figure 41C:
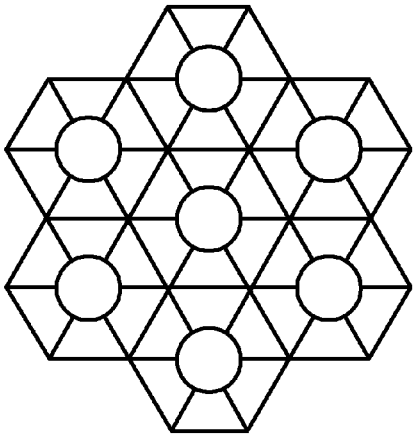
Figure 41D:
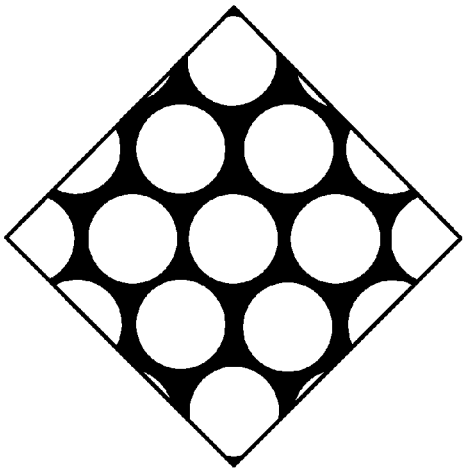
Figure 43A:
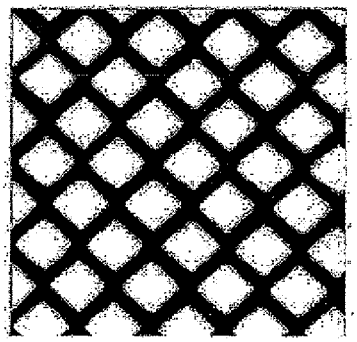
FIGS. 43A-43D illustrate four examples of the many possible "mesh," "woven," "net" geometric reinforcement configurations that may be used in the current invention to produce impact attenuation control characteristic(s) as stated herein.
Figure 43B:
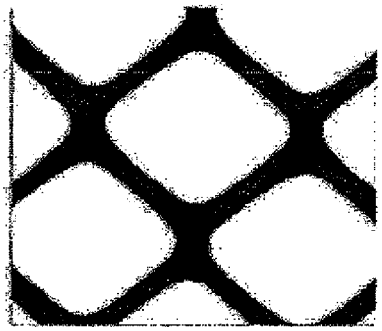
Figure 43C:
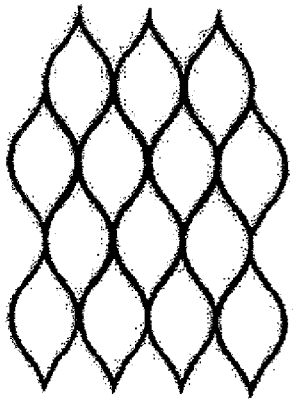
Figure 43D:
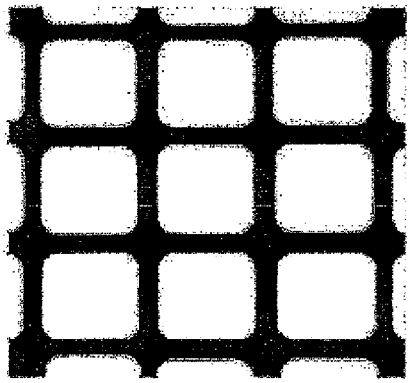

Furthermore, the inventor theorizes that the annular or helical reinforcement geometries of the inventive apparatuses encompassed herein will economically outperform purely linear shaped reinforcement configurations such as used in the prior art cost prohibitive motorcycle safety helmets as illustrated in FIG. 40, and may further potentially benefit through manufacturing and labor reductions and may also have other advantages and benefits through the inventive resultant efficiencies.

Some prior art motorcycle helmets only having carbon and/or Kevlar® fibers only on a portion of the helmet or only on certain segments and are not conjoined for significant impact stress attenuation as illustrated in FIG. 40.

As an example of the prior arts limitations, as illustrated in FIG. 40, well-known manufacturer of a motorcycle helmet only partially positions and reinforces near the helmet's "critical zones"—thus is structurally incomplete (non-monolithic impact stress diffusion and transfer). A well-known manufacturer of motorcycle helmets only reinforces near critical zones, as seen in FIG. 40, thus is inefficient and is therefore non-monolithic for impact attenuation (stress diffusion and transfer) and thus does not realize the full potential of the Kevlar® or Carbon fiber or other materials. The invention's previously unavailable impact shock attenuation, "recoil" reduction and displacement characteristics improves the overall safety performances of helmets in general and more specifically football helmets. This is an object of the invention.

Furthermore, the current invention potentially reduces safety helmets weight, mass, and improves, and widens the attenuation of impact acceleration and compensation ranges. Furthermore, the current invention overcomes the prior art's limitations, such as high performance motorcycle helmets that almost exclusively employs carbon and/or Kevlar® materials generally having non-monolithic herringbone weave patterns or variations of same.

Additionally, the helmet(s) woven seams(s) may be designed and configured to be (conjoined and/or interlocked) and manufactured (cast in place) to be the "strongest" portion or section of the safety helmet(s). Furthermore, the prior art ignores or is unaware of the different types of safety helmet impact waveforms that produce different types of symptoms, injuries, and diseases.

Furthermore, as the prior art does not consider or ignores that, these and other highly complex impact forces or waveform "frequencies" that need to be reduced and modulated to provide previously unavailable protection from short and long term impacts when wearing a helmet and provides a wider range of impact(s) attenuation and displacement.

The amplitude and magnitude of encountered impact(s) is relatively critical due to its effect on and the existing prior art mechanisms fail to provide a satisfactory or optimized reduction in a wide variety of encountered impacts and the resultant recoil. More particularly, the direction of the impact recoil forces generally coincides with the longitudinal axis of the helmet(s) impacts. For these and other reasons, improvements in the design and operation of a wide variety of safety helmet(s) are desired in the art.

The innovative approaches of the current invention taken herein make a more effective use of the encountered impact(s) energy and, in particular, recycle (and return), as much as practicable, the encountered impact energy or force by departing from the traditional and historical mechanisms. In one aspect, this invention provides new solutions, mechanisms, and systems for helmet(s) and allows previously unavailable revolutionary safety changes and improvements applicable to safety helmet(s) in general including their design and uses.

Taking into account all these adverse and/or secondary effects that impede the use of all safety helmet(s), and the present inventions approaches are new and innovative. In general and in one aspect, the invention is aimed at addressing the design of new safety helmet(s) systems by taking advantage of impact energy attenuation to help improve the prior art helmet(s) and consequently minimize and/or compensate for the wide variety of adverse impact effects encountered and improve safety. A first innovation is the deliberate use of reinforcement and control of impact energy attenuation to address the adverse effects encountered during use and operation. This allows one to conceive of a new helmet(s) design and organization, still dependable, but significantly improved. This new approach also allows a helmet(s) manufacturer and designers to address concerns and constraints as part of whole rather than as individual problems, so as to take into account the advantages and interfaces between helmet(s), face guard(s), reinforcement(s) and attenuating padding systems and other components during their use and operation. Considering the operation as a whole, as this invention exemplifies, allows completely new concepts and expands the universe of designs, manufacturing configurations, and previously unavailable mechanisms possible for safety helmet(s) in general. Additionally, the present invention addresses the problems and disadvantages associated with conventional safety helmet(s), and provides improved controlling methods and devices for reducing a wider range of impact(s) effects in a variety of safety helmet(s), and systems. One aspect of the invention is to reduce the amplitude or consequences of impacts in general.

The invention also facilitates the design and production of a more compact face guard and innovative helmet integration (lower profile) and/or allows reductions in the weight of the face guard and helmet, which results in many new design possibilities and safety improvements in ergonomics. Thus, incorporating one or more of the many aspects of the current invention into a helmet(s) improves operational safety and/or reduces the total profile and weight as needed in the art.

One of the fundamental principles of the present invention is the transfer of encountered mechanical impact and recoil forces to a direction outside of the longitudinal axis of the impact source or sources. As can be seen in each of the exemplary embodiments disclosed herein, the transfer of encountered impact force or forces disperses or dissipates highly complex impact forces and preferably returns and reflects them thereby reduces the moment responsible for a wide range of impacts including the downward jerking characteristic of some conventional helmet(s) impacts. The mechanism(s) that transfers these highly complex forces can be configured and oriented to counteract the impact recoil forces along the longitudinal axis of the reinforcement "coils," "rings," "mesh," or "netting," etc. to effectively eliminate or compensate for the highly complex impact attenuation as needed. This is an object of the invention.

Thus, the portion of the impact forces encompasses reinforcement apparatuses and mechanisms or system(s) of the invention is preferably transferred in a direction outside the longitudinal axis of the impact source and effectively disposed of by being cancelled out, thereby significantly reducing or even eliminating the highly complex components of impact forces along the longitudinal axis of the impact that is responsible for the encountered impact(s). One of skill in the art will recognize that the embodiments disclosed herein are exemplary and that one or more of the foregoing principles can be applied in many variations to safety helmet(s) and other transportable safety equipment(s) as stated herein of various designs, configurations and uses.

In several embodiments of the present invention encompasses that an impact recoil attenuation control devices for use in a helmet(s) comprises. Alternately, the movement of the inertia may have reinforcement components lateral to or perpendicular to the impacts axis of the helmet(s). Such that the reinforcement laterals transfer of momentum substantially reduces the reactive impact forces.

Thus, the reinforcement apparatuses or components as stated herein comprises an impact inertia directing reinforcement guiding component that operates to transfer momentum or forces generated by the impact of one or more impacts to a direction outside of the longitudinal axis of the initial impact. In a more basic aspect, the reinforcement is a component part of a helmet(s), or more particularly reinforcement(s), that in response to the force(s) of impact in response to the movement of an impact(s). The inertia reinforcement unique configuration(s) or masses allows for the highly complex absorption of impact(s) recoil forces and directs those forces in the form of momentum in a direction outside the longitudinal axis of the initial impact(s). Throughout this disclosure, the use of the term "reinforcement" can refer either to a single or to multiple parts or masses. The component masses of the "reinforcement" may optionally serve additional functions not stated herein.

Additionally, such as in a system where the "reinforcement" simultaneously absorbs and transfers the complex 3-dimensional impact "forces" encountered directly through contact with the reinforcement as guiding apparatus and the remaining (waves) to the multi-layered memory pads and/or the face guard attenuating apparatus or vice a versa or any combination. Either directly or through reinforcement linkage system(s) as described herein, and the momentum of the impact(s) is then transferred to the reinforcement as is thus attenuated and dissipated.

In any embodiment, the inertia reinforcement or reinforcements of the current invention serve the same basic function to absorb encountered impact forces and/or re-direct impact impulse forces out of the longitudinal axis of the initial impact "coiled" "looped" return configurations are most preferred.

The inertia reinforcement configurations of the current invention can be pre-engineered (guided) to move along a path defined by its structural pathway or guide. The guide can be a "coil," "hoop" filament(s) mesh or net(s) or articulated part(s), or any other component designed to allow the reinforcement to move the energy to an end point of its movement. And may be configured so that the "movement" of the guiding reinforcement in response to the impact impulse can be one of pure translation or the movement can be more complex in nature. Depending upon application, in other words, there can be a direct connection possible between the reinforcement guiding apparatus and the inertia that causes the movement of the inertia to move the energy along its reinforcement guide(s), or there can be a inventive linkage, such as "rings" and "coils," or there can be more complex linkages, as stated herein such but not limited to as multiple "rings" "coils" and/or articulated parts and manner of their linkages. Preferably having impact attenuating guiding/directing and transferring displacement and recoil stress transferring characteristics to improve impact attenuation. As an example, acceleration effects (guided stress transfer) such linkage "rings" "coils" provide a higher percentage of compression transfer as compared to tension. More specifically having improved surface accelerations and stress transferring characteristics. In a specified embodiment, the current invention further encompasses employing non-interlocking loops to suit a variety of interlocking reinforcement applications. That may encompass a wide range of filament gauges (diameters) to suit a specific application as needed.

In other specified embodiments encompasses the helmet(s) adjoining seams(s) may be interlinked and designed and configured and manufactured to be the "strongest" and most reinforced attenuating portion of the safety equipment, including helmet(s).

The inventive joining and (wave) transferring linkage, may be hooked, or interlocking "rings" or "ringlets," and may be configured in a wide variety of tubes and micro tubes on/in the form of micro "rings," "coils," "fibers," or filaments as needed depending upon the application.

Preferably, in a method aspect encompasses overlapping "reinforcements," or layers preferably located and centered over the adjoining sections or "seams" and/or preferably the more critical "impact zones," i.e., such as over the helmet(s) ears and the forehead sections.

Thus, the overlapping and/or shared reinforcement(s) sections now provides the strongest portion of the safety helmet(s), such as modular helmets including drop jaw helmets and may simultaneously reduce weight, mass, improve, broaden acceleration compensation ranges including modular helmets additionally including drop jaw helmets The "recoil" "rings" may be sized and dimensioned to suit a wide variety of safety helmet applications as needed.

Preferably the terminating of the "rings" "coils" with hooks and or coils is preferred.

In an exemplary embodiment encompass methods and apparatus such that the degree of phase displacement is a matter of the helmet(s) design option, but some degree of phase displacement is preferred. Of a wide variety of portable impact reduction systems, as described herein.

In several specified embodiments encompass that in combination with the use of one or more geometric reinforcement configurations such as in a variety of lamination processes, a number of improvements in design, weight, accuracy, and impact "recoil" characteristics as needed are possible.

In an illustrative embodiment of the current invention (as illustrated in FIGS. 41A through 41D), the four most preferred examples of the inventive "net," "mesh" reinforcement attenuating configurations are shown. Note that the illustration only shows four of many possible configurations within the current invention.

The impact control devices guiding reinforcement(s) of the current invention components can be advantageously prepared with comparatively small parts or components or larger pre-manufactured reinforcements components, which simplifies manufacture.

The mechanisms and aspects of the invention can be used to complement or improve a wide variety of existing or conventional shaped safety helmet(s) and can be combined with various arrangements, attachments, and combinations as needed.

In one general aspect, the invention comprises improved and novel impact attenuation control methods and device(s) for use in (a) safety helmet(s), having a component, or force distribution or vectored force attenuation component(s).

In an exemplary embodiment encompasses that the forces transferred to the inventive reinforcement guiding apparatus as stated herein can be selectively directed in any one or more of several directions as needed therefore traverse one or more of a variety of paths from the impulse imparted through the reinforcement guiding geometries, including, but not limited to: a recoil curved or curvilinear path; a controlled path extending outward from the impact zone; the path chosen relates to the design characteristics of the helmet(s), or other transportable safety equipment as stated herein as desired.

In a specified embodiment encompasses that the controlled inertia reinforcement configurations are preferably mass appropriate for a particular safety helmet(s) relates to the design characteristics of the safety helmet(s) as needed.

In a specified embodiment encompasses that the transfer of the impulses of impact from the reinforcement to the inertia reinforcement guide can be through direct contact between the two parts having simple or even complex linkages. As stated herein, in other specified embodiments, one or more reinforcement assemblies may be used. In other embodiments, one or more overlapping reciprocating "coils" "rings" apparatus may provide additional reinforcement as needed.

For example, as illustrated in FIGS. 42A through 42C, a wide variety of annular/spring "coils" "rings" having reinforcement configurations can be adapted for this purpose. As an example, return or recovery attenuating "coils" "rings" having reinforcement characteristics as stated herein can be designed by one of skill in the art.

The inventive impact recoil attenuating control device(s) can be manifested as in one of the numerous figures accompanying this disclosure. Also, numerous embodiments and alternatives are disclosed in the accompanying claims. In another aspect, the invention provides a method for making an impact attenuation control device(s) of the invention and/or incorporating into helmet(s) an impact attenuation control device, or devices as needed.

Other embodiments and advantages of the invention are set forth in part in the description herein, and in part, will be obvious from these descriptions, or may be learned from the practice of the invention.

In one aspect, the present invention in particular allows two or more parameters to be varied:

And as an illustrative embodiment as discussed more particularly herein, the angles formed by the reinforcement(s) mesh(s) and or nets reinforcement configurations such as polygon/pentagon configuration and parts of the reinforcement(s) can be specifically engineered and configured or manipulated to optimize impact forces attenuation, reduction, and other operational characteristics in a variety of safety helmet(s) styles and sizes. Control or variance of such complex factors is not typical of present safety helmet(s) technology. The impact attenuating control device(s) notably enables construction of a wide variety of safety helmet(s) and other safety equipment as stated herein.

Other characteristics and advantages of the current invention will be apparent to those skilled in the art from the description of embodiments may be specifically designed for a wide variety of safety helmets.

As illustrated in FIG. 43, there are four examples of the many possible "mesh" "net" geometric reinforcement configurations that may be used in the current invention to produce impact attenuation control characteristic(s) as stated herein.

The selection of the reinforcement geometric configuration(s) including weight, geometries, shapes, gauge(s) will depend on a number of design factors, including, but not necessarily limited to: the degree of impact attenuation reduction or counteracting impact forces (reflection) desired or required.

One of skill in the art can routinely measure the impact attenuation characteristics of any selected configurations and design in order to modify one or more of the design factors noted herein to achieve a particular outcome or result.

In other specified embodiment encompasses that in an apparatus part or reinforcement mechanism that can be referred to as a "guide" or "path."

One of skill in the art can determine the type of reinforcement configuration(s) or attenuating dampening device or devices for a particular embodiment.

Of course, a helmet(s) incorporating or using the devices or methods of the current invention can also be combined with any known helmet(s) modification or control devices or systems available. For example, safety pad, recoil pads, and air or gas injection systems can be incorporated into a design, either individually or in any combination. The impact attenuating control mechanism(s) of this invention provide vastly improved characteristics over the prior art.

The improvement afforded by the devices and methods of current invention are significantly greater. For example, the inventor theorizes that about a 10% reduction in impact recoil as measured by downward movement, or about 20% to 40% reduction, or about 50% to 60% reduction, or about 70% to 80% reduction, or about 80% to 90% reduction may be obtainable, and even, depending on the overall design, a 90% to 99% reduction in impact force attenuating.

Having described the invention herein and the factors one can consider, what follows refers to specific preferred embodiments of the Figures and Examples. As noted herein, the invention is not limited by the scope of the embodiments listed, the Figures, or the Examples. Rather, one of skill in the art can employ the principles and examples to design, make, and use a number of embodiments not specifically shown here that are fully within the scope of the present invention.

Figure 44:
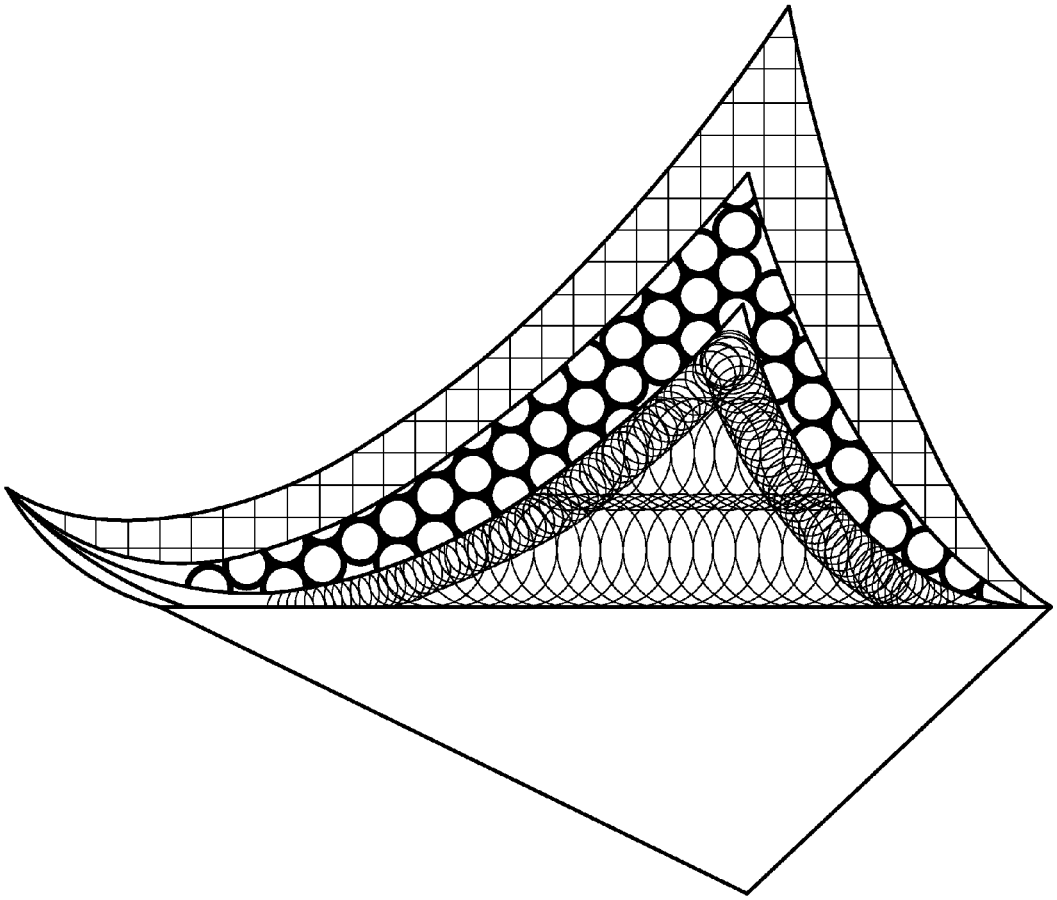
FIG. 44 is a schematic of the embodiment of a multi-layer lamination impact attenuation control devices according to the invention.
Figure 45:
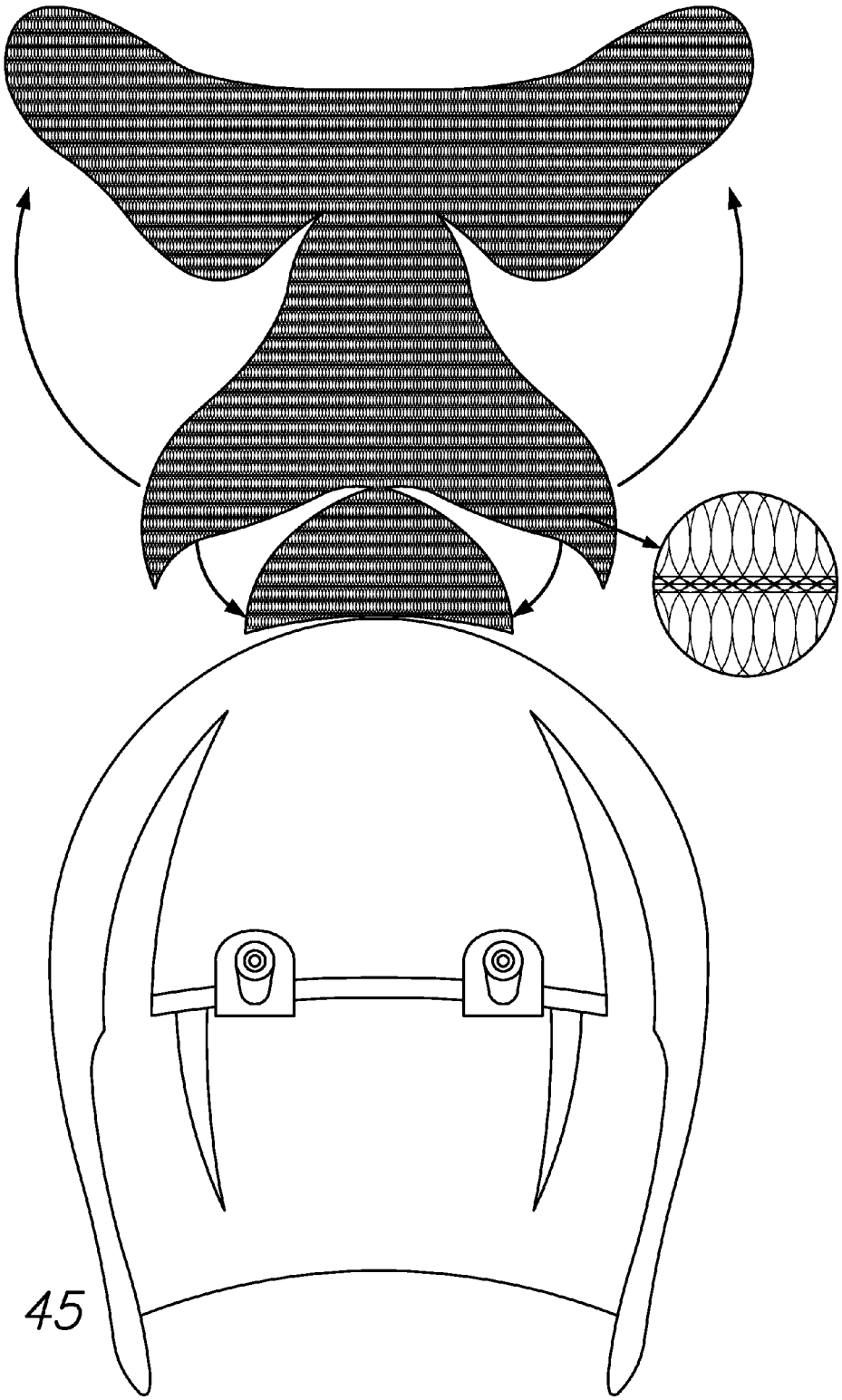
FIG. 45 illustrates a preferred "coiled" reinforcement apparatus that can be folded and configured into a reinforcement safety helmet of the current invention.
Figure 46:
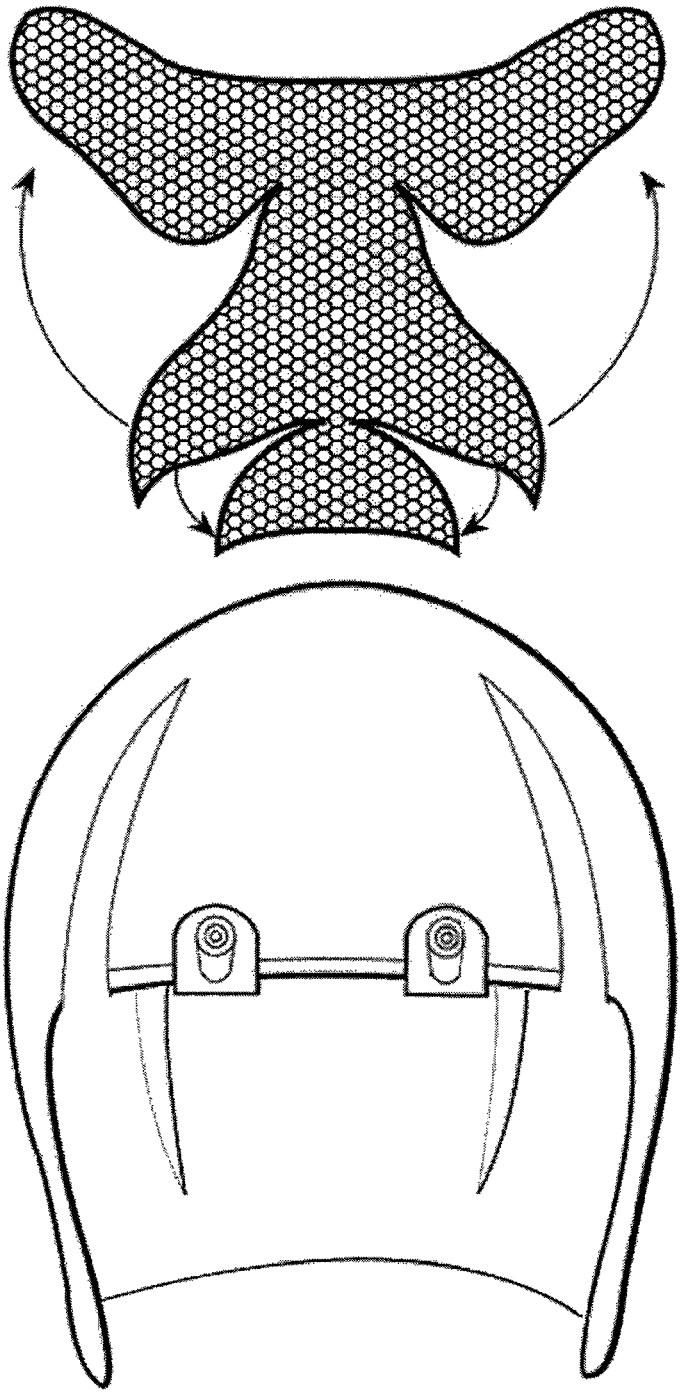
FIG. 46 illustrates a preferred "mesh," or "honeycomb" reinforcement apparatus that can be folded and configured into a reinforcement safety helmet of the current invention.
Figure 47:
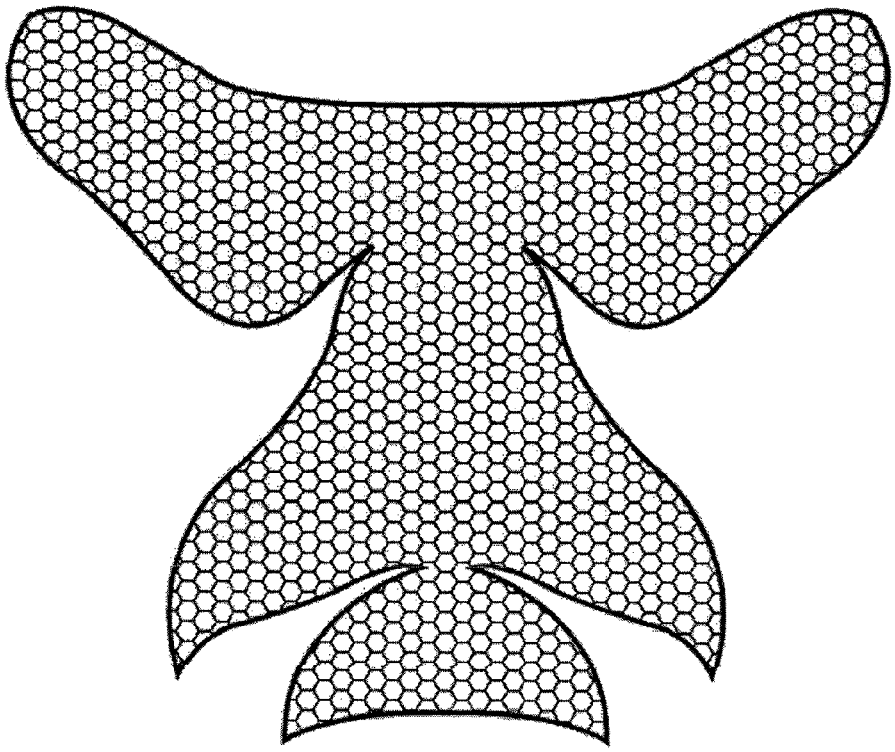
FIG. 47 illustrates the preferred form "mesh," or "honeycomb" reinforcement configuration.
Figure 48:
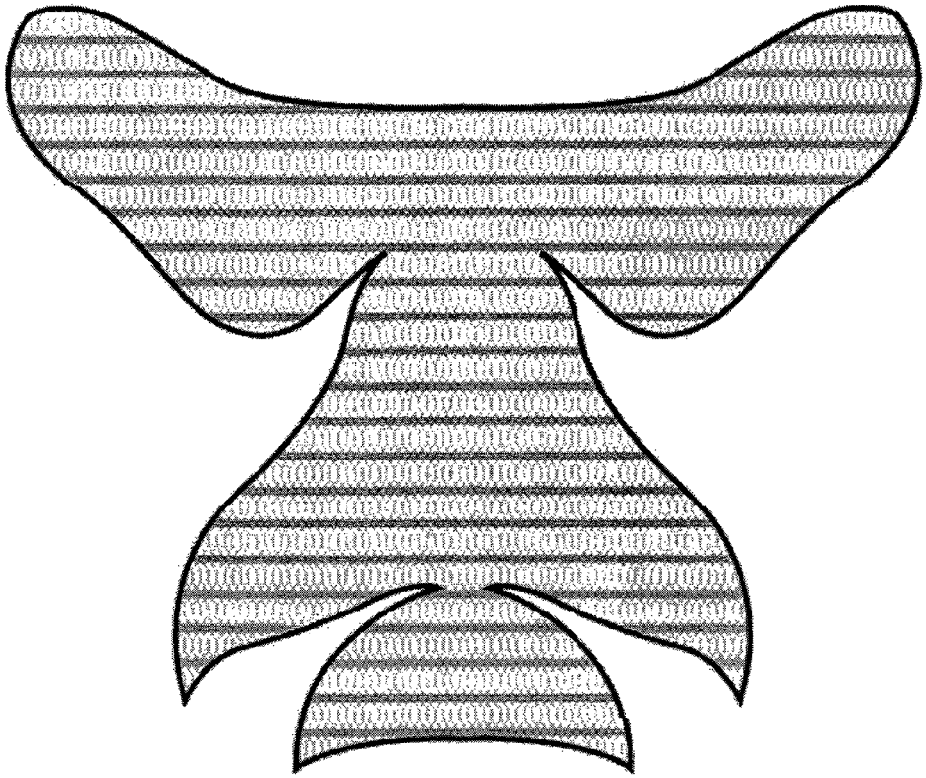
FIG. 48 illustrates the preferred form "coils" reinforcement configuration.

FIGS. 44 and 45 show a cut-away view of the internal parts and the operation of the system in an exemplary embodiment.

The "guide" or "path" can be integrally formed as part of the reinforcement(s) of the helmet(s), or optionally, "guide" or "path" can be an internal part of helmet(s) to attenuate counteract and to redirect and preferably return a wide range of impact wave(s) or forces.

In other specified embodiments encompasses that the range of possible reinforcement's configurations including sizes and positions can vary by design factors or by the desired impact attenuation and other control characteristics as needed.

FIG. 44 is a schematic of the embodiment of a multi-layer lamination impact attenuation control devices according to the invention.

The reinforcement guides(s) in the form of "meshes," and or "nets" configurations can take various sizes and forms, for example octagon coils, and many other possible laminated forms and shapes.

Furthermore conventional mechanisms can be adapted for use with the current invention or in designing a helmet(s). The impact attenuation energy recoil reflection mechanism is shown in FIGS. 19 and 20. An inverse or reflective oscillation by the reinforcement at the end of its return has a dampening effect on an impact.

As shown in FIGS. 24, 25, and 26, greater adjustment of the resistance to the impact(s) moment by means of an appropriate modification of the reinforcements decoupling angles is enabled.

One skilled in the art is familiar with techniques and devices for incorporating the invention into a variety of safety helmet(s) examples, with or without additional helmet(s) elements know in the art, and designing helmet(s)s that take advantage of the improved three dimensional force distribution and impact reduction attenuation having characteristics of the invention.

In several embodiments encompasses that the inventive helmets having multiple laminated and or cast in place attenuating layers to sufficiently cure and thus sufficiently harden. Various thermal methods such as elevated and or lowered thermal cycles or/a combination of thermal and or chemical methods may be used if needed during the manufacturing process of the current invention to preferably obtain the desired hardness and/or molecular orientation as needed and or to speed up the curing rate and/or improve construction process. For example, but not limited to a torch, hot air blower, steam, air, nitrogen gas, radio or microwave energy sources may be employed to treat the wide variety of reinforcements materials and/or to speed up or improve the curing rates and/or cycles. Depending upon application, a judicious choice of the helmet's material(s) and configurations known to those within the art that cures quickly such as plastics, resins or other hybrid materials.

In several specified embodiments encompasses a wide variety of leave-in-place cast-in-place reinforcement apparatuses for manufacturing safety helmets having extruded surfaced deformations or surface textures as needed may have a variety of combinations of spaced filaments, sizes, gauges and a variety of woven patterns as needed having a variety of previously unavailable advantages and benefits. As for example, mixing different tensile ranges, sizes with different diameters and shapes, filaments and or fibers, materials maybe specifically tailored to a wide variety of different filler or bonding materials and plastic mixes and applications needed. Such as but not limited to fiber-reinforced polymer (plastic), fiberglass/Kevlar® composites, fiberglass, polycarbonate thermoplastics etc. or any suitable materials or combination known within the art.

In several specified embodiments the methods and apparatus encompasses a wide variety of customized specifications for the inventive reinforcement(s) to meet specific conformational configurations strengths sizes and shapes, such as the combination(s) of different materials can be specifically tailored to correspond to and suit a specific grade or level of transportable safety equipment, including safety helmets or mix of material(s) to meet or exceed a wide variety of conformational tolerances as needed.

The reinforcement apparatuses materials such as the filaments "rings," "meshes," or "fibers," and their pre-engineered spacing's provide(s) an impact regulating apparatus that provides an optimal attenuation dampening characteristics may be tailored to a variety of custom resins or plastic mixes as needed, as for example, for obtaining a high initial reinforcement shear strength having a minimal time between each laminated or cast layer(s), depending upon application. The helmet(s) may incorporate multiple layers of the same or different attenuation, configuration materials or textiles as needed.

As a further example (showing in FIG. 44), the reinforcement(s) apparatus in the form of a variety of woven filaments in strips may optionally comprise longitudinally-extending strips and transversely-extending strips interwoven therewith such as a, but not limited to herringbone pattern, and the outer layers of crossing longitudinally-extending strips and transversely-extending strips are crossed and may be bonded together at their optimum pre-engineered crossing and apertures (spacings) as needed.

As an option, at their crossing locations of the filler or bonding locations or crossing strips occurs because neither of the filler or bonding layers is in contact with the adjacent strip or filler or bonding layer thereof. These filler or bonding locations therefore provide the material with a pre-engineered apertures as needed, the amount or size of which is determined by the application such as the sizes and spacing of the strips.

It will also be readily appreciated that a particular advantage of the current invention(s) employing woven plastic reinforcement attenuating material(s) as an apparatus in accordance with the present invention is that the filler or bonding methods of the crossing locations can be effected by conventional filler or bonding and equipment(s), as known within the art for example heat sealing, ultrasonic sealing, dielectric sealing or magnetic sealing etc.

In a specified embodiment encompasses that the woven reinforcement apparatus as stated herein is useful where the reinforcement(s) is to be contained within the helmet(s). Such as for example certain filler or bonding resins or cements. Also, the material(s) may be selected so that the reinforcement(s) has a desirable amount of tensile range(s) and dampening and attenuating characteristics including elasticity, which is useful where capability of impact energy absorption, control and dissipation is required, for example in football face guards, football helmets, motorcycle helmets and other helmets and face guards known within the art.

In other specified embodiments encompasses the reinforcement apparatus have fabric material(s) and methods, which may be coated on its outside surfaces with synthetic and or plastic materials and is constructed by weaving the fabric or fabrics in a wide variety of laminate(s) or sheet(s) or any form with basic threads having a given tensile strength with the two or more layers of the fabrics being joined together such as by "rings," "coils," or annular "loops," "hoops," or threads or any combination as needed or required which have a similar or greater tensile range or strength than the basic filaments and or threads.

In other specified embodiment encompasses synthetic filament fabrics, such as but not limited to, polyamides, polyethylene terephthalate or similar fibers are well known as basic fabrics for coating with plastics and or synthetic rubbers. If the coated filaments and or fabric materials has to be manufactured into, e.g., generally shaped domes, hemispheres curvilinear or other still more complicated geometric forms it is necessary to connect the coated fabric webs and the parts cut out of them by sewing, welding, bonding or similar processes. Note that it is almost impossible in such cases to achieve seam joints which at all points and in every direction have a shear strength near or greater the tensile strength of the coated fabric material, such as the low peeling strength of welded seams does not allow as much high mechanical strain in an opposite power direction.

Furthermore, the weaving of reinforcement fabric(s) is also a well-known and common process within the art. When generally dome, ovoid shaped woven reinforcement(s) are to be coated, they may be cut along one edge of the flattened stock to obtain a web of double width or along both edges to obtain two fabric sheeting's for the coating processes. It is also possible to cut into generally tubular/dome fabric(s) in a diagonal (helical) direction, which results in one web of diagonal materials or more as needed.

The single, rolls of fabric obtained by any of these methods can be coated with plastics and or other synthetic materials in the usual manner and manufactured into open or closed reinforcement forms, such as oval, ovoid domed shapes by the methods and apparatuses described herein. It is also possible to connect parts of the two or more laminated layers of a pre-cut flat woven fabric along one or both edges or in other places by weaving or "ring" coil attachment and/or "coiled" securement techniques, as stated herein.

The object of this invention is to eliminate the prior art limitations and provide means of filler or bonding or coating plastics and or synthetic materials having smooth and uniform on one or both outside surfaces. For the final reinforcement application of the fabric web or the parts cut out of it, it is possible to predetermine the shape(s) with one or more open or closed hollows by an economical working method. Preferably conventionally on normal machines known within the art with a wide variety of plastics and or synthetic materials (in the form of pastes, plastisols, solutions, dispersions or latex emulsions with or without folds as needed, compressions or any loss in ease of handling compared with normal fabric backings. To weave this innovative curvilinear shaped reinforcement as needed. They may be divided by their functions into the following three filaments or threads: (1) The basic size(s) and strengths of the fibers of the warp and or wefts needed for the desired reinforcement weave of the fabric; (2) the connecting fibers, coming out of the warp and or weft, which by a special weaving technique permanently connect parts of the areas of the two layers of the generally tubular reinforcement fabric spaced apart as needed or required; and (3) the pre-engineered aperture(s) (spacing's distances fibers), coming out of the warp and or weft, which by a special weaving technique permanently link the total areas of the two layers or parts of these areas to determine the distance apertures between the two layers for the final reinforcement application(s) as needed.

In this example the auxiliary threads or reinforcement filaments preferably covers the total area of the fabric web to attach the two or more layers closely to each other, while the distance fibers can be over the whole area or only in parts of it or sporadically distributed in certain places just as necessitated by the reinforcement pre-engineered specifications such as configuration strength, and shapes required.

In this example the connecting fibers may be permanently connected only parts of the two layers closely and tightly to each other, while the threads or filaments preferably cover the areas with connecting fibers or only in some parts or sporadically distributed in certain critical stress zones or areas as needed and or places of the areas without connecting fibers just as necessitated by the designed application and shape(s) as required.

In several specified embodiments encompasses inventive methods and apparatuses such that the woven or configured reinforcement threads or filaments cover all those areas of the helmet(s) with reinforcement(s) having enhanced impact attenuation control characteristics employing fabrics woven or configured to a certain predetermined distance (spacing) as an example between the two or more laminated layers or multi-layers as needed. The threads or filaments are not necessary in places which are permanently and closely joined by connecting fibers because they cannot perform their function there, but it may be necessary and economical for the weaving pattern(s) to have them preferably incorporated over the total area of the reinforcements in helmet(s) as needed.

As compared with other fibers of the weave patterns and all permanent connections between the two or more laminated layers, the threads or filaments preferably have an equal or higher tensile strength or as needed.

In other specified embodiment encompasses that the threads or filaments are to be employed over the entire width and length of the woven fabric web, such as if there are no connecting fibers used between the layers. If the connecting fibers join parts of the two layers or multi-layers to each other closely and tightly the threads or filaments are to be employed at least over the entire width and length of all areas free of connecting fibers.

As an option, the threads or filaments can be applied in the warp or only in the welt or in both directions as needed. And may encompasses threads and filaments of different characteristic(s) in one generally oval, dome, curvilinear fabric web, as an example one type in the warp and the other type in the welt. All types of threads and filaments have a structural function in the generally oval, ovoid dome curvilinear shaped fabric web which has been performed when smooth and uniform coating has been carried out such as but not limited to (cast, injected molded, sprayed, etc.) in the helmet(s) preferably near the outside surfaces, or either the near inside and/or the near outside surfaces, as needed.

As mentioned herein, connecting fibers and distance fibers having a permanent cast-in-place leave-in-place function as reinforcement apparatus having structural webs in a variety of patterns and, as they come out of the warp and or weft, having the same tensile or greater strength of the basic fibers. As an option two or more different types of basic fibers having different yarn diameters and or fiber types, leading to different tensile strengths, in alternating or other sequence, and to use only the fibers of high tensile strength for the functions of connecting fibers and or distance fibers. The difference in function between the connecting fibers and the distance fibers is the pre-engineered distance spacing's (apertures) between the two or more layers of the woven fabric, which is determined for the final application. The connecting fibers join the two or more layers to each other only in certain parts of the total area or sporadically distributed but permanently pre-engineered (spaced) tightly and closely as needed per application, while the distance fibers permanently connect the two or more layers over the total area or only in certain places or sporadically distributed but at a certain predetermined aperture distance (spaced) and define the distance between the two or more layers for the end use. It is also possible to employ distance fibers in a way, that they result different lengths between the two or more layers to permit complicated, uneven shapes such as a variety of helmets for the final applications as needed. The distance fibers if present in the woven fabric after leaving the weave of one layer may run between both layers or more until they enter the weave of the other layer or as needed they remain in this position because both layers' seams or more are temporarily or permanently stitched closely to each other by auxiliary threads as needed or by filaments until coating process is completed and is subsequent cast in place or to accurately conform to the pre-engineered distances between the two or more layers in the end use shapes as needed.

Preferably the fibers of the warp and weft and the connecting fibers and distance fibers originating in the basic weave are synthetic filaments or mainly synthetic filaments. These three classes of fibers need to have high tensile strength as required for the final reinforcement attenuating form of application. Therefore filaments of, e.g., polyamides, polyethylene terephthalates or polyvinyl alcohols etc, are preferably used.

As an option the woven reinforcement attenuating apparatus fabrics may be manufactured and prepared according to this invention, can be easily bonded or conventionally coated on normal coating equipment with, such as but not limited to, PVC-plastisols, vinyl copolymers, polyurethanes polyacrylates, polychloro-butadienes, polyolefins, polyamides, etc., by all techniques normally used for the respective polymers.

The innovative reinforcement methods and apparatus generally employing oval, ovoid, curvilinear configured fabric(s) or flat cut and folded reinforcement fabric pre-cut as needed, described by this invention, allows predetermining the end use shapes of a wide variety of safety helmet(s). A wide variety of shapes and configurations can be formed by the distribution of the employed connecting fibers and/or distance fibers into predetermined patterns as needed. After coating both outside surfaces with filler or bonding plastics and or synthetic materials.

As the reinforcement(s) maybe predetermined by the described weaving measures of the current invention, there is not or only a little further manufacturing is needed to install it may be necessary to insert "hoops," "loops," eyelets, grommets, flaps, pads, openings for filling or injection, valves and valve connections, to cut edges, to fasten straps and latches, and to reinforce parts by additional strip reinforcement "meshes," and or "rings" or coated fabric as needed.

Practicing this invention with all possible combinations of the described classes of such as but not limited to reinforcement having enhanced impact and recoil attenuation control characteristics such as but not limited to annular "rings," "coils," mesh(s), netting, a wide variety of filaments, fibers etc enables a very economical production of series in various helmet with a wide capability of configurations and shaping as needed.

Additionally, an inexpensive and efficient method is described herein for the assembly and manufacturing of such reinforcement for the of attenuation safety helmets in high volume. Furthermore, said method of manufacturing embodies the adaptation of a set of simple mechanical elements onto existing manufacturing processes.

It should be understood that, with the present invention, the amount of impact attenuation (stress transfer) can be flexibly and fixed controlled or any combination with the proper combination of reinforcement apparatuses as needed, including the selection of reinforcement filaments number, location size of the expansion blocks as needed.

For example, the laminating process builds external and internal layers (extruded) surfaces may deposited in succeeding layers, one surface on the face of the other, in a single or multiple passes, or any combination as needed. These could be of the same or different configurations and material(s). For example, any plastic material may be injection molded, cast, formed, sprayed or extruded onto the internal or external surface or any combination during a first pass and the same or other materials may be applied over the reinforcement material during a second pass or as needed.

By combining some or all of the features described herein into a safety helmet's systems, the vast majority of a durable and quality helmet(s) may be built according to a wide variety of safety grades ranging from standard to customized configurations and specifications very quickly and efficiently. This is an object of the invention.

In a specified embodiment encompasses a reinforcement impact attenuating method and apparatus having material fabrics being woven in both the warp and weft directions having basic fibers (filaments) having two or more layers, said layers having, in the flat condition, side edges, which are connected together so that said fabric is filled, a wide variety of filler or bonding plastic(s) or resins etc., as stated herein.

The improvement comprising said fabric including auxiliary threads, said auxiliary threads binding said two or more layers together, having a pre-engineered aperture(s), woven formation, and as an option or optionally, whose two or more layers may in part be connected closely or with distance spaced fibers, depending the necessary or required apparatus(s), or any suitable combination, by means of a variety of weaving(s), so that coated a reinforcement apparatus having material(s) of various shapes can be manufactured by a simple an economical working method almost without or wholly without any stitching, welding or bonding operations. The final shape of the reinforcement attenuating apparatus having material is predetermined by the weaving and coating techniques as needed depending upon application.

Due to the relatively light-gauge, of the woven reinforcement apparatus having material(s) of which the cast-in-place, leave-in-place reinforcement materials form is constructed or fabricated, and may be readily be punch-cut or cut with hand shears. Then the grids or webs can be or as needed cut, such as including any necessary openings.

As an example, the invention encompasses methods and apparatus that relates to woven and web synthetic reinforcement attenuating plastic materials. Such woven plastic materials may be produced as a reinforced attenuating dome shaped structure from which a variety of helmets may be made or may be produced for other transportable safety equipment.

It is therefore an object of the invention to provide a wide variety of woven plastic reinforcement methods and apparatus having attenuating materials and which may if desired possess a suitable pre-engineered qualities and characteristics as needed. Additionally, the woven strips comprising longitudinally-extending strips and transversely extending strips filaments interwoven in a wide variety of patterns therewith as needed.

Preferably, such reinforcement impact attenuating methods and apparatus having woven plastic materials preferably having a high resistance to unraveling comparable to unbounded material and may be produced with the required or desired pre-engineered reinforcement recoil control attenuating apparatus. Also, the filler or bonding increases the strength of the material and recoil control.

The longitudinally-extending strips and transversely-extending filaments (strips) are preferably bonded together by filler or bonding materials at the pre-engineered apertures (spaced locations) where at least one filaments strip has a bonding there adjacent to the other filaments strip(s).

As an option at least some of the strips may carry a filler or bonding layer on both sides thereof, and the layer of filler or bonding material may comprise synthetic plastic material(s).

In a specified embodiment encompasses that each woven reinforcement impact attenuating strips is preferably molecularly oriented substantially in the direction of the length of the strip. Each strip may be a synthetic plastic material selected from the group consisting of polypropylene, polyethylene, linear low density polyethylene, polyamides, high density polyethylene, polyesters, polystyrene, polyvinyl chloride, their copolymers and mixtures thereof, carbon, fiberglass, Kevlar®, graphene and its variances.

In a specified embodiment encompasses that the woven plastic impact attenuating reinforcement material(s) may be produced in sheet form and or folded in a generally hemispheric, dome, ovoid, and oval and optionally may be formed from pre-cut lengths, such as flat sheets.

The layers of filler or bonding material may comprise hybrid and or synthetic plastic materials selected from the group consisting of linear low density polyethylene, ionomers (for example Surlyn®), polyvinyl chloride, ethyl vinyl acetate, ethyl propyl copolymers, polyethylene copolymers, low density polyethylene, their copolymers, vinyl copolymers and mixtures thereof the filler or bonding material(s) may contain one of more additives to improve the strength an accuracy of location securement (where they cross) and the accuracy of the aperture (spacing), improving the welding and adhesion as needed.

Depending upon the application, the width of each strip may be in the range from about 0.0005 to about 2 inches, and the thickness of each strip may be in the range of between about 0.0001 to about 0.5000 inches or as needed.

The term reinforcement "mesh" as used herein is an apparatus defined as a stiff fixed and or flexible leave-in-place cast-in-place reinforcement apparatus configured to specifically attenuate preferably reflect, deflect and dissipate a wide variety of impact forces and stresses.

The reinforcement "mesh" material(s) or filaments contribute to the tensile shear and ductile strength. In a specified embodiment encompasses methods and apparatuses may incorporate a wide variety of "mesh" having surfaces textures such as but not limited to mesh, patterns and configurations including gauges and sizes, and encompasses a wide variety of "mesh," and or "netting" patterns preferably positioned in proximity to the outside and or the inside of a helmet or a portion of a safety helmet(s) or other transportable safety equipment.

As an example, the reinforcement "mesh(s)" may be manufactured using a variety of extrusion and or expansion processes known within the art to produce a wide range of apertures (spacing and hole sizes), weights, and thicknesses as needed. To suit a variety of applications as used here in the term "extrusion" is a continuous manufacturing process in which plastic resin pellets are melted and pushed through a die to create a continuous reinforcement "mesh." This extruded "netting" can be produced in a wide range of configurations ranging from fine "netting"/"mesh" to coarse extrusion "mesh(s)" and can also be manufactured (produced) by a variety of expanding process to allow a wide variety of "mesh" configurations to be made from a wide variety of filler or bonding plastics and resins as stated herein such as not otherwise available through the extrusion process. Plastic "mesh"(s) may be produced in a wide range of reinforcement configurations as needed. Note: Some variation is inherent in the extrusion process tolerances for plastic "mesh" vary with apertures (hole sizes), weights, thicknesses and widths as needed per application.

As an exemplary embodiment, encompasses, generally polygon configured "mesh" "netting" pattern may be extruded using counter-rotating dies. Additionally, the joints may be formed when two strands intersect or overlay each other, such as but not limited to forming a generally polygon, pentagon shaped pattern(s). The two distinct planes (known as flow channels in some applications) are created when the opposing strands overlap. The tooling and processing manufacturing conditions can create generally polygon "mesh" "nets" having pre engineered angles ranging from about 40 degrees to 105 degrees as needed to suit a variety of applications.

In other embodiments encompasses internal and external reinforcement(s) having generally polygon shaped "mesh(s)" or "netting(s)" that may be extruded using a circular oscillating die plate. Known within the art, as an example, the longitudinal reinforcement strands are determined by the size of the holes (aperture(s)) around the circumference of the die plate. The cross strands are created when the die plate opens, creating an integral joint structure along the x and y plane. As for example but not limited to generally pentagon, polygon "mesh" "netting" typically has one flat side created by the melted extruded "mesh" passing over a mandrel. In a specified embodiment encompasses oriented netting is produced in a secondary operation by heating and stretching the extruded "mesh," "netting" to create a lighter-weight reinforcement material having a higher strength to weight ratio. Typically, the bi-axial orientation "stretches" the initial extrusion to about 3 to 4 times the original width and length, or as needed.

As an example, but not limited to biaxial oriented polypropylene "nets" are generally lighter weight and more flexible than extruded generally square "mesh(s)". The orientation process "stretches" the extruded square mesh in one or both directions as needed under controlled conditions to create strong, flexible, light weight attenuating reinforcement "mesh" or "netting(s)" and is thus preferred in some applications.

In addition, a wide variety of manufacturing process and methods can produce inventive or customized "mesh" "nets" configurations as stated herein to meet specific application and extrusion requirements to suit a wide range of reinforcement attenuating applications and a wide variety of custom mixes and specific applications as needed.

Additionally plastic "mesh" or "netting" may be produced in a wide range of suitable configurations known within the art. Note some variations are inherent in the extrusion and orientation process. Tolerances for plastic "meshes" vary with geometric configurations and apertures (hole sizes), materials, weights, thicknesses and widths as needed.

As an example, expanded "mesh" is generally produced within the art by slitting plastic sheet stock in a controlled pre-engineered pattern(s), then stretching or expanding the width to produce the designated nominal aperture (hole) size. Note that the dimensional measurements for expanded "mesh" are somewhat different than extruded and oriented "mesh" "nets."

In other specified embodiment encompasses that plastic "mesh" "nets" may be produced by other expanding process(es) known within the art. This allows for a variety of "meshes" to be made from a variety of plastics and resins not otherwise available through extrusion process. Note, generally the nominal weight of extruded and oriented "nets" are most commonly identified in PMSF (pounds per 1000 square feet).

As stated herein, woven "mesh" reinforcement may be produced by weaving monofilament fibers using advanced looms and finishing equipment. The "mesh" aperture (opening) for a given strand thickness (gauge) is dictated by controlling the threads per inch (weft mesh count and warp mesh count).

Note: reinforcement woven "mesh" industrial textiles may be constructed from a wide variety of monofilament synthetic fibers. These weaving processes are known within the art may produce fine mesh(s) industrial textiles with apertures (hole sizes) as small as 1 micron, having a strand and thickness tolerance of about +/−10%.

The manufacture of these reinforcement textiles is determined by the yarn type, yarn size and thread count. Monofilament yarns are a single continuous filament, which produces a relatively smooth surface and are commercially available from several sources, such as industrial netting, 7681 Seltzer Parkway North, Minneapolis Minn. 5545-9938, www.industrialnetting.com.

Generally, monofilament fabrics as used in the current invention are generally produced with equal yarn diameters and equal thread counts in both the warp and weft directions, the "mesh" opening is usually generally square in shape.

In several specified embodiments encompasses that these precision woven fabrics can meet stringent technical requirements as needed. Note, synthetic woven media may be manufactured from but not limited to nylon(s), polyester(s), and polypropylene in a wide range of widths as needed. Polypropylene is generally preferred.

As for example, from flat plastic "netting," and flexible "netting" may be cut from and can be used in a variety of reinforcements, such as in a internal impact force attenuating apparatus to contain the filler or bonding resin or plastic mix(es) during the manufacturing process. The "netting" as a reinforcement apparatus may encompass a wide variety of possible mesh sizes, shapes, gauges, diameters and lengths to meet a wide variety of reinforcement applications and specifications.

In a specified embodiment encompasses that the extruded generally square, one of many possible configurations, or other shaped and configured impact attenuating reinforcement(s) apparatus in the form of "mesh(s)" may also be used as a heavier outer protective reinforcement layer for the casting medias as stated herein. Note the thicker strands of these generally square "mesh" extrusions may provide significant attenuation and protection. The seams can be bonded or sonically welded to secure the reinforcement together or other laminated layers as needed.

Whatever the trans-portable safety equipment application or function, the extruded attenuating reinforcement in the form of plastic "mesh" and "netting," contribute to both improved safety and performance.

As an example, attenuating reinforcement in the form of "netting" may be sonic welded or heat sealed to manufacture a wide range of safety helmets having possibilities, ranging from fine "meshes" to heavier, the rigid and more open forms are preferred.

As for example, the "reinforcement" specifications may be specifically engineered and manufactured to meet a variety of specific safety helmet(s) structural conformational tolerances such as, but not limited to high impact strength applications and or for applications such as motorcycle and ballistic helmets as needed.

In several exemplary embodiments encompasses that the attenuating reinforcement itself is also encompassed as an apparatus by the present invention.

As a non limiting example, but not limited to, "woven" poly propylene attenuating "reinforcement," may be formed and configured in a variety of configurations, filaments ranges from about 500 psi to 90,000 psi for most applications. The preferred "reinforcement" "mesh" range is from about 45,000 psi to about 90,000 psi, or as specified.

In several specified embodiments encompasses inventive methods and apparatus such that the leave-in-place, cast-in-place, extruded "mesh" may have surface deformations and textured conform to the general shape of the helmets that may be specifically engineered and manufactured to control or specifically regulate the impact attenuation control characteristics as specified.

In a specified embodiment, the current invention encompasses a wide variety of "reinforcement" "mesh" configuration patterns, materials gauges, voids, sizes spacing's, and filaments' sizes and weave(s) or patterns and lengths and dimensions as needed for a wide variety of applications for safety helmets as necessary.

In several specified embodiments the helmets internal "reinforcement" may further prevent random micro cracking during the construction and manufacturing process of the helmets and furthermore limits the long term cracking occurrence from a wide variety of encountered impacts.

The current invention's methods and apparatus simultaneously promotes simultaneous casting of multi-grade(s) sized "reinforcement" and filler or bonding plastics and/or resin mixes and other materials as needed.

The method(s) and apparatuses of the current invention compensates for the manufacturing inconsistencies that may occur in the prior art helmet(s) such as casting or injection process. This is an object of the invention.

In several specified embodiments encompasses that the inventive reinforcements "rings" "coils" apparatus further promotes faster casting and curing rates and construction schedules thus reducing construction timelines at reduced costs or equivalent cost.

In other specified embodiments encompasses that the "reinforcement" casting/molding methods and apparatus of the current invention is compatible with a wide variety of micro-reinforcements micro-fibers, micro-coils, aggregates (minerals) filler or bonding plastics and or synthetic resins as needed.

Figure 50:
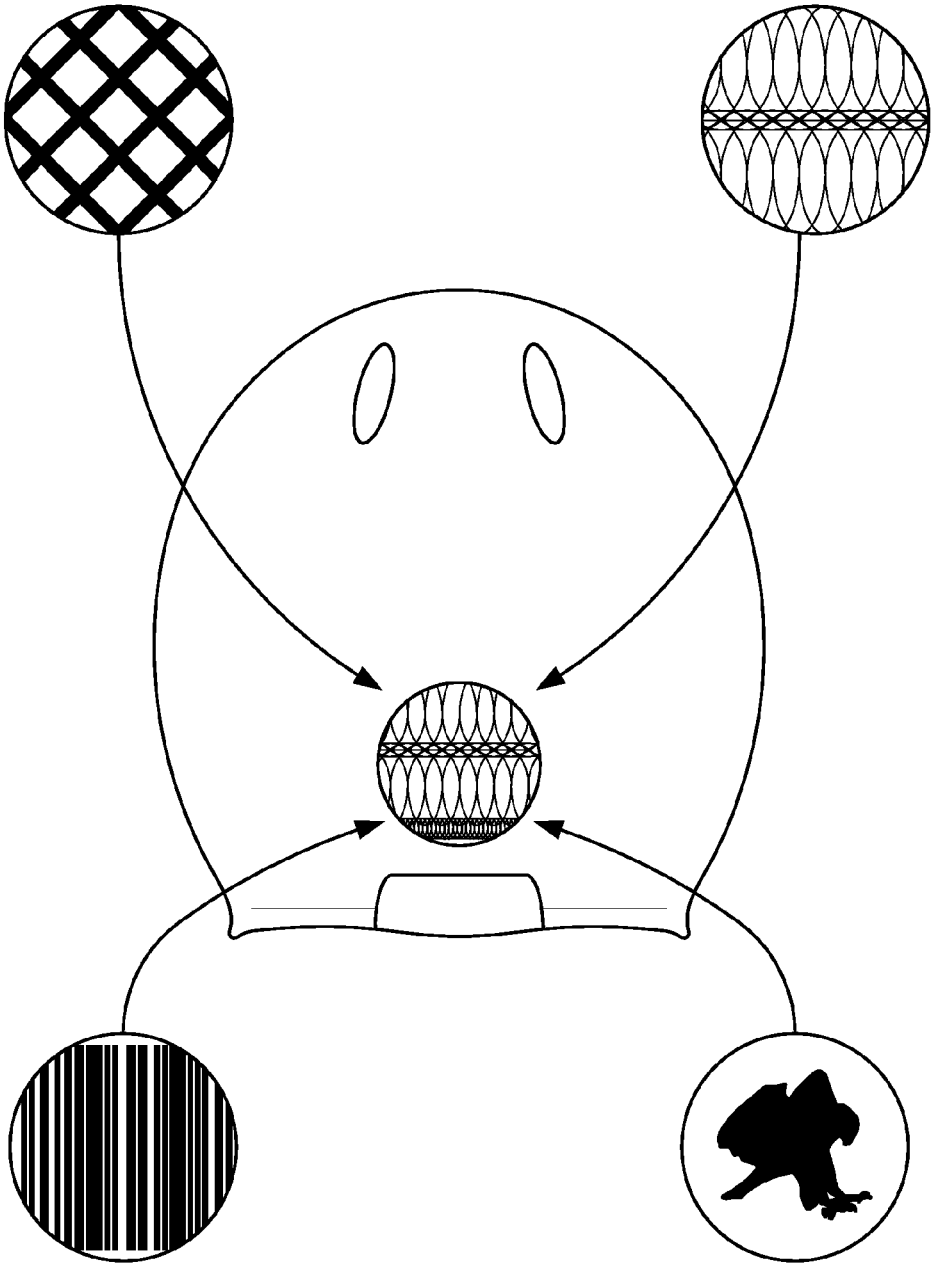
FIG. 50 illustrates a round viewing window, which is one of many possible configurations, such as but not limited to oval, pentagon, star, triangle, freeform etc. viewing windows having the shapes or configurations of, in a helmet(s), may encompass (a viewing window or viewing port that allows for visual inspection of the reinforcement(s) through a section of the helmet(s) translucent or transparent shell to visually inspect the reinforcement configurations).

FIG. 50 illustrates a round viewing window, which is one of many possible configurations, such as but not limited to oval, pentagon, star, triangle, freeform etc. viewing windows having the shapes or configurations of, in a helmet(s), may encompass (a viewing window or viewing port that allows for visual inspection of the reinforcement(s) through a section of the helmet(s) translucent or transparent shell to visually inspect the reinforcement configurations).

In a specific embodiment, the viewing window or viewing port may encompass, as illustrated in FIG. 50, such as but not limited to bar codes, holograms, logos, trademarks, embedded chips, factory codes, manufacturing codes, etc.

As an option, the reinforcement material or materials may be treated with colored indicating dyes and/or a color changing dye as needed, such as for indicating the curing stage or curing rate, such as but not limited to by color changing from white to green, indicating that the previous layer has sufficiently cured to sufficiently receive and support the next reinforcement layer as needed.

In other specified embodiment(s) encompasses temporarily attaching a testing device into the helmet, such as having a capacitance indicating apparatus to indicate the condition(s) or status of the helmets, including the safety status such as indicating the shelf life of the helmet or any damage or portions of damage thereof.

Or as an option may encompasses an anti-counterfeiting indicating component such as embedding fluorescent dyes that fluoresce, such as revealing coils, labels, etc. from the exposure from ultra-violet light or as an option may encompasses viewing window or port to visually reveals the "hoops," "coils," such as but not limited to logos, holograms, bar codes, embedded chips, factory codes, inventory codes, manufacturing codes etc.

Figure 49:
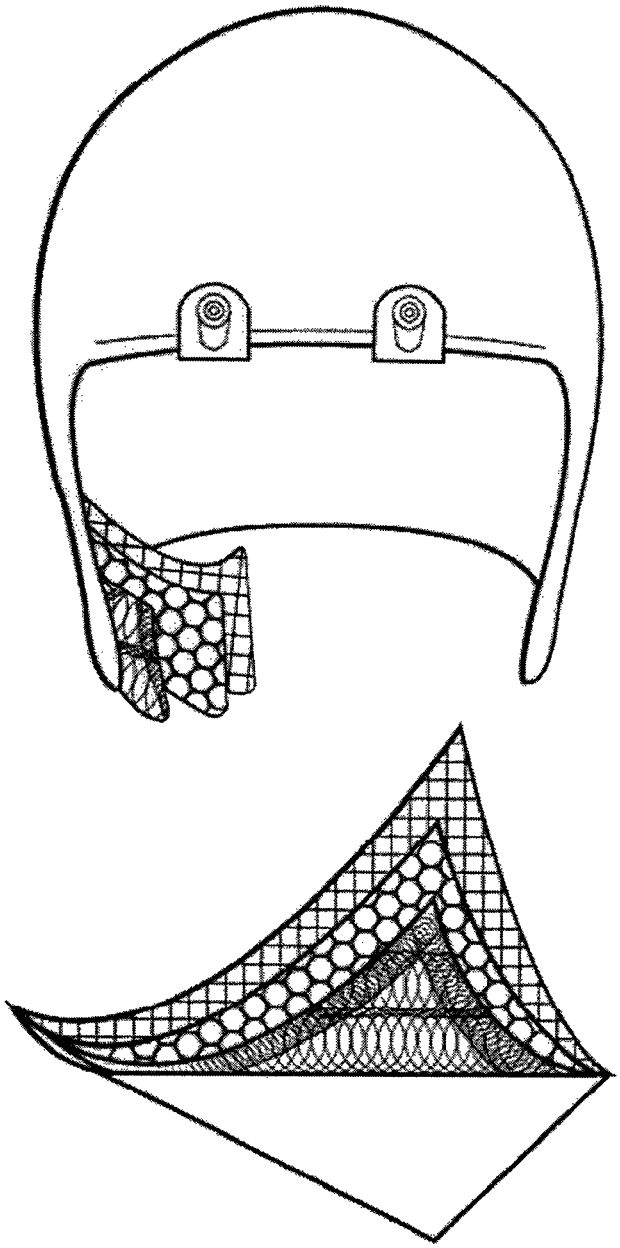
FIG. 49 illustrates four of many possible configurations encompassed by the current invention having impact force attenuating characteristics as an example perpendicular to or lateral to the longitudinal axis of the impact source may be referred to a vectorial component or part of a force or momentum vector, preferably directed outside the longitudinal axis of the impact source.

In several embodiments the invention encompasses methods and apparatuses, such that the "reinforcement" attenuating apparatus may be constructed and composed from a wide variety of different laminations processes; as an example, employing singular or multi-layered lamination processes and materials from a wide variety of compositions and materials, such as but not limited to a wide variety of fabrics, foils, filaments, plastics, "coils," "loops," fibers, weaves, binding agents, mesh configurations, weaving patterns, spacing, crossing angles, fabrics, hybrid materials. Further encompasses such as in single and/or multiple lamination manufacturing processes in layers as needed. FIG. 49 illustrates one of many possible lamination processes. In an illustrative embodiment encompasses four possible lamination layers that may be used in the current invention for a wide variety of transportable safety equipment having impact attenuation characteristics. Additionally, FIG. 49 illustrates the use of a multi-layered lamination process in a method aspect of constructing a reinforced lamination football safety helmet.

To regulate the casting environment for a wide variety of cementatious and non-cementatious mixes to suit a variety of casting or injection molding applications specifically for optimizing a variety of safety helmet performance characteristics to obtain the synergistic potentials of high performance safety helmets by controlling the mechanisms for the curing environment to enhance the mix component(s) and mechanisms and to optimize the materials and mix proportions whose properties have been designed to meet specific engineering needs.

In other exemplary embodiments encompass methods and apparatuses for casting reinforcement(s) in helmets such as by casting annular reinforcement(s) within a helmet.

In other exemplary embodiments encompass methods and apparatus for injection molding helmet(s) having a hollow space of a suitable geometric configuration(s) as described herein that is subsequently filled forming the "reinforcement" by injection molding methods known within the art.

In several embodiments encompasses an apparatus such that the "reinforcement" configuration may be specifically pre-engineered and manufactured to control micro-cracking (shrinkage) and (thermal cracking) ranging from simple generic to customized safety helmet shells and having mixes to suit a specific application or as needed.

The "mesh" or "meshes" described and discussed herein have enhanced impact recoil control characteristics. Thus, these mesh(s) as discussed herein need to be produced in high volume, having a specifiable degree of apertures with very low cost. One way to achieve this is to weave in a set of bands of specified width and density as needed with a flat or circular loom. However, the associated post operation involves, after cutting out the panel(s) to size, folding and sewing or linking of two lines to form the mesh in the desired shape as stated herein. And having "Rings" "coils" securement is preferred.

Additionally, the present invention encompasses methods and apparatus, which can inexpensively and efficiently manufacture a wide variety of impact force attenuating reinforcement(s) inside such helmet(s) in high volume with a specifiable range of design of reinforcement(s) having enhanced impact recoil attenuation and return control characteristics and stress dissipation characteristics needed. Thus, the helmet(s) itself is also encompassed by the present invention.

Additionally the "mesh," may comprise a specified number and location of force attenuating reinforcement configurations along the direction of the generally curvilinear dome, oval shaped axis. Furthermore, the width of the reinforcement bands is specifiable by the helmet(s) design(s) as needed.

The method of manufacturing of the mesh(s) may start with the generally oval, ovoid weaving of the yams of the selected materials as an example with a circular loom whereby a generally oval ovoid or optionally flat panel structure is formed with woven warp and weft strands shaped and configured as needed or aperture(s) as needed. Preferably, the direction of the warp strands is parallel to the axis whereas the direction of the weft strands is perpendicular to the general oval, ovoid, curvilinear shaped axis such as helmets and other transportable safety equipment as stated herein.

As there is warp strands at each such band location, the resulting woven wall or panel structure(s) of the band consists of weft strands. With the interlocking power from the warp strands, the flexing weft strands within band create the required apparatus (gaps) or aperture(s) in between than otherwise possible with the presence of interlocking warp strands. These gaps (apertures) within bands are thus form the desired reinforcement attenuating structure(s) for the helmet(s) reinforcements. Therefore, emerging from the circular loom with the adaptation of the invention embodiment is a woven helmet reinforcement structure wherein a number of apertures or gaps, bands are parallel to the helmets axis are built in wherever invention embodiment is disposed along the circumferential periphery of the helmet(s). It is also important to note that, as part of the function of the circular loom, emerging woven structure is actually semi-dome shaped for easiness of subsequent manufacturing and assembly handling as needed to suit a wide variety of helmet manufacturing configuration applications as needed.

As an option, the "woven" "mesh" reinforcement structure(s) may be sectioned off along a set of lines as needed with predetermined spacing to form a set of segments, each segment having the desired set of bands preferably extending axially or as needed.

Thus, an innovative reinforcement structure having a generally oval shaped body panel is described wherein a desired set of bands preferably extending axially is built in or on the body panel. Additionally, an inexpensive and efficient method is described herein for the manufacturing of such reinforcement(s) for safety helmet(s) in high volume. Furthermore, said method and apparatus of manufacturing embodies the adaptation of a set of simple mechanical spacing elements onto an existing circular loom(s).

Figure 52:
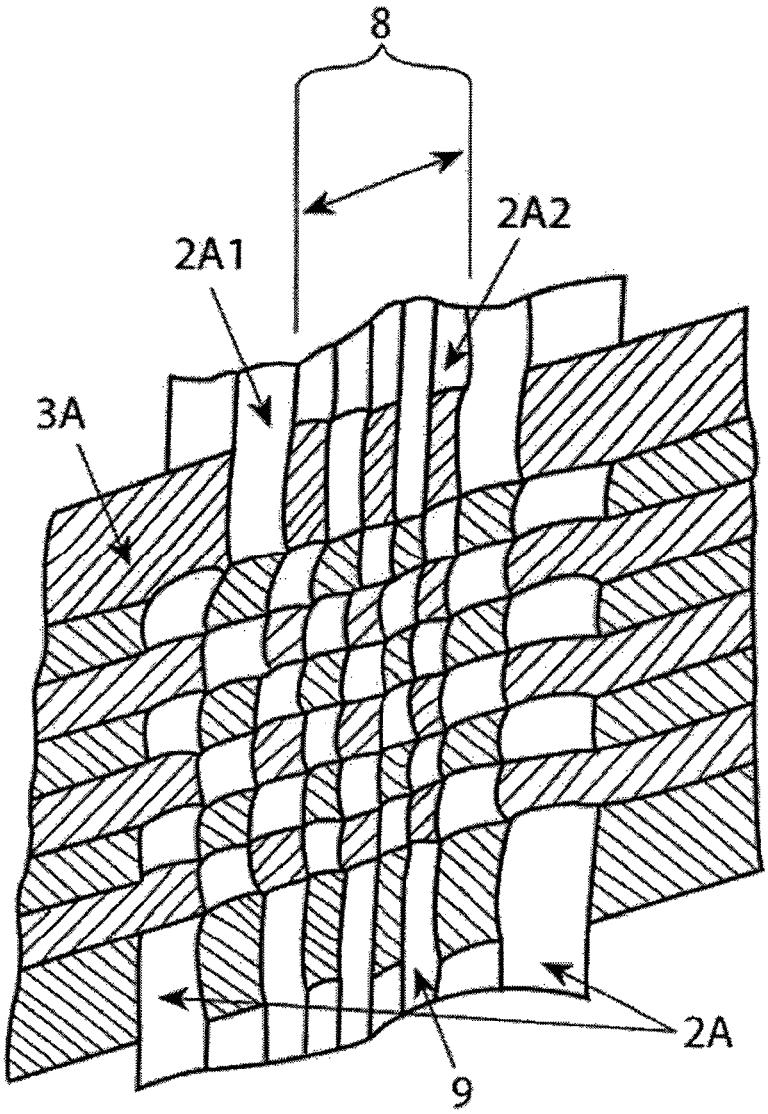
FIG. 52 is a perspective illustration of a small section of the detailed woven structure including the corresponding section of bands made with the present invention.
Figure 53:
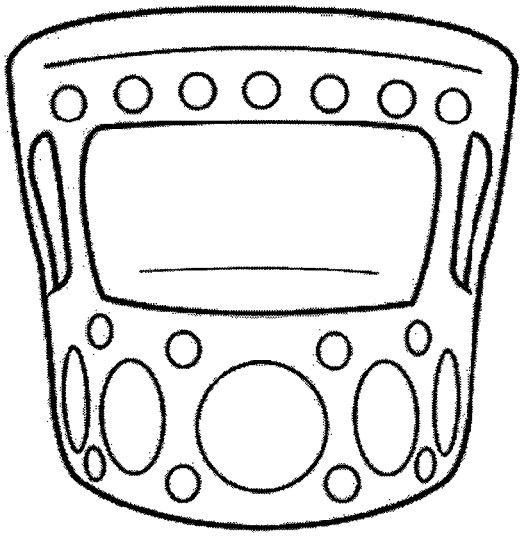
FIG. 53 is a perspective view of an embodiment of a monolithic football helmet also showing a face guard of the present invention.

FIG. 52 illustrates the helmet's body panel 8 comprises many interlocking strands of woven warp 2A and woven weft 3A woven by a conventional circular loom machine. The material for the warp and weft strands may be any of the many materials compatible with the circular loom. Some non-limiting examples are polyethylene, polypropylene and nylon. It is important to note that, as part of the function of the circular loom, the said emerging woven generally dome, oval or flat body panel 8 may be flattened into a continuous belt form and optionally be wound into a roll for easiness of subsequent handling. The top opening of the generally dome, oval or flat body panel 8 is secured together to form a top edge. The top opening comes naturally out of the sectioning operation of the curvilinear body structure into helmet reinforcement segments as needed.

The spaced and interlocking strands of woven warp 2A and woven weft 3A of the prior art does not allow adequate degree of stress displacement means of controllably increasing the degree of displacement must be devised to solve this limitation.

Figure 51A:
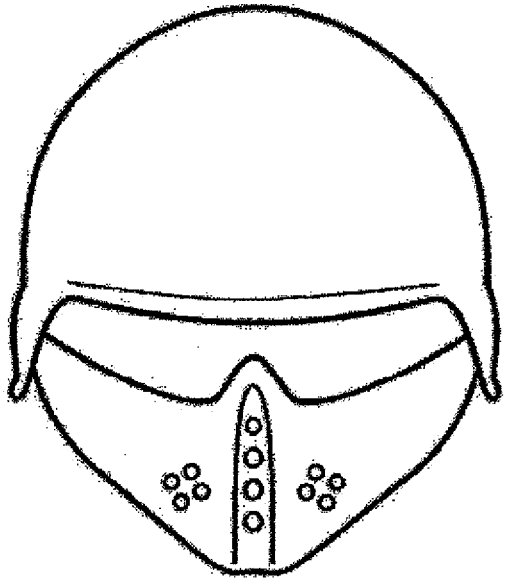
FIGS. 51A and 51B illustrate a simplified illustration of a high performance ballistic modular drop jaw safety helmet employing the current invention's inventive methods and apparatuses, further including methods of manufacturing, as stated herein, such as used in police and military applications, having a modular adjustable drop jaw configuration as illustrated above, whereby the desired degree of impact reinforcement attenuation is obtained.
Figure 51B:
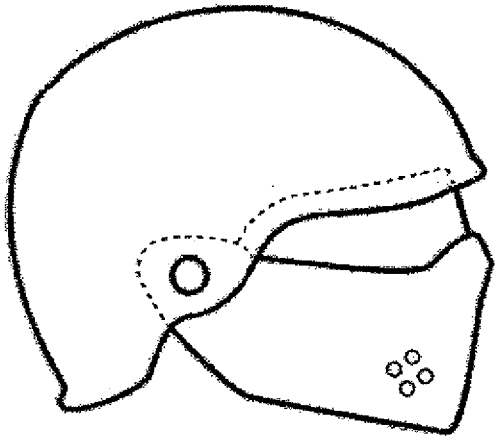

FIG. 51 illustrates a simplified illustration of a high performance ballistic modular drop jaw safety helmet employing the current invention's inventive methods and apparatuses, further including methods of manufacturing, as stated herein, such as used in police and military applications, having a modular adjustable drop jaw configuration as illustrated, whereby the desired degree of impact reinforcement attenuation is obtained.

FIG. 52 illustrates an illustrative embodiment of the current invention. As stated herein, the body panel 8 comprises many tightly interlocking strands of woven warp 2A and woven weft 3A. The top opening of the curvilinear reinforcement panel 8 is sewn together or linked by "coils" sufficiently closed to form a sewn bottom edge. The top opening comes out of the sectioning operation of the reinforcement structure into pre-engineered segments. To suit a wide variety of reinforcement(s) applications, however, around the periphery of the panel a set of bands 9 is disposed. Within each band 9, having both warp and weft strands, having the interlocking power from the woven warp 2A, the flexing woven wefts within the band 9 now create the designed reinforcement apparatus than previously otherwise possible with the presence of interlocking woven warp 2A thus form the desired reinforcement attenuating structure(s) of the current invention to suit a wide variety of reinforcement apparatuses of the present invention.

As an example during the weaving operation, a controlled amount of lateral squeezing force may be produced which causes a smaller apertures a (closer packing) of the woven warp 2A along the edge of the band 9. This is illustrated in FIG. 52, which shows a perspective view of a small section of the detailed woven reinforcement structure including the corresponding section of a pre-engineered aperture band 9 made with the present invention. Along the two edges of the spaced band 9 are formed two squeeze zones 8 wherein both the woven warps in left squeeze zone 2A1 and the woven warps in right squeeze zone 2A2 are suitably spaced and packed with a pitch tighter than elsewhere on the woven web as needed.

It should be understood that, with the present invention, the amount of spacing or aperture for the woven reinforcement(s) can be adjusted and controlled to suit a wide variety of applications with the proper combination of the selection of number, location and size of the expansion block. The invention is applicable, in particularly, to the manufacture of a variety of reinforcements having improved attenuation and dissipation characteristics of a wider range of encountered impacts over the prior art.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

Furthermore, the components, steps, features, objects, benefits and advantages that have been discussed are merely illustrative. None of them, nor the discussions relating to them, is intended to limit the scope of protection in any way. Numerous other embodiments are also contemplated, including embodiments that have fewer, additional, and/or different components, steps, features, objects, benefits and advantages. The components and steps may also be arranged and ordered differently.

It is to be understood that the invention is not limited to the exact details of construction, operation, exact materials, or embodiments shown and described, as obvious modifications and equivalents will be apparent to one skilled in the art.

The following Examples, and forgoing description, are intended to show merely optional configurations for the devices of the invention. Variations, modifications, and additional attachments can be made by one of skill in the art. Thus, the scope of the invention is not limited to any specific Example or any specific embodiment described herein. Furthermore, the claims are not limited to any particular embodiment shown or described herein.

The following discussion addresses optional features and design factors one of ordinary skill in the art may employ in producing a wide variety of helmet(s). Nothing in this discussion should be taken as a limitation to the scope of the invention and the parameters defined here are merely examples of the many embodiments possible. While the optional features and design factors of the helmet(s) noted here can also be used with high performance helmet(s), typical impact conditions may make the discussion below more appropriate for safely helmet(s).

The particular arrangement shown in the figures and described herein is intended to be only one example of a boarding path arrangement or configuration incorporating the principles of the invention. Various details of the invention may be changed without departing from the scope of the invention. Furthermore, the foregoing description of the preferred embodiment of the invention and best mode for practicing the invention are provided for the purpose of illustration only and not for the purpose of limitation, the invention being defined by the claims.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further any specific numbers noted herein are only examples: alternative implementations may employ differing values or ranges.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A helmet assembly comprising:

a shell configured to receive a head of a wearer of the helmet, the shell comprising a reinforcing layer that includes an outer surface and an inner surface, wherein the reinforcing layer comprises a series of linked coils that are entirely encased within a solid filler material, and wherein the series of linked coils are positioned between the outer surface and the inner surface of the reinforcing layer wherein the series of linked coils includes at least first, second and third linked coils that each define an axis, and wherein the axes of the first, second and third linked coils are not co-axial;

wherein the inner surface of the reinforcing layer generally forms a curved plane, and wherein the series of linked coils are arranged in overlapping rows to form a curved plane that is generally parallel to the curved plane of the inner surface of the reinforcing layer.

2. The helmet assembly of claim 1, wherein the amount by volume of the filler material is about the same on either side of the curved plane of the series of linked coils, such that the curved plane of the series of linked coils is located in approximately the middle of the reinforcement layer.

3. The helmet assembly of claim 1, further comprising a face guard having an upper side and a lower side, wherein the face guard has at least one flexible connecting rod affixed proximate the upper side of the face guard, wherein the shell comprises at least one curved receiving channel defined therein that extends generally parallel to the curved plane of the inner surface of the shell, wherein the curved receiving channel is adapted to allow the at least one flexible connecting rod to be removably inserted into the curved receiving channel so as to fasten the face guard to the shell.

4. The helmet assembly of claim 3, further comprising at least one set of three ear ports, the at least one set of three ear ports comprising an upper ear port, a middle ear port, and a lower ear port configured generally in a vertical arrangement, the upper ear port having an opening that is larger than the middle ear port and larger than the lower ear port, and the middle ear port having an opening that is larger than the lower ear port.

5. The helmet assembly of claim 4, further comprising one or more adjustable pentagonal or octagonal memory foam pads affixed proximate the reinforcement layer.

6. The helmet assembly of claim 5, wherein the one or more adjustable pentagonal or octagonal memory foam pads comprised of two or more layers.

7. The helmet assembly of claim 4, further comprising one or more adjustable rounded or ellipsed dome pads affixed proximate the reinforcement layer.

8. The helmet assembly of claim 1 , wherein the filler material is comprised of resin or plastic.

9. The helmet assembly of claim 1, wherein the filler material is selected from the list of: polypropylene, polyethylene, linear low density polyethylene, polyamides, high density polyethylene, polyesters, polystyrene, and polyvinyl chloride.

10. The helmet assembly of claim 1 , wherein the diameter of the linked coils range from about 0.25 inches to about 3 inches.

11. The helmet assembly of claim 10, wherein the linked coils are comprised of metal.

12. The helmet assembly of claim 11, wherein the linked coils are comprised of metal selected from the following list: carbon steel, alloy steel, stainless steels, and tool steel.

13. The helmet assembly of claim 10, wherein the linked coils are comprised of polypropylene, high strength composite, or graphene.

14. The helmet assembly of claim 10, wherein the linked coils are comprised of micro tubes.

15. The helmet assembly of claim 1 , wherein the diameter of the linked coils range from about 0.33 inches to about 2 inches.

16. The helmet assembly of claim 1 , wherein the diameter of the linked coils range from about 0.4 inches to about 1.2 inches.

17. The helmet assembly of claim 1 , wherein the number of linked coils that overlap ranges from 1 to 10.

18. The helmet assembly of claim 1 , wherein the number of linked coils that overlap ranges from 4 to 5.

19. The helmet assembly of claim 1, wherein the outer surface of the reinforcing layer comprises one or more openings through which the linked coils are visible.

20. The helmet assembly of claim 19, wherein the linked coils are treated with a color changing dye.

21. The helmet assembly of claim 1, wherein the filler material is a bonding material.

22. The helmet assembly of claim 1 wherein the series of linked coils are arranged in overlapping rows.

23. The helmet assembly of claim 1 wherein each of the coils includes a central opening, and wherein the filler material is disposed within the central opening of each of the coils.

24. The helmet assembly of claim 1 wherein the shell comprises an outer layer having an inner surface, and wherein the reinforcement layer is positioned proximate the inner surface of the shell.

25. The helmet assembly of claim 1 wherein the series of linked coils has an outer surface, and wherein the entire outer surface of the series of linked coils is encased in the solid filler material.

26. A helmet assembly comprising:

a shell configured to receive a head of a wearer of the helmet, the shell comprising an outer surface and an inner surface, the inner surface of the shell generally forming a curved plane;

a face guard having an upper side and a lower side;

wherein the face guard has at least one flexible connecting rod affixed proximate the upper side of the face guard;

wherein the shell comprises at least one curved receiving channel defined therein that extends generally parallel to the curved plane of the inner surface of the shell, wherein the curved receiving channel is designed to allow the at least one flexible connecting rod to be removably inserted into the curved receiving channel so as to fasten the face guard to the shell.

27. The helmet assembly of claim 26, further comprising at least one set of three ear ports, the at least one set of three ear ports comprising an upper ear port, a middle ear port, and a lower ear port configured generally in a vertical arrangement, the upper ear port having an opening that is larger than the middle ear port and larger than the lower ear port, and the middle ear port having an opening that is larger than the lower ear port.

28. The helmet assembly of claim 27, wherein one or more adjustable pentagonal or octagonal memory foam pads are positioned on the reinforcement layer.

29. The helmet assembly of claim 28, wherein the one or more adjustable pentagonal or octagonal memory foam pads are comprised of two or more layers.

30. The helmet assembly of claim 27, further comprising one or more adjustable rounded or ellipsed dome pads affixed proximate the inner surface of the shell.

31. The helmet assembly of claim 27, wherein the outer surface of the shell comprises one or more openings through which the linked coils are visible.

32. The helmet assembly of claim 31, wherein the linked coils are treated with a color changing dye.

33. The helmet assembly of claim 26, wherein the shell includes a reinforcement layer that is comprised of a series of linked coils encased within a filler material.

34. The helmet assembly of claim 33, wherein the series of linked coils are arranged in overlapping rows to form a curved plane that is generally parallel to the curved plane of the inner surface of the shell.

35. The helmet assembly of claim 33, wherein the linked coils are comprised of metal.

36. The helmet assembly of claim 33, wherein the linked coils are comprised of polypropylene, high strength composite, or graphene.

37. The helmet assembly of claim 33, wherein the filler material is a bonding material.

* * * * *